US005437460A

United States Patent [19]

Cho

[11] Patent Number: 5,437,460

[45] Date of Patent: Aug. 1, 1995

[54] METHOD OF PLAYING MULTIPLE PLAYER STRATEGY GAME

[76] Inventor: Chin-Kuei Cho, 8805 Saunders La., Bethesda, Md. 20817

[21] Appl. No.: 269,343

[22] Filed: Jun. 30, 1994

[51] Int. Cl.[6] ..... A63F 3/02

[52] U.S. Cl. ..... 273/262

[58] Field of Search ..... 272/242, 260, 261, 262, 272/263

[56] References Cited

U.S. PATENT DOCUMENTS

| | | | |
|---|---|---|---|
| 3,048,404 | 8/1962 | Tebbs | 273/262 |
| 3,433,482 | 3/1969 | Castellano | 273/261 |
| 4,147,360 | 4/1979 | Bailey | 273/261 |
| 4,552,364 | 11/1985 | Shaffer | 273/260 |
| 4,753,441 | 6/1988 | Braus et al. | 273/261 X |

FOREIGN PATENT DOCUMENTS

| | | | |
|---|---|---|---|
| 8204467 | 6/1984 | Netherlands | 273/261 |
| 13190 | of 1915 | United Kingdom | 273/262 |

OTHER PUBLICATIONS

"Commander", *Playthings Magazine*, Jun. 1988, p. 75.

*Primary Examiner*—William E. Stoll

[57] ABSTRACT

A strategic game for two, three, or four players is disclosed. The players, utilizing nine playing pieces each, engage in a strategic game on an original game board. The objective of the games is for a princess and her team of patriots to win over all of the other princesses, and vice versa. The game board comprises four square kingdoms separated by two intersecting blank rectangles that form a cross in the middle. Each kingdom consists of twenty five intersecting points for each player. Each set of playing pieces, including a princess, an angel, an elephant, an eagle, a horse, a tiger, and three monkeys, is distinguished from the other sets by differentiating characteristics such as colors for each player. The starting positions and movements of the playing pieces on the game board proceed according to a set of game rules. The game ends when a princess wins over all of the other princesses. The game board, the thirty six playing pieces, and their movement abilities under the game rules form a novel, intellectually challenging, and entertaining strategic game.

2 Claims, 71 Drawing Sheets

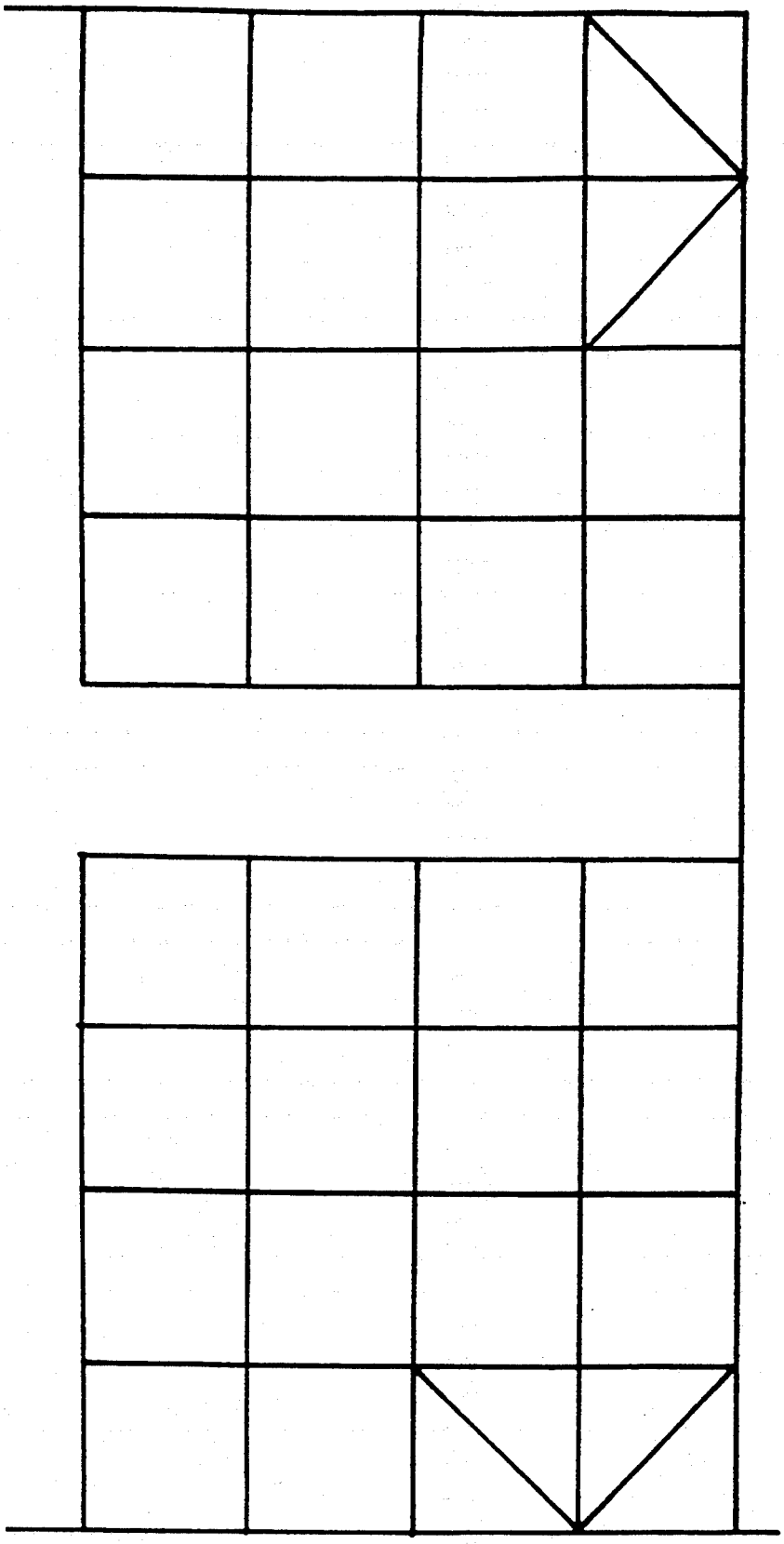
FIG. 1B 5 6 7 8 9 X

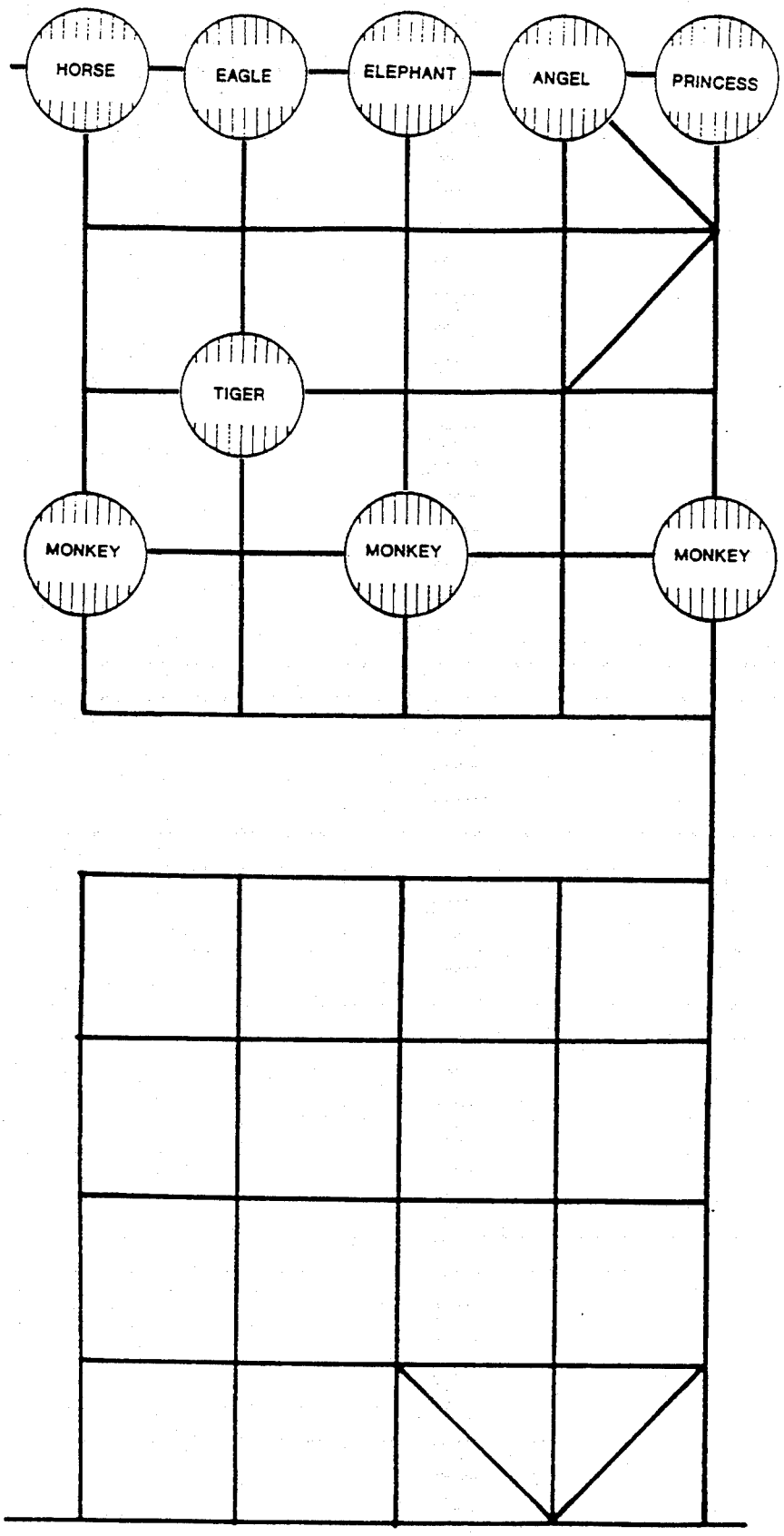
FIG. 4B 5 6 7 8 9 X

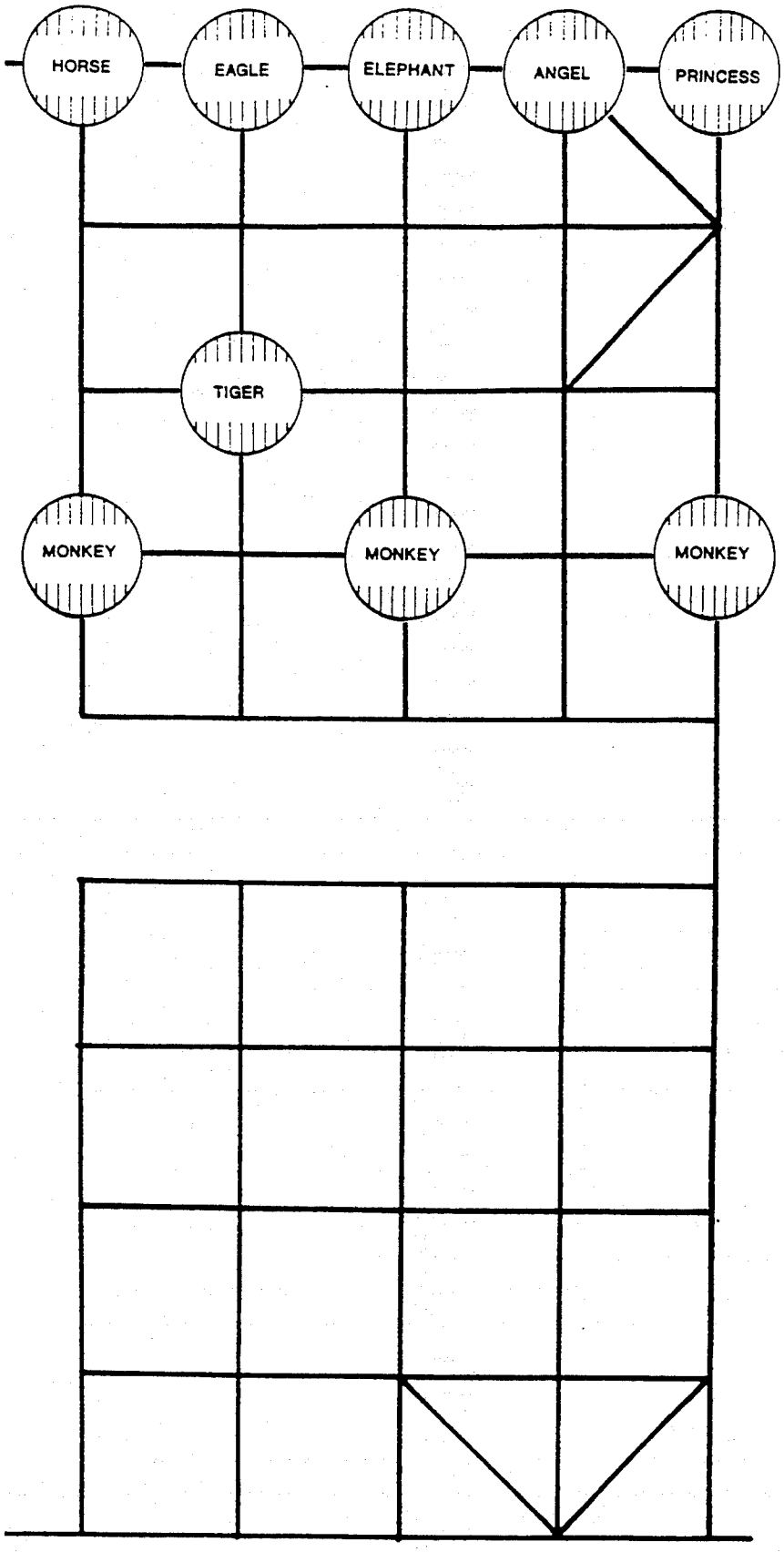
FIG. 5B 5 6 7 8 9 X

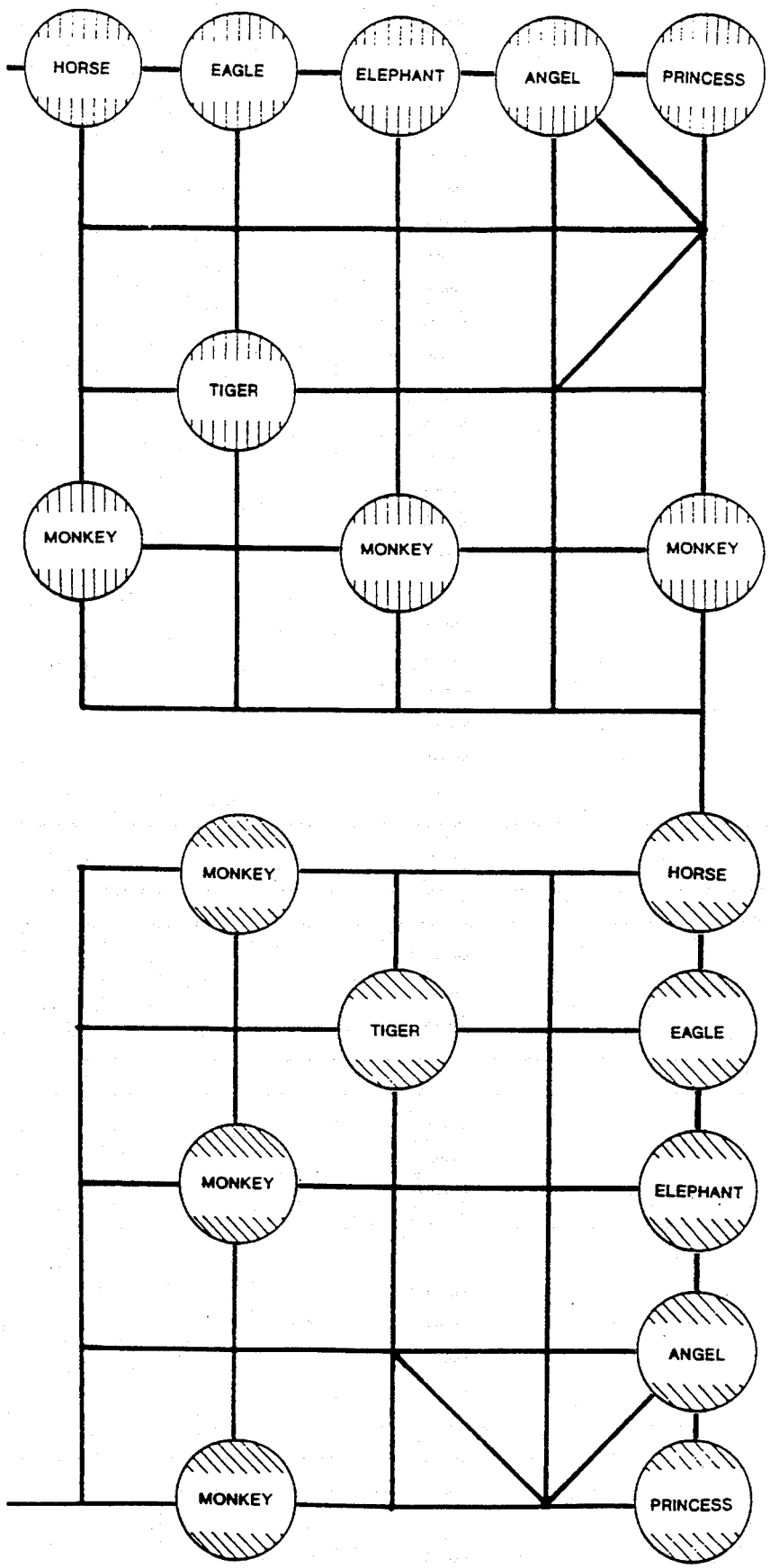
FIG. 6B 5 6 7 8 9 X

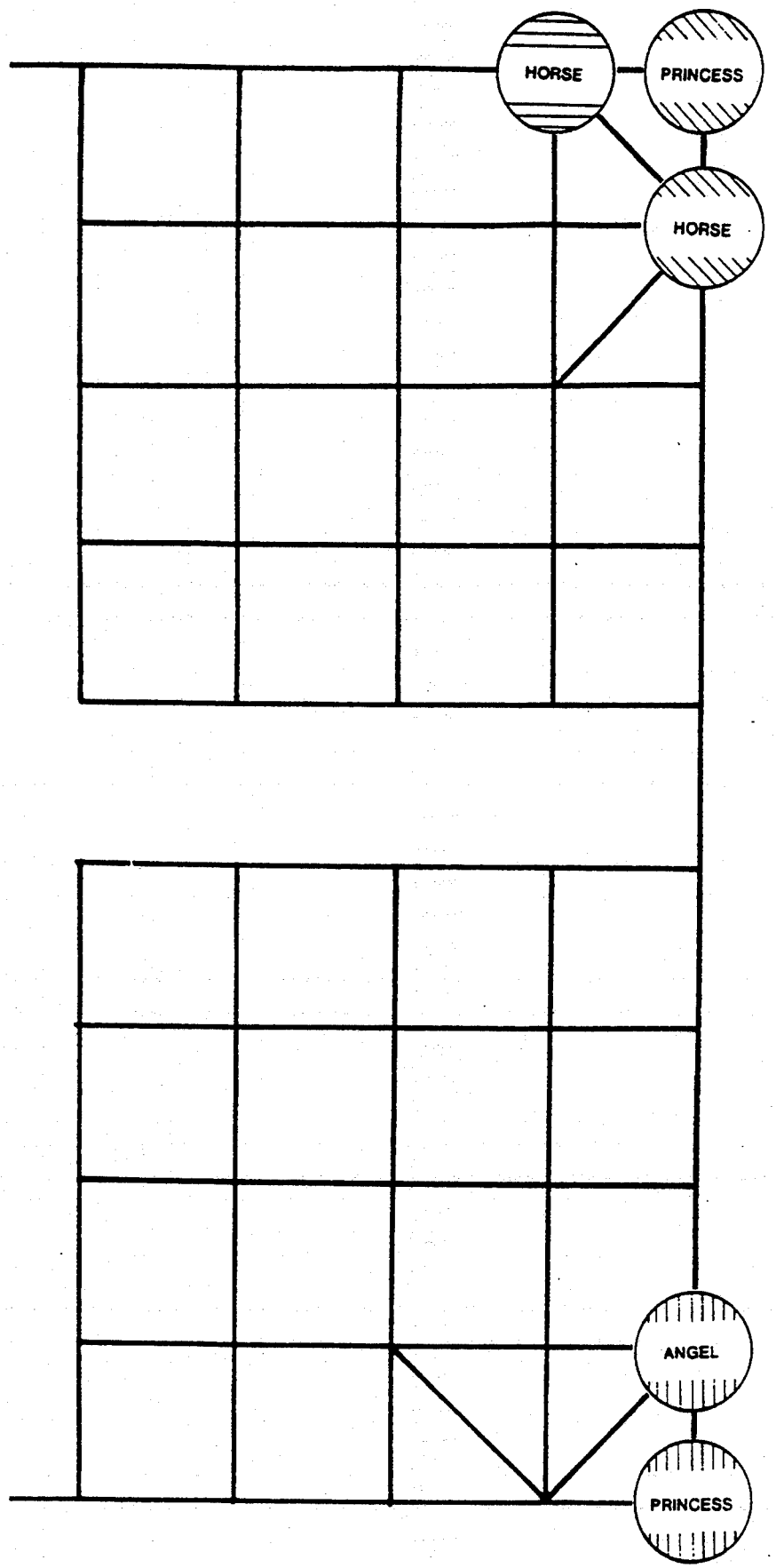
FIG. 7B 5 6 7 8 9 X

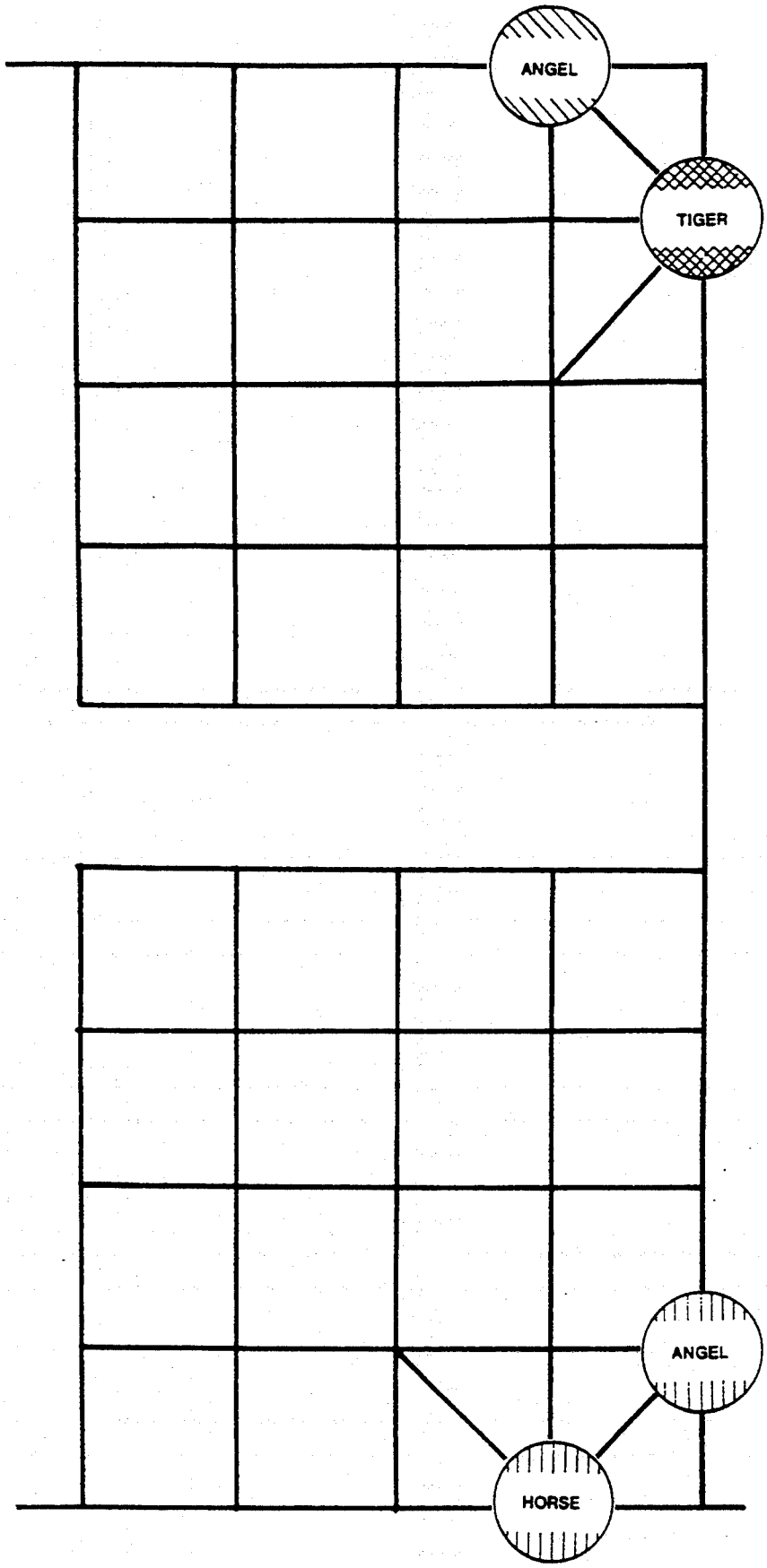
FIG. 8B 5 6 7 8 9 X

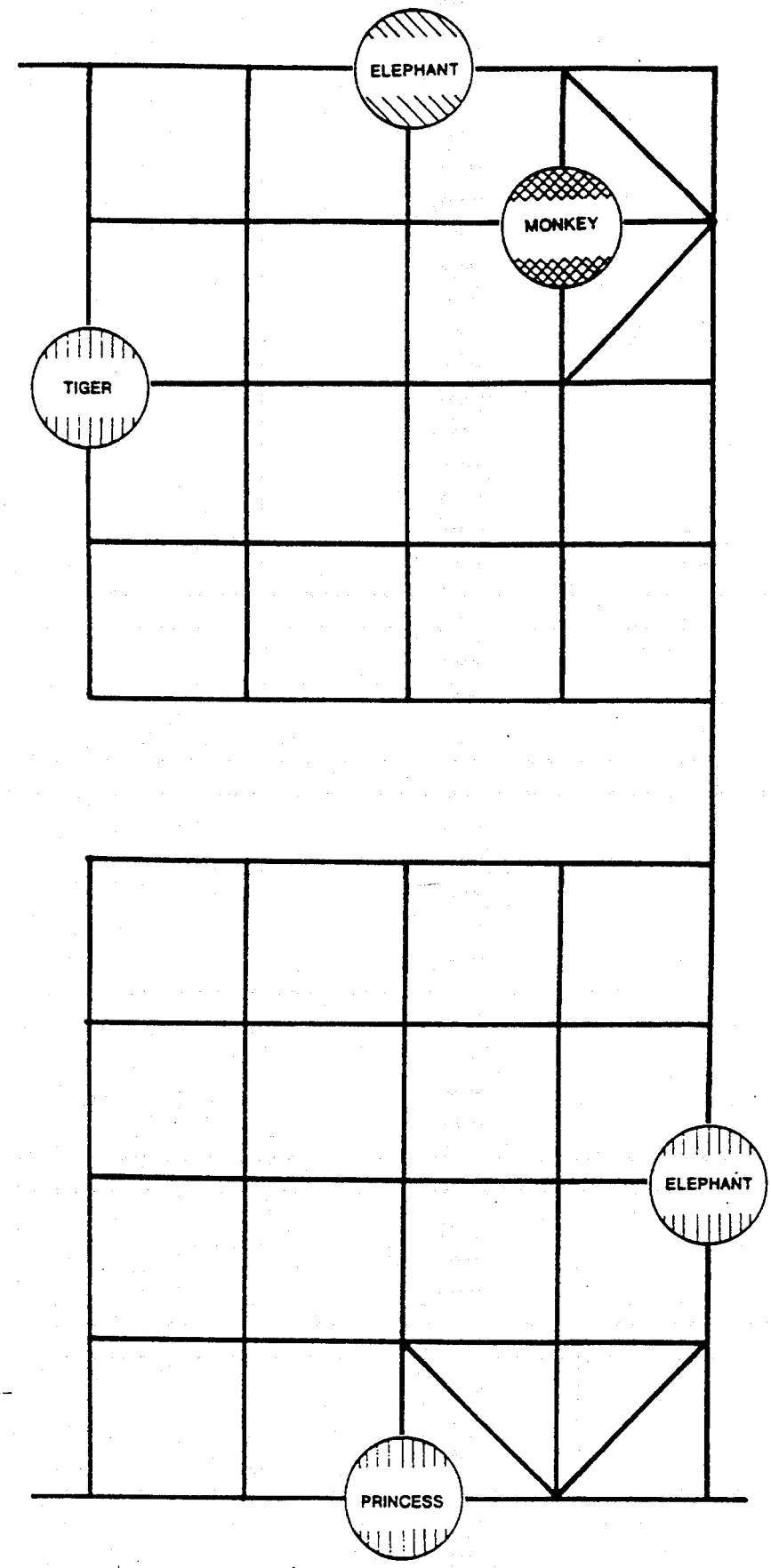
FIG. 9B 5 6 7 8 9 X

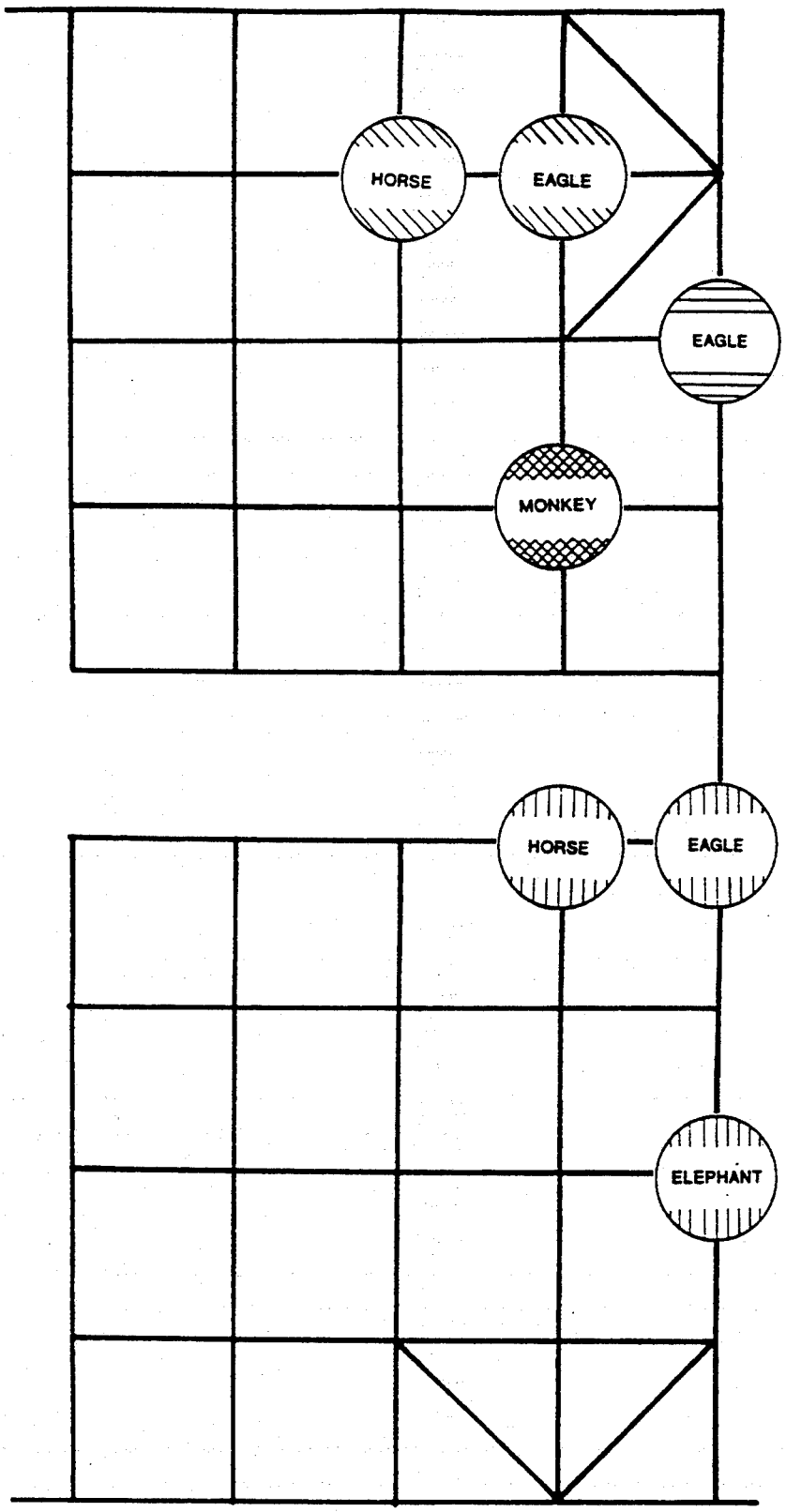
FIG. 10B 5 6 7 8 9 X

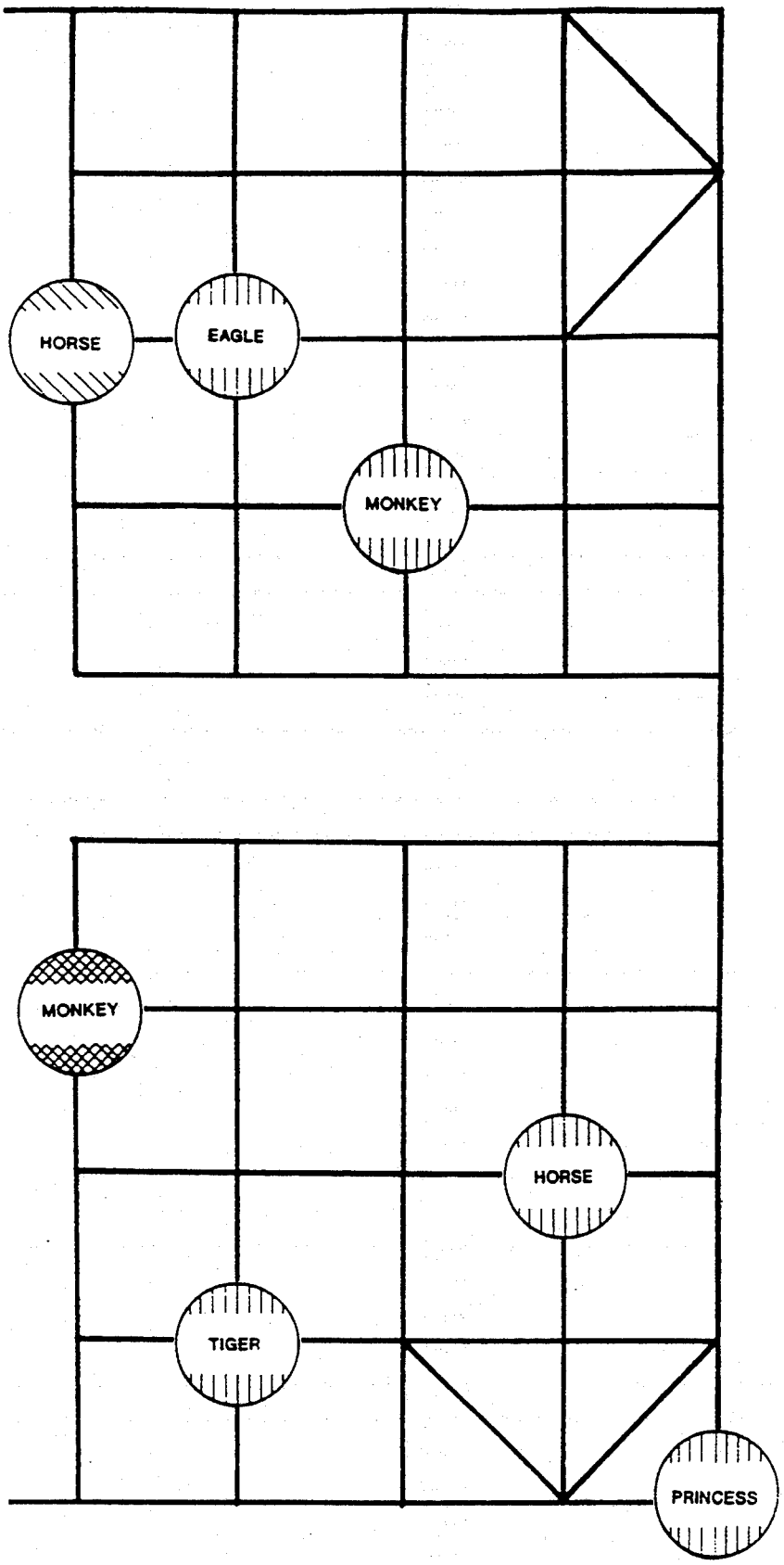
FIG. 11B 5 6 7 8 9 X

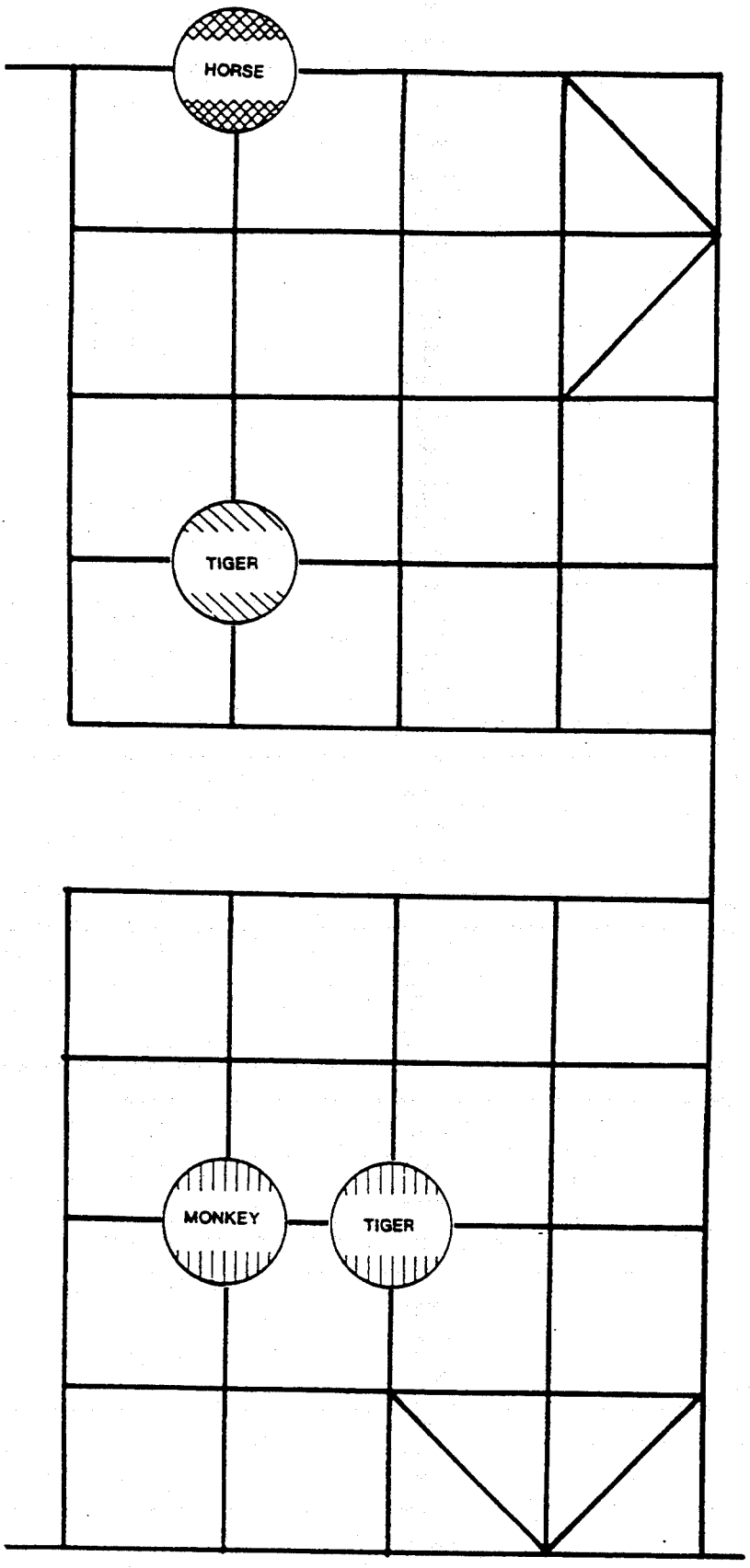
FIG. 12B 5 6 7 8 9 X

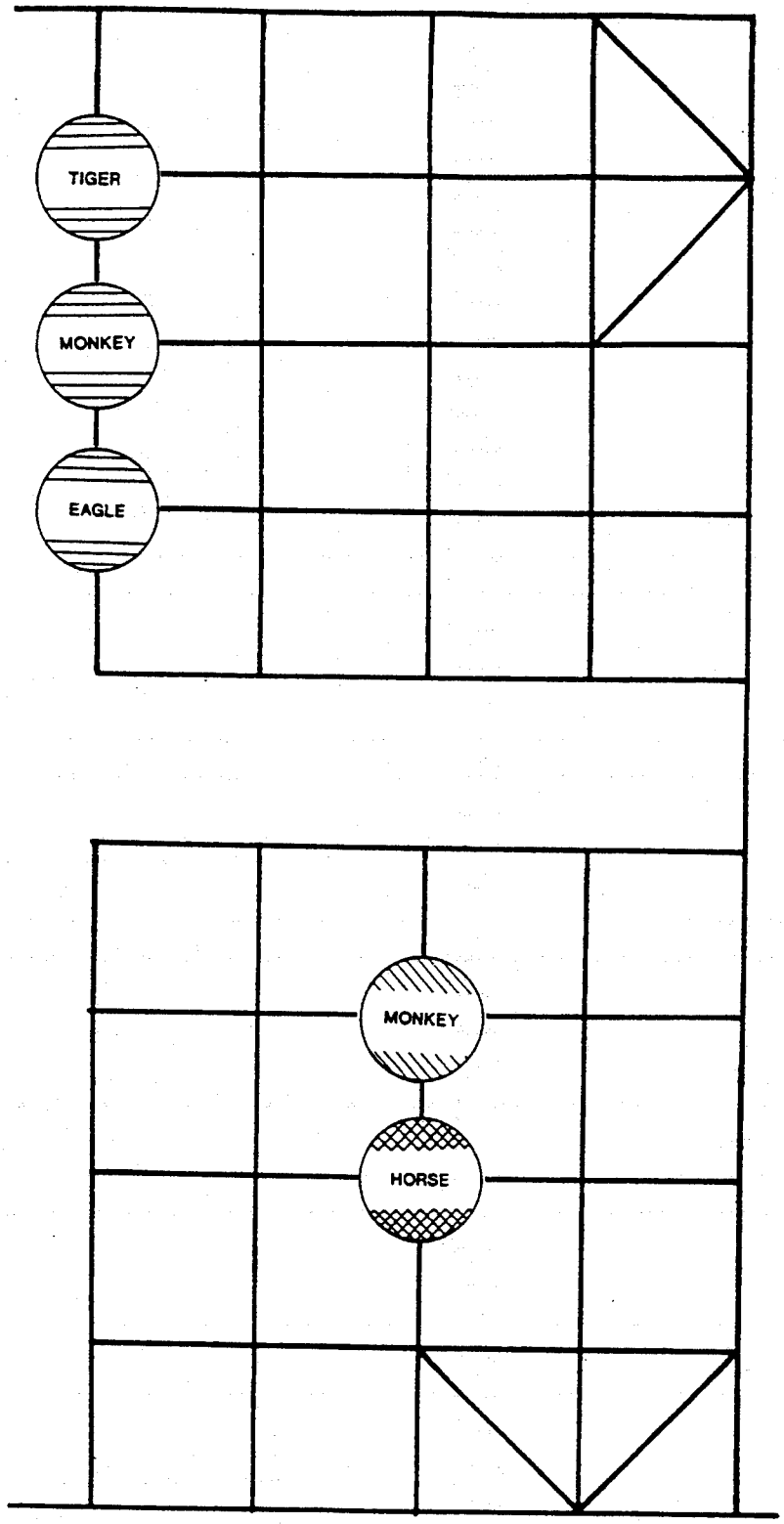
FIG. 13B 5 6 7 8 9 X

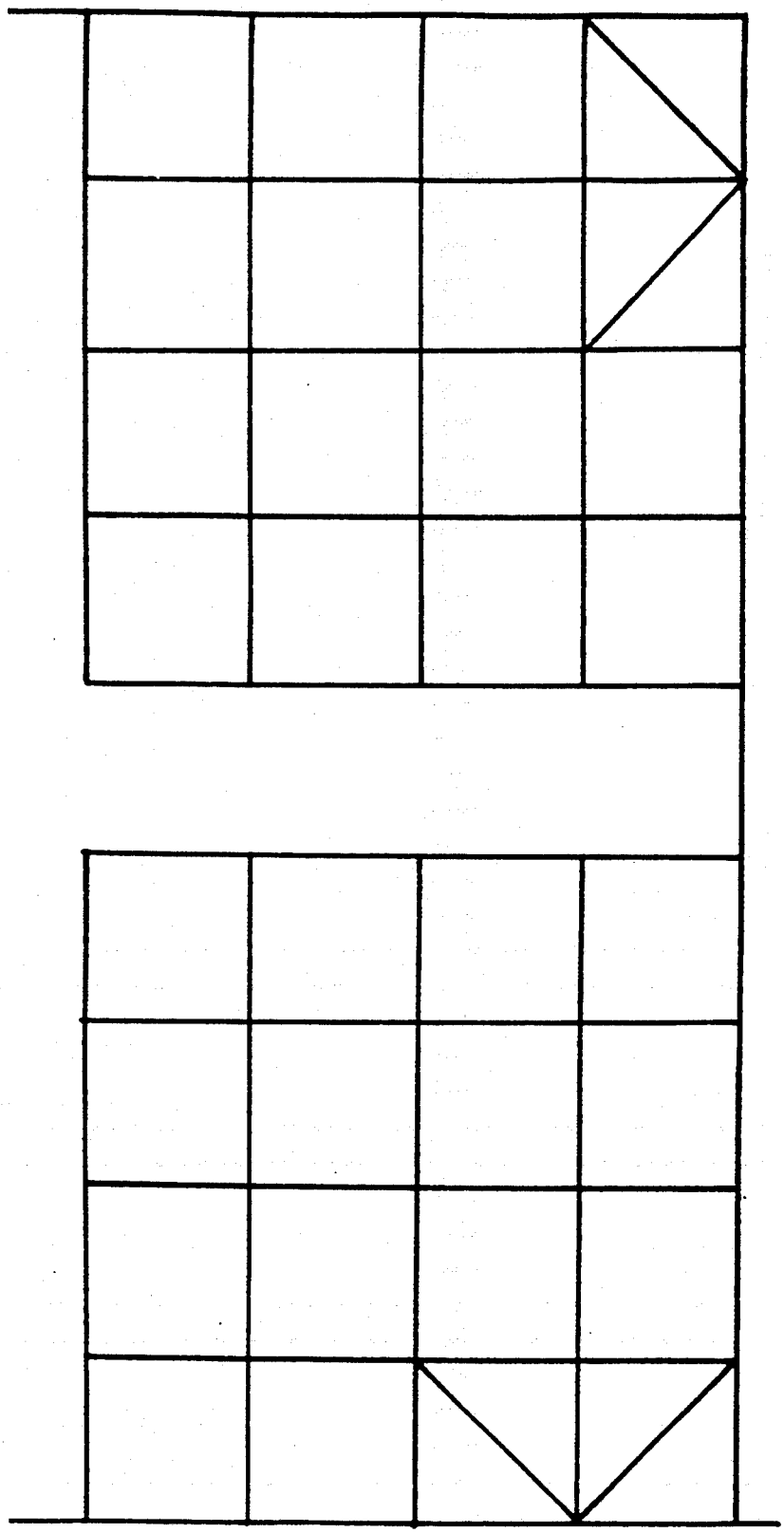
FIG. 14B 5 6 7 8 9 X

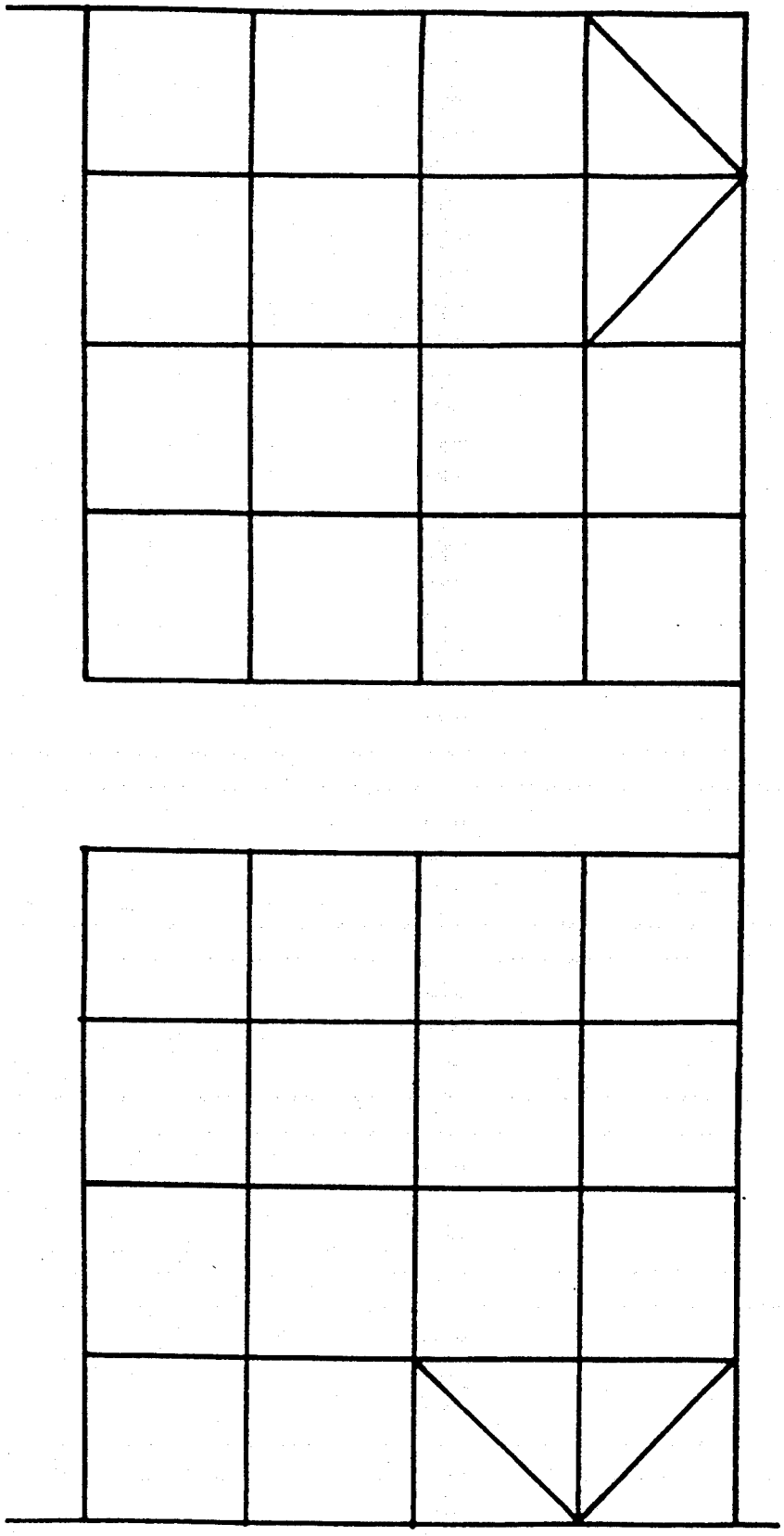
FIG. 15B 5 6 7 8 9 X

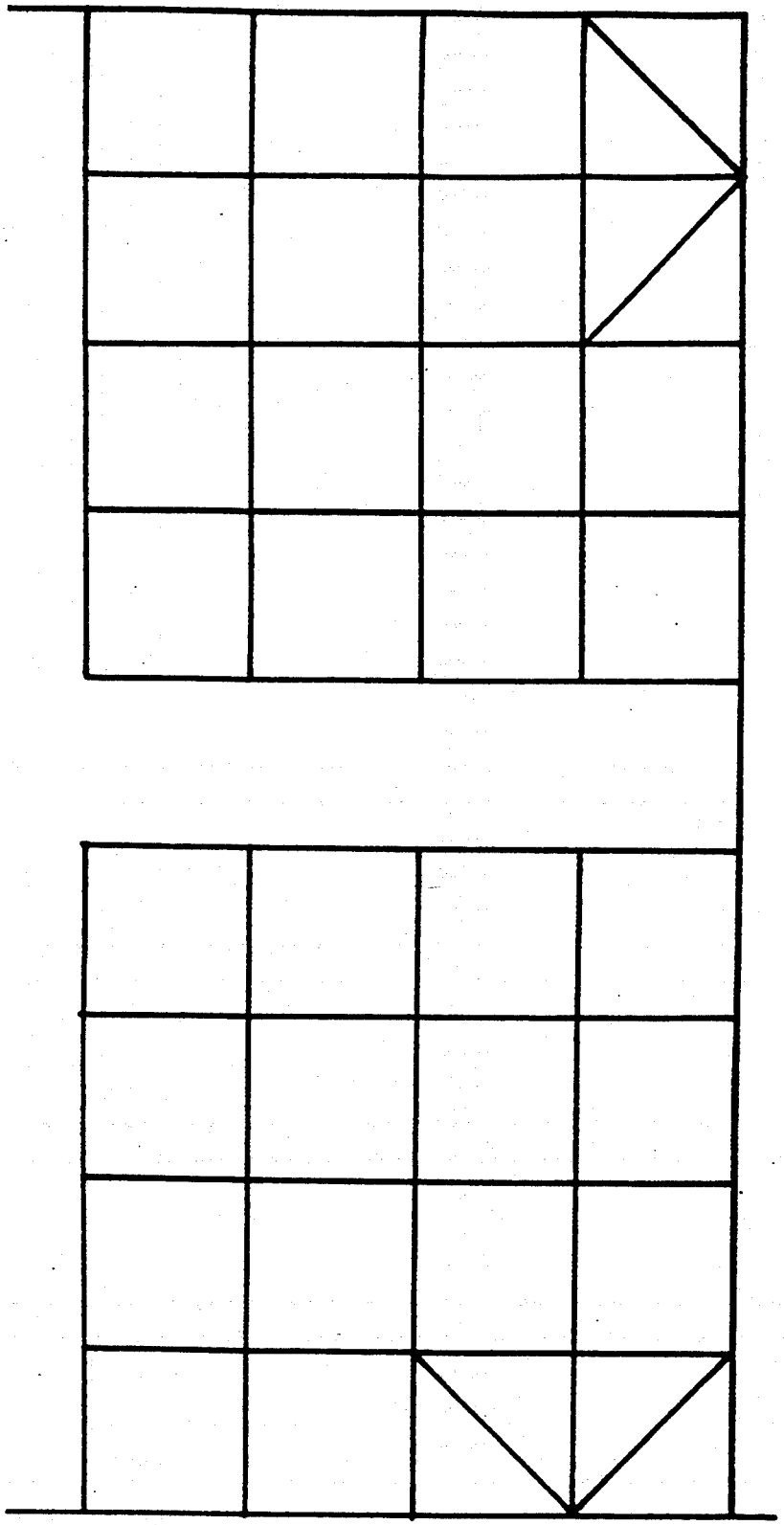
FIG. 16B 5 6 7 8 9 X 5 6 7 8 9 X

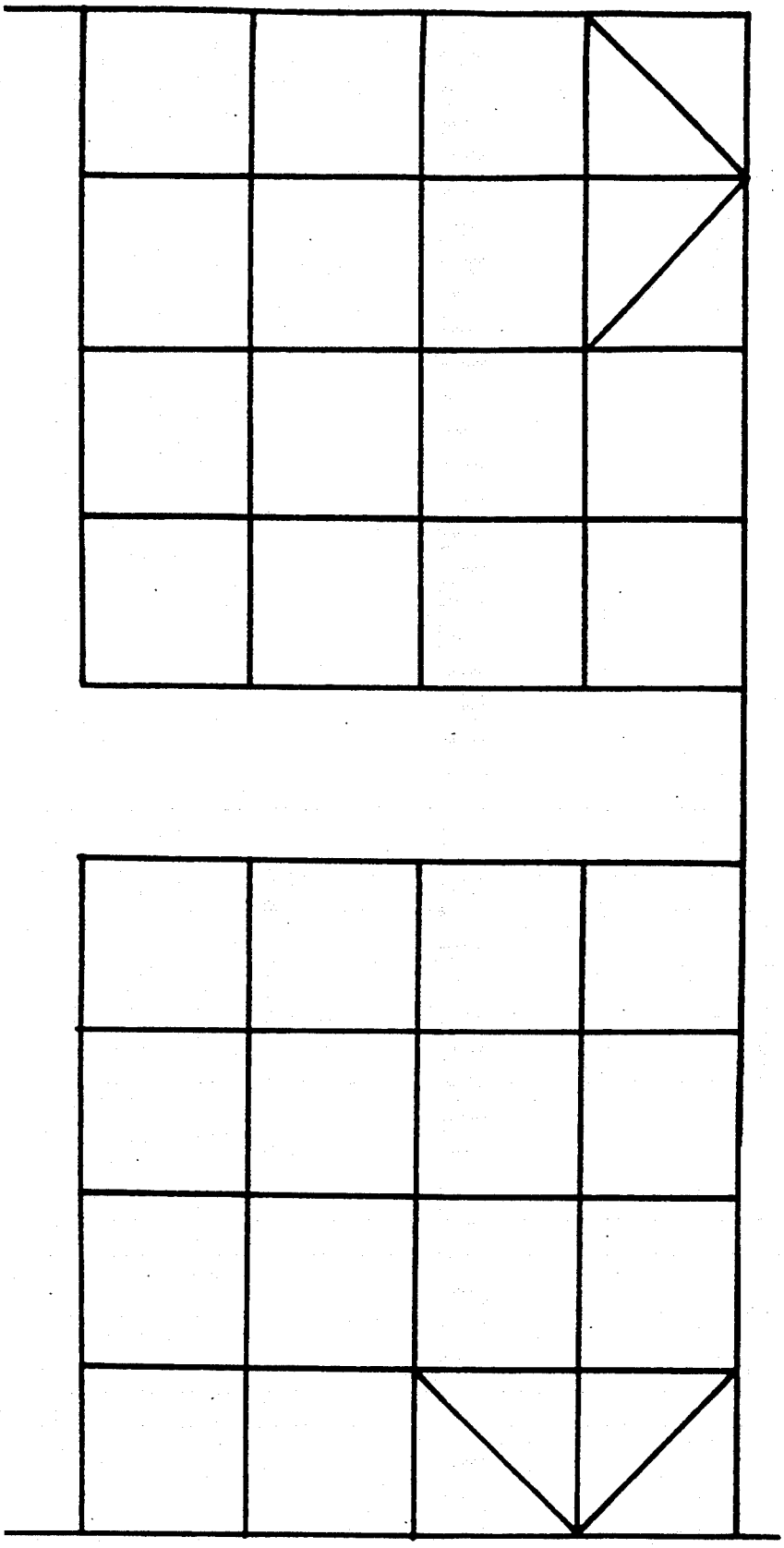
FIG. 18B 5 6 7 8 9 X

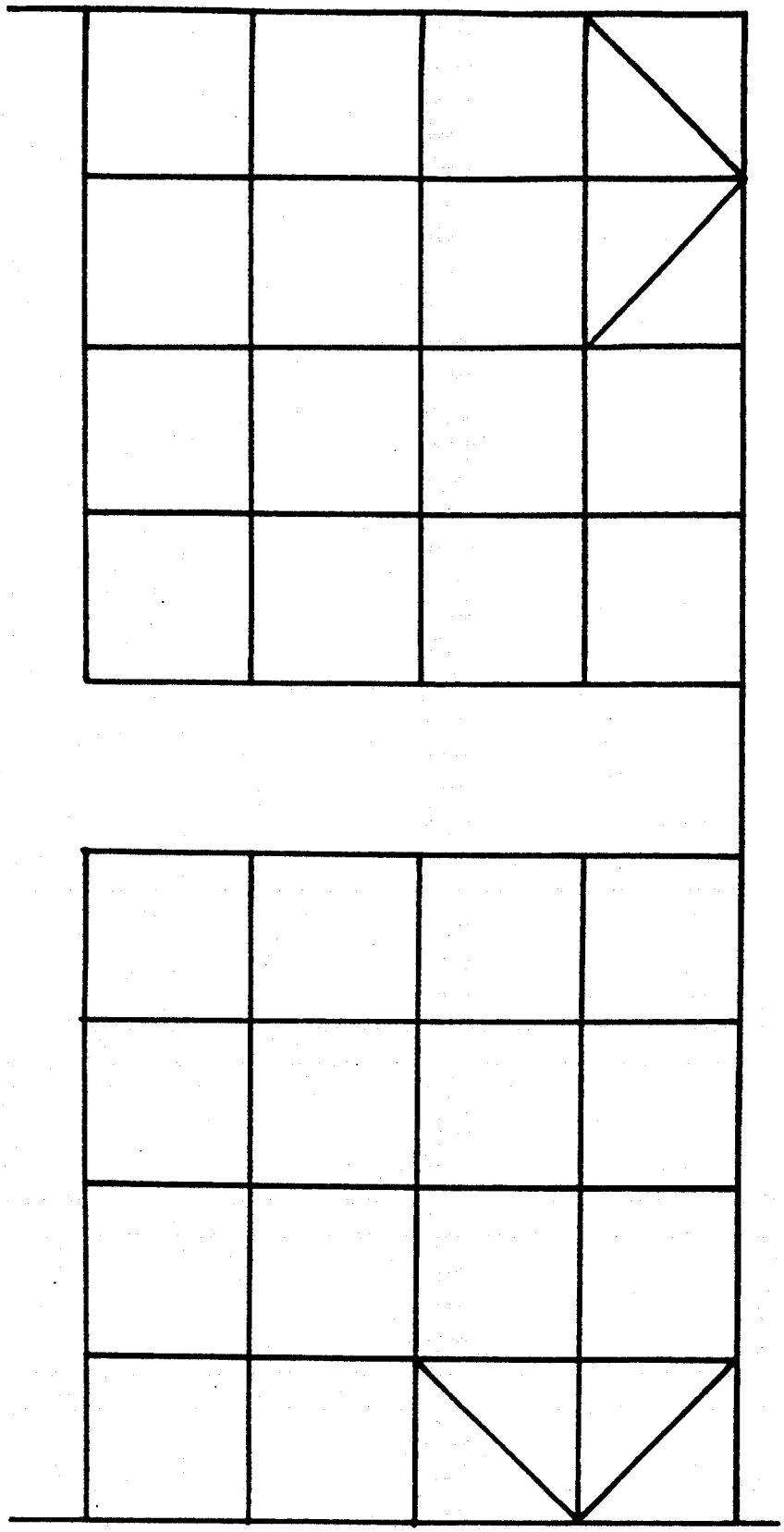
FIG. 19B 5 6 7 8 9 X

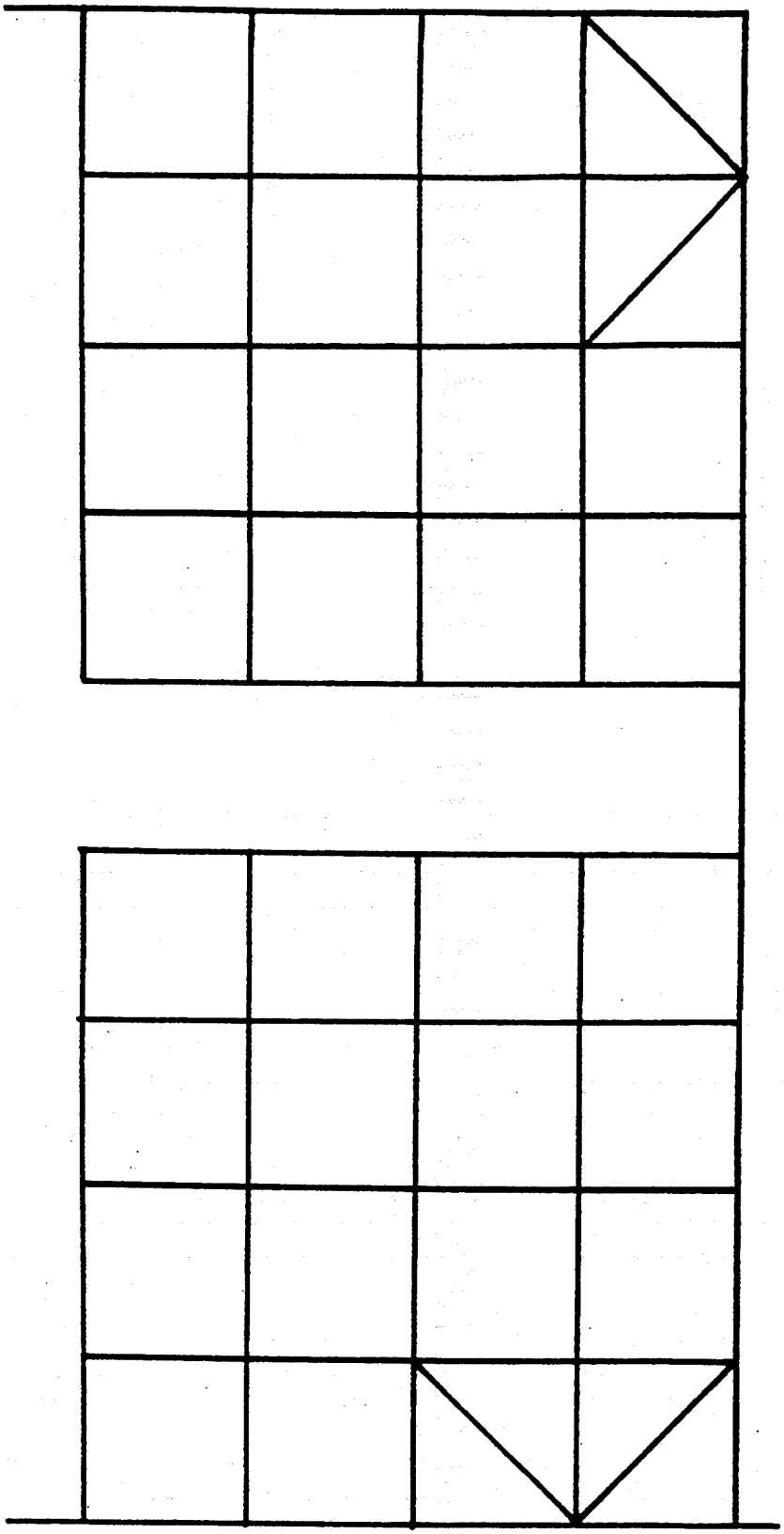
FIG. 20B 5 6 7 8 9 X

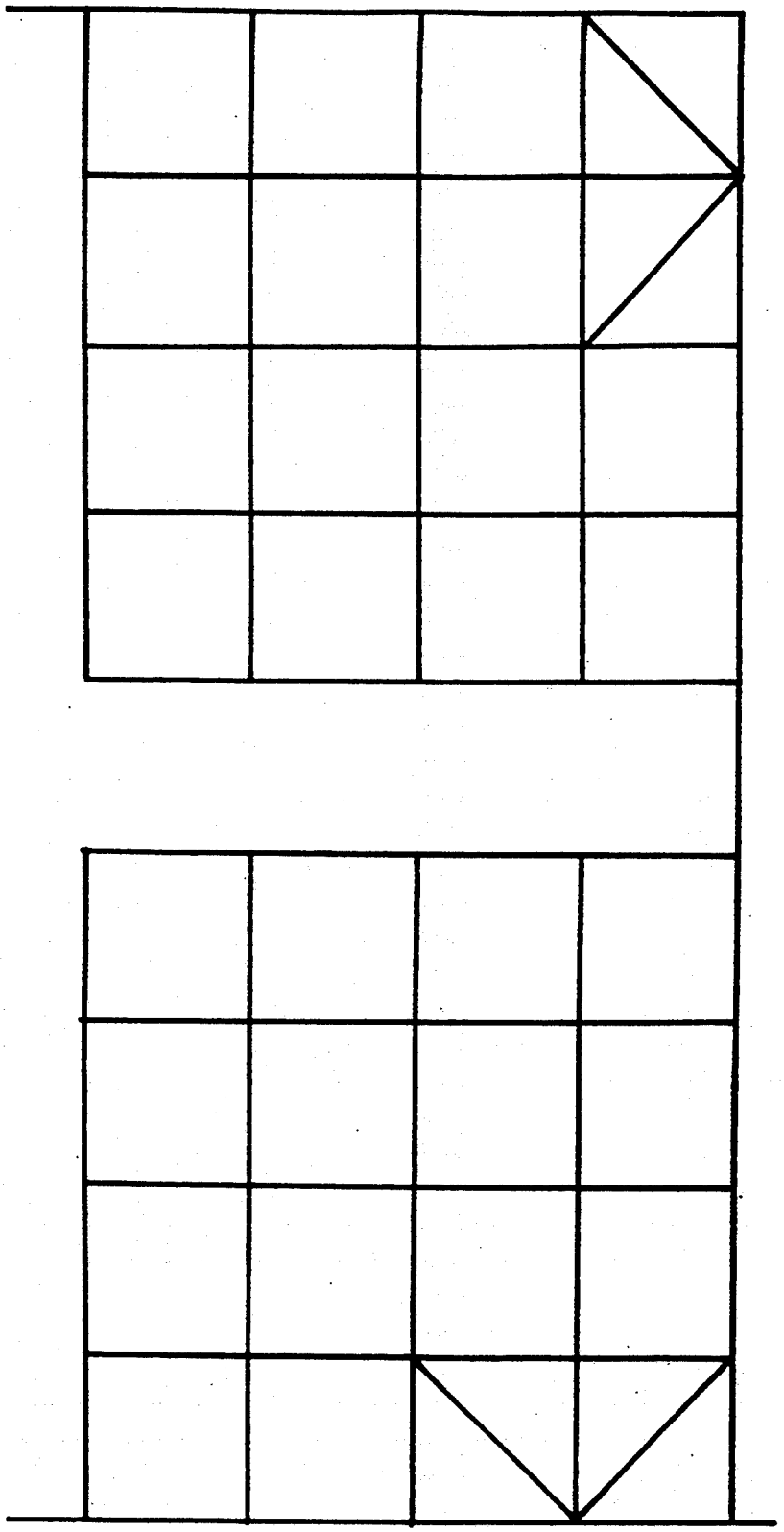
FIG. 21B 5 6 7 8 9 X

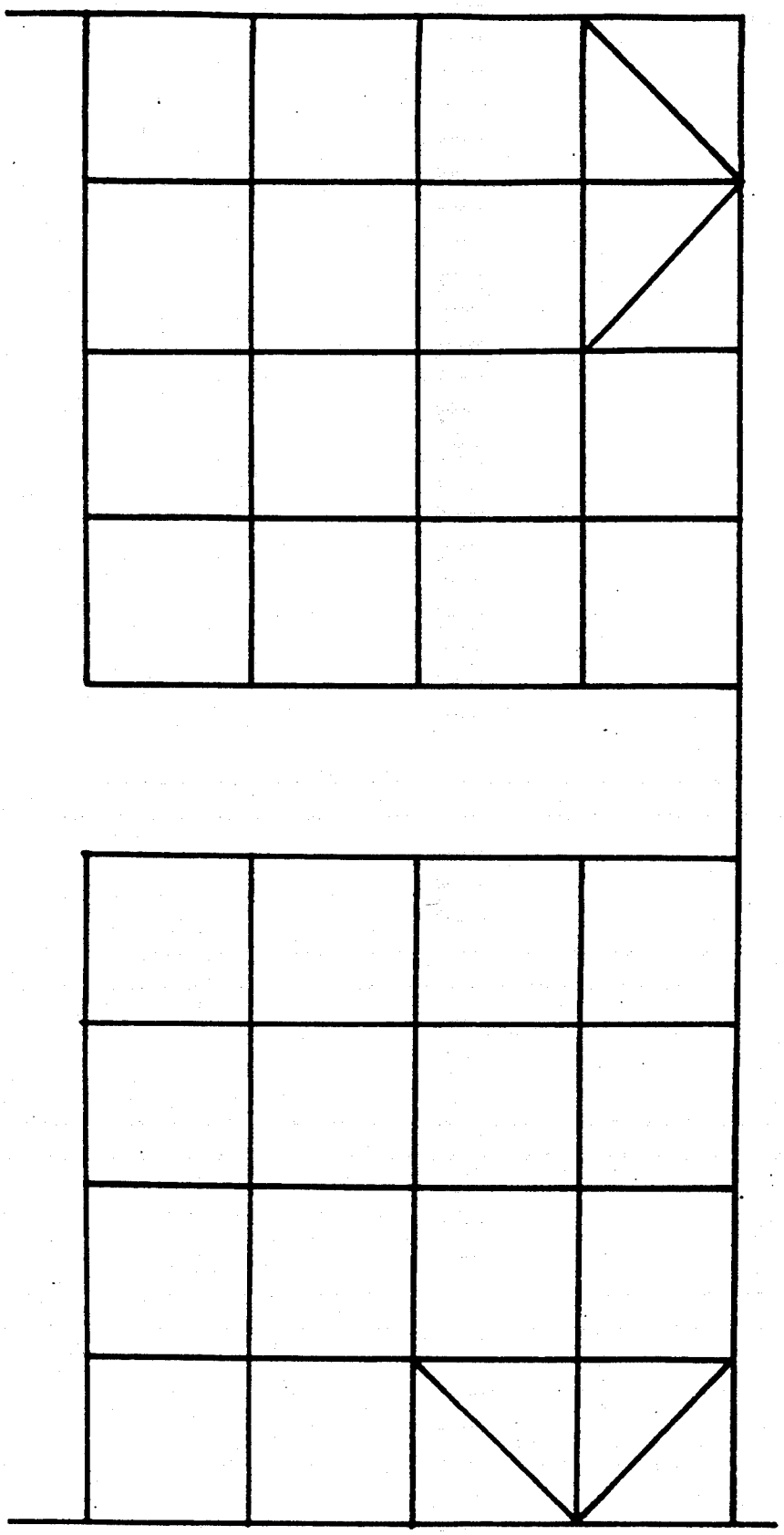
FIG. 22B 5 6 7 8 9 X

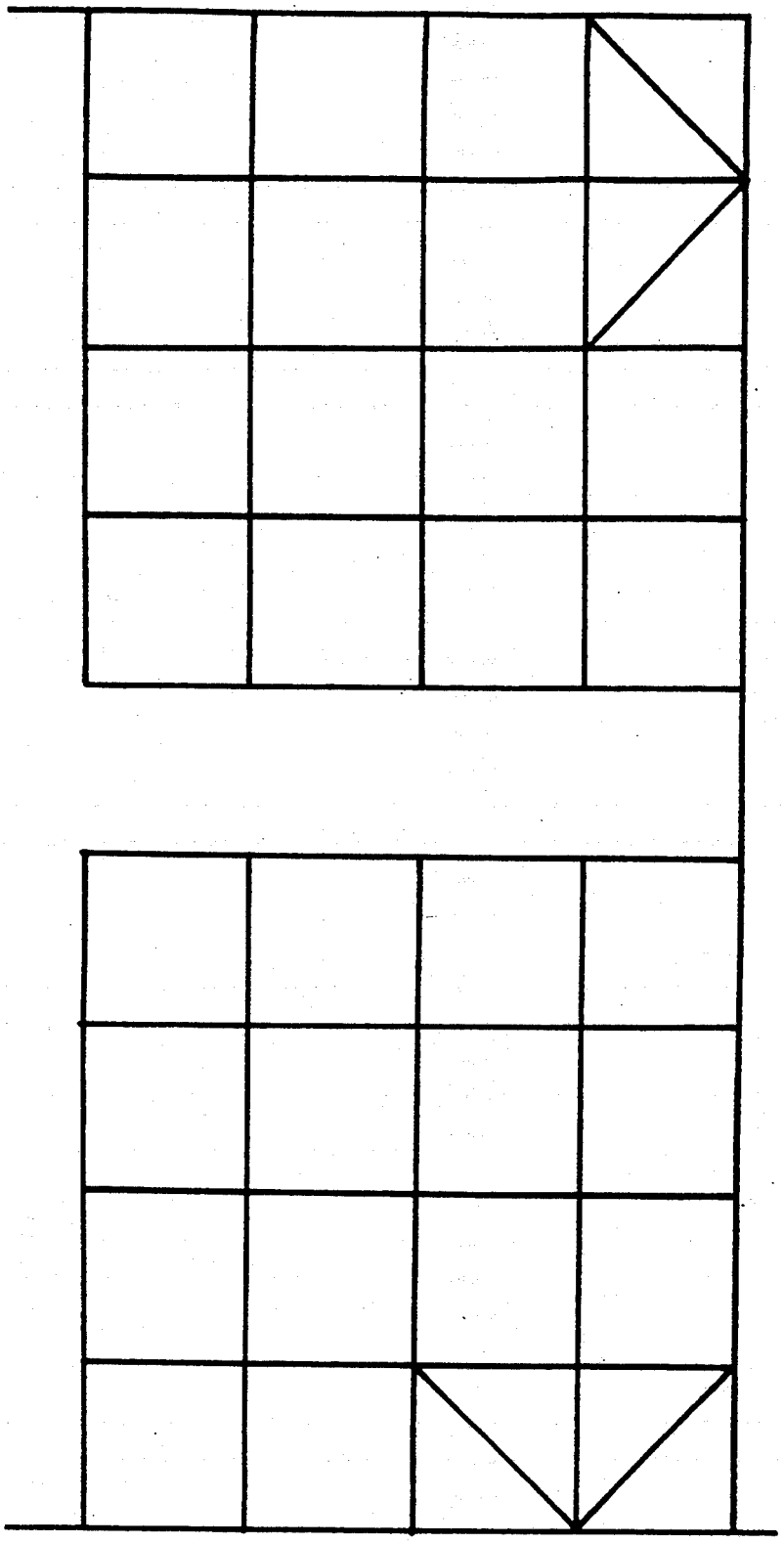
FIG. 23B 5 6 7 8 9 X

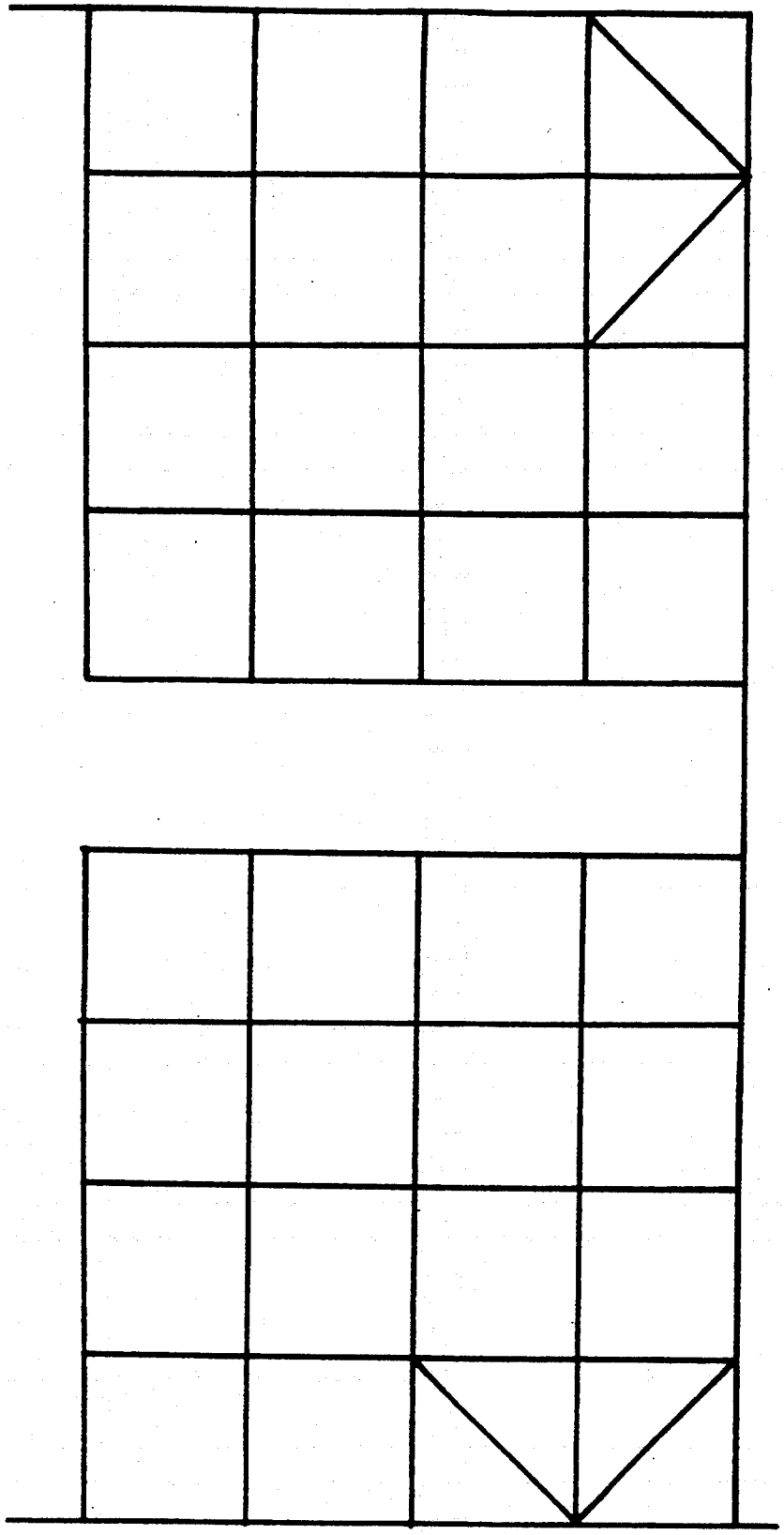
FIG. 24B 5 6 7 8 9 X

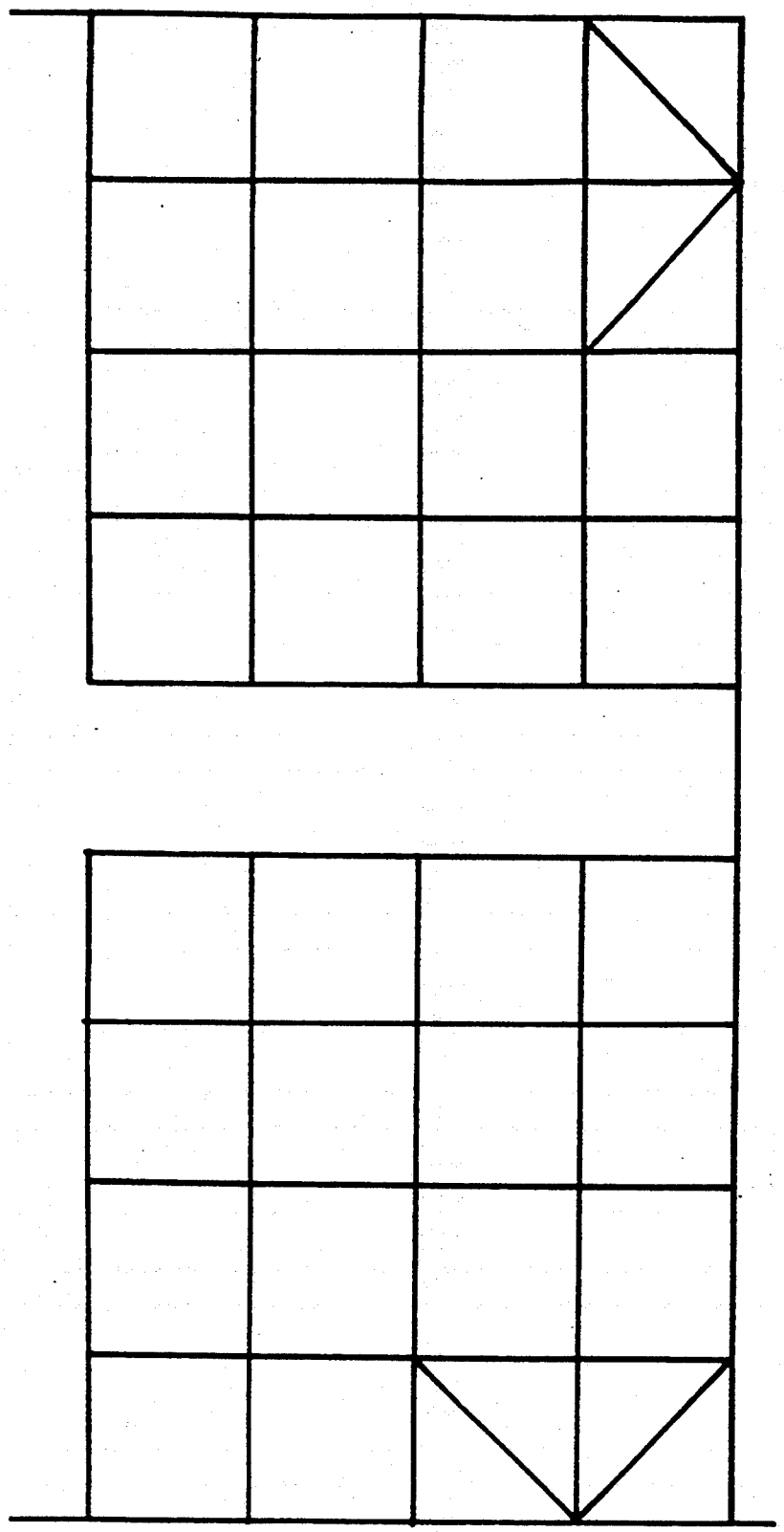
FIG. 25B 5 6 7 8 9 X

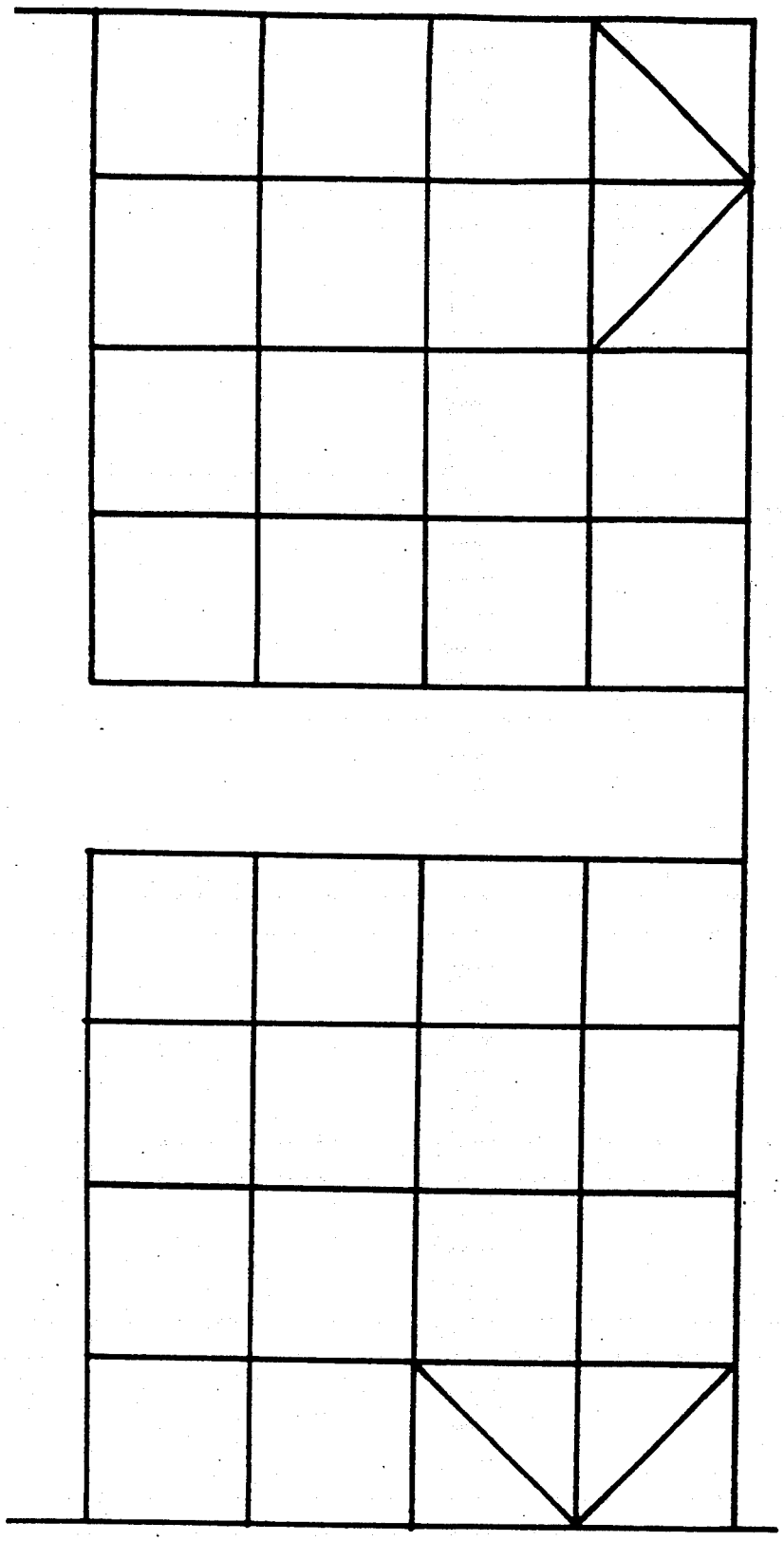
FIG. 26B 5 6 7 8 9 X

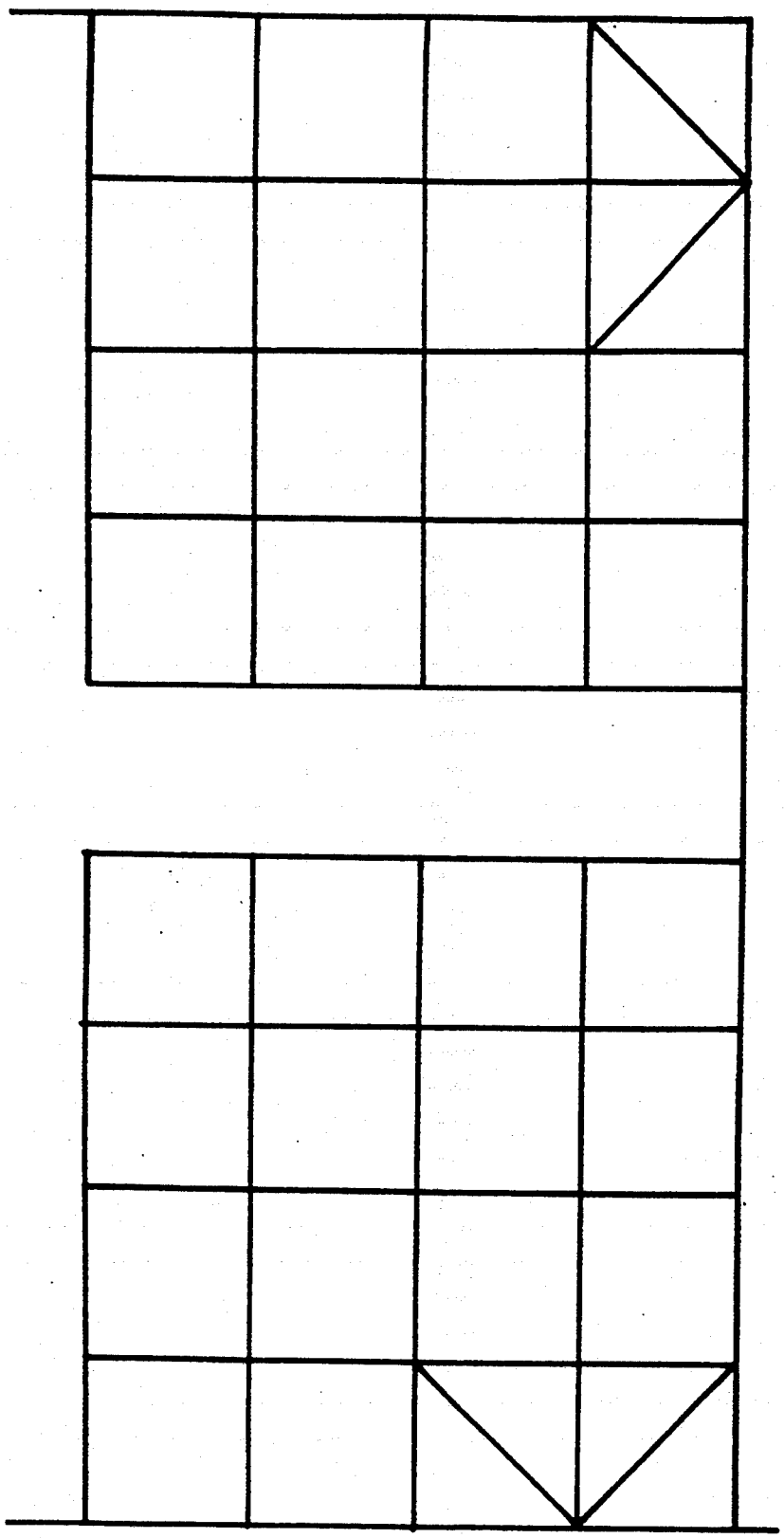
FIG. 27B 5 6 7 8 9 X

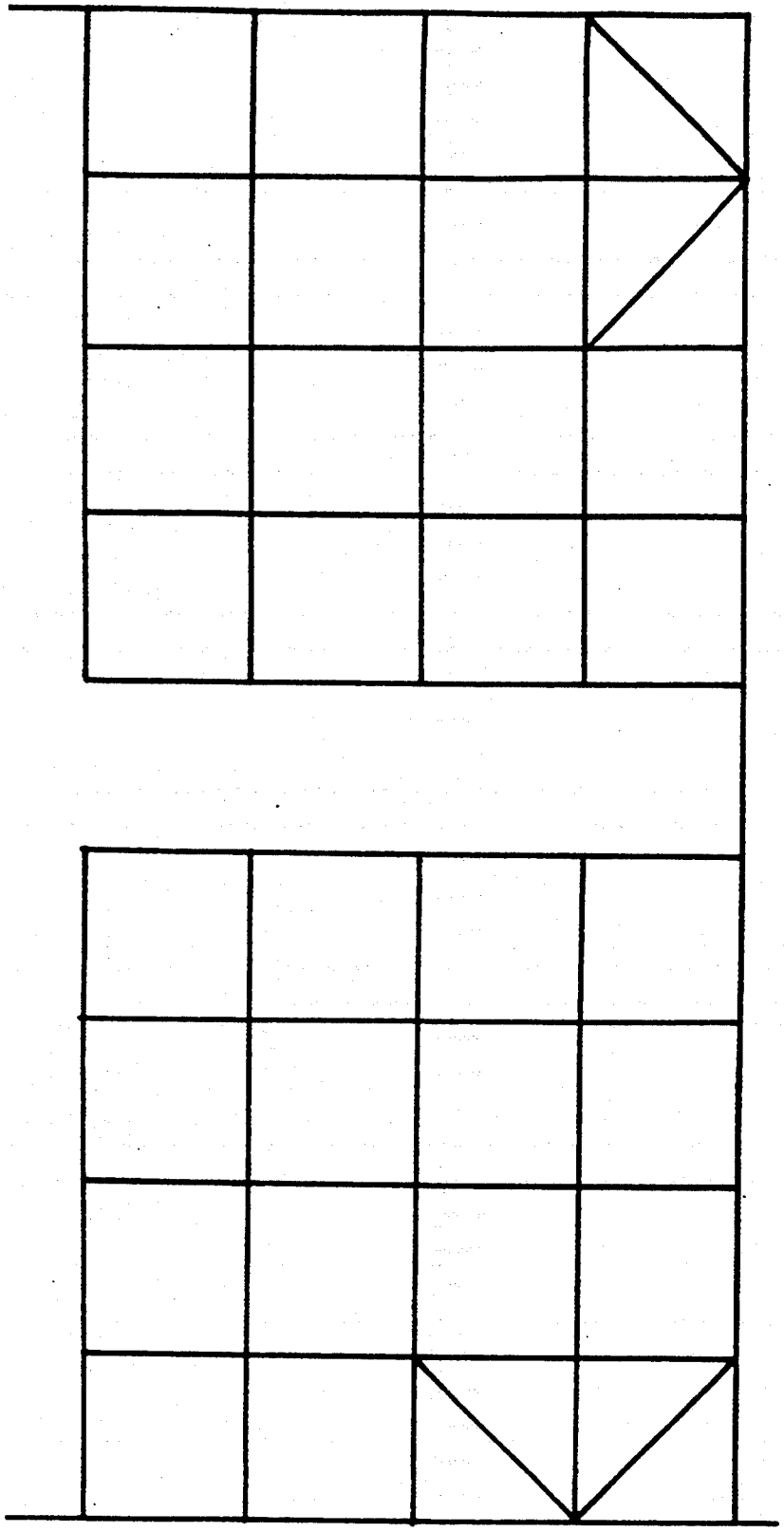
FIG. 28B 5 6 7 8 9 X

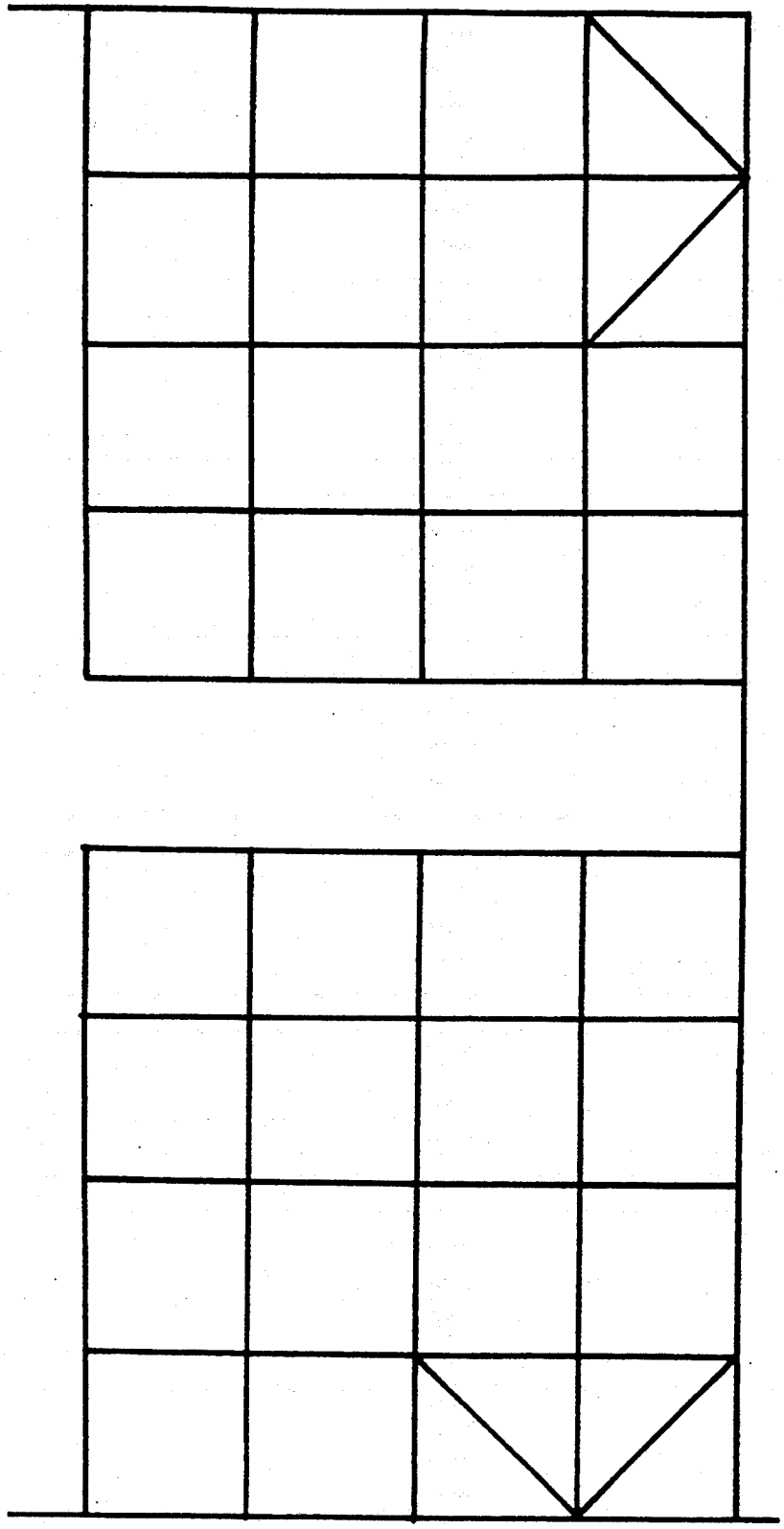
FIG. 29B 5 6 7 8 9 X

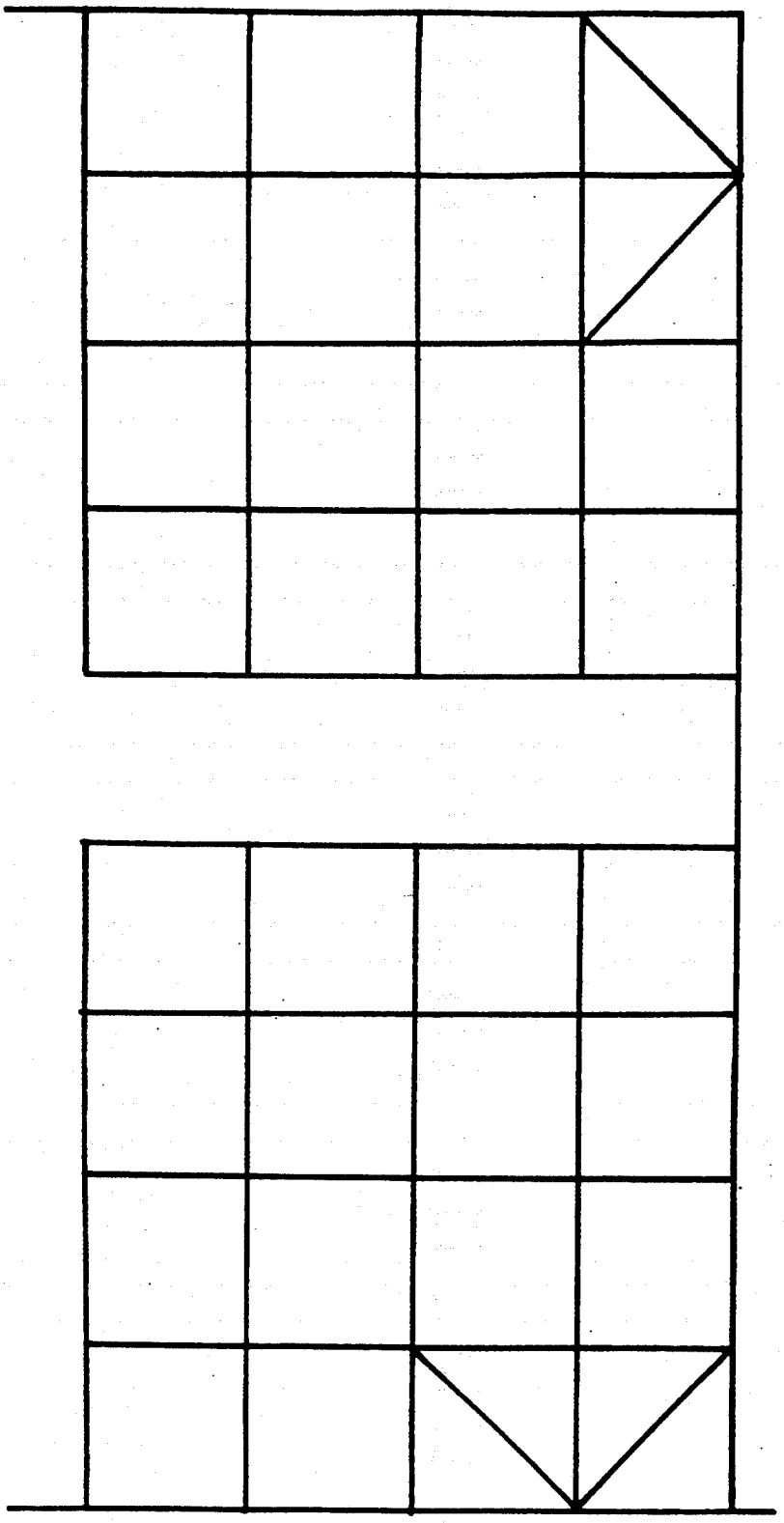
FIG. 30B 5 6 7 8 9 X

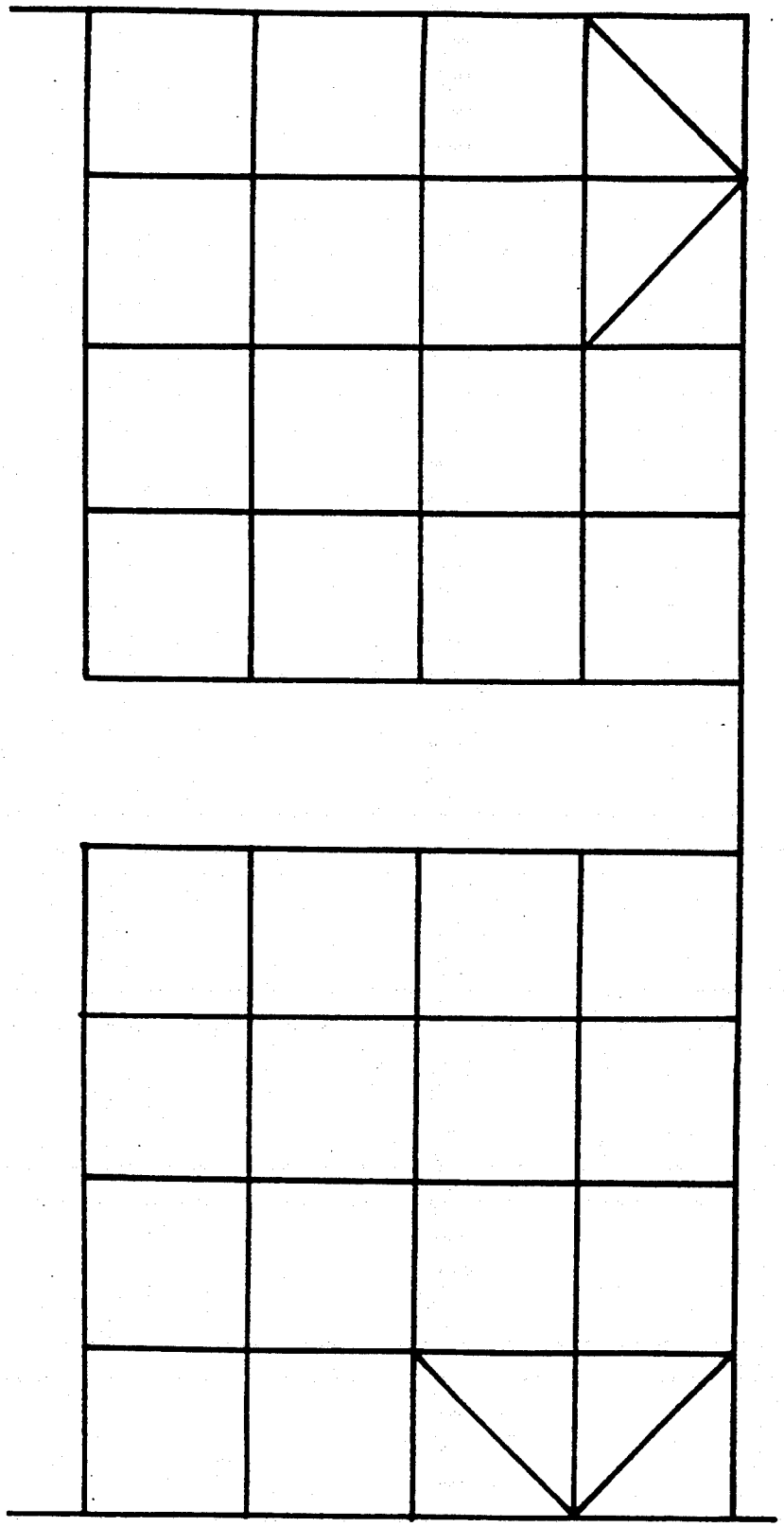
FIG. 31B 5 6 7 8 9 X

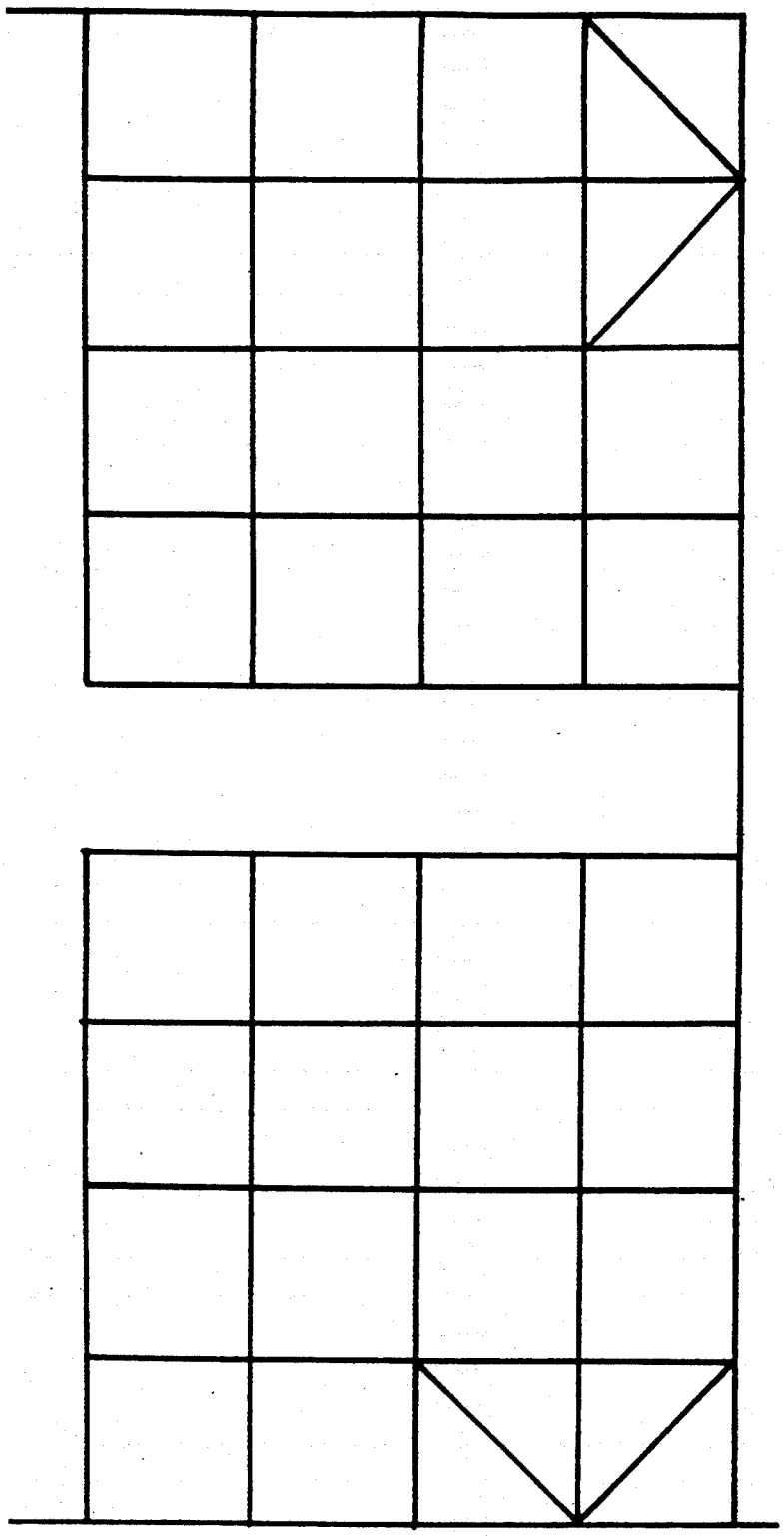
FIG. 32B 5 6 7 8 9 X 5 6 7 8 9 X

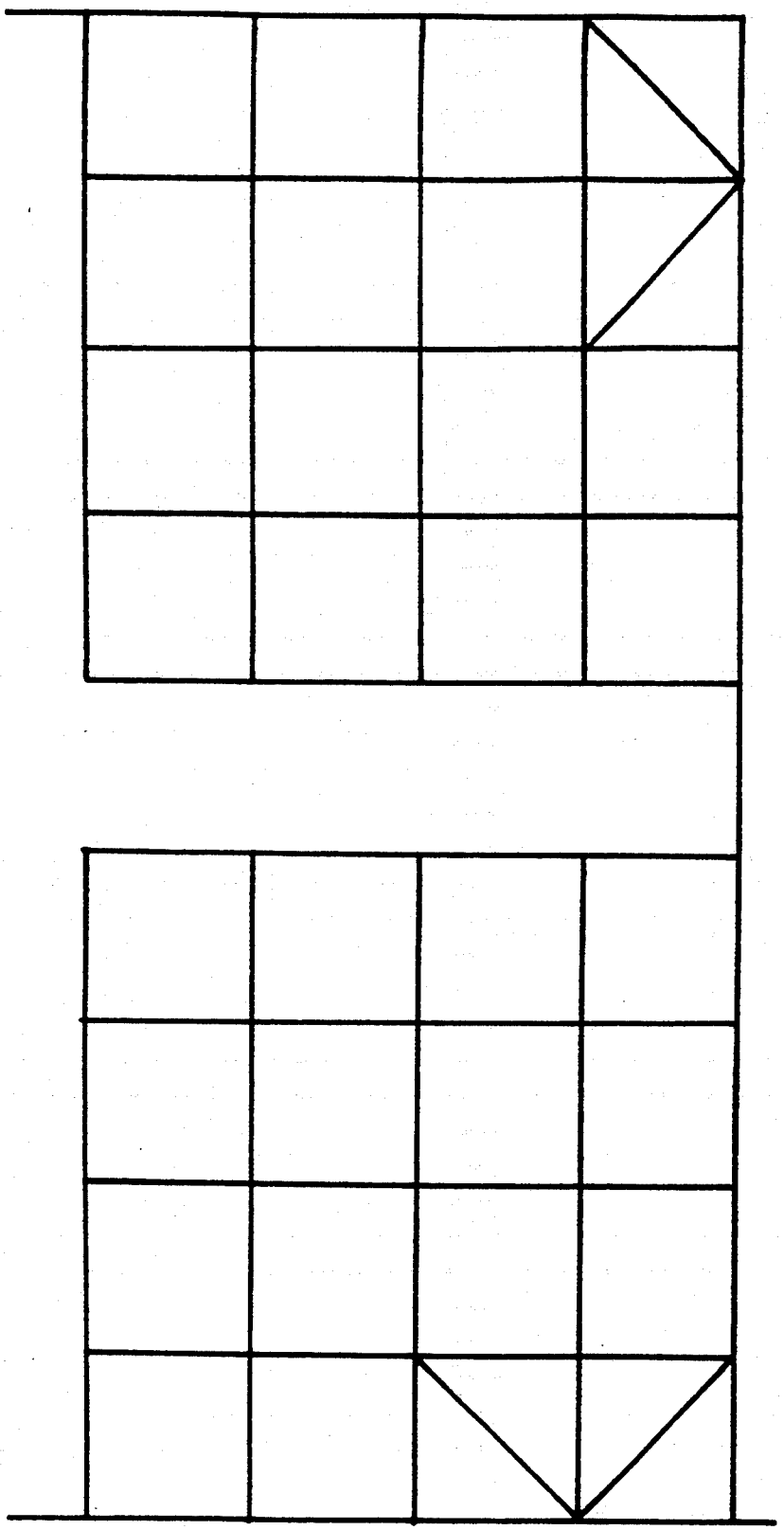
FIG. 34B 5 6 7 8 9 X

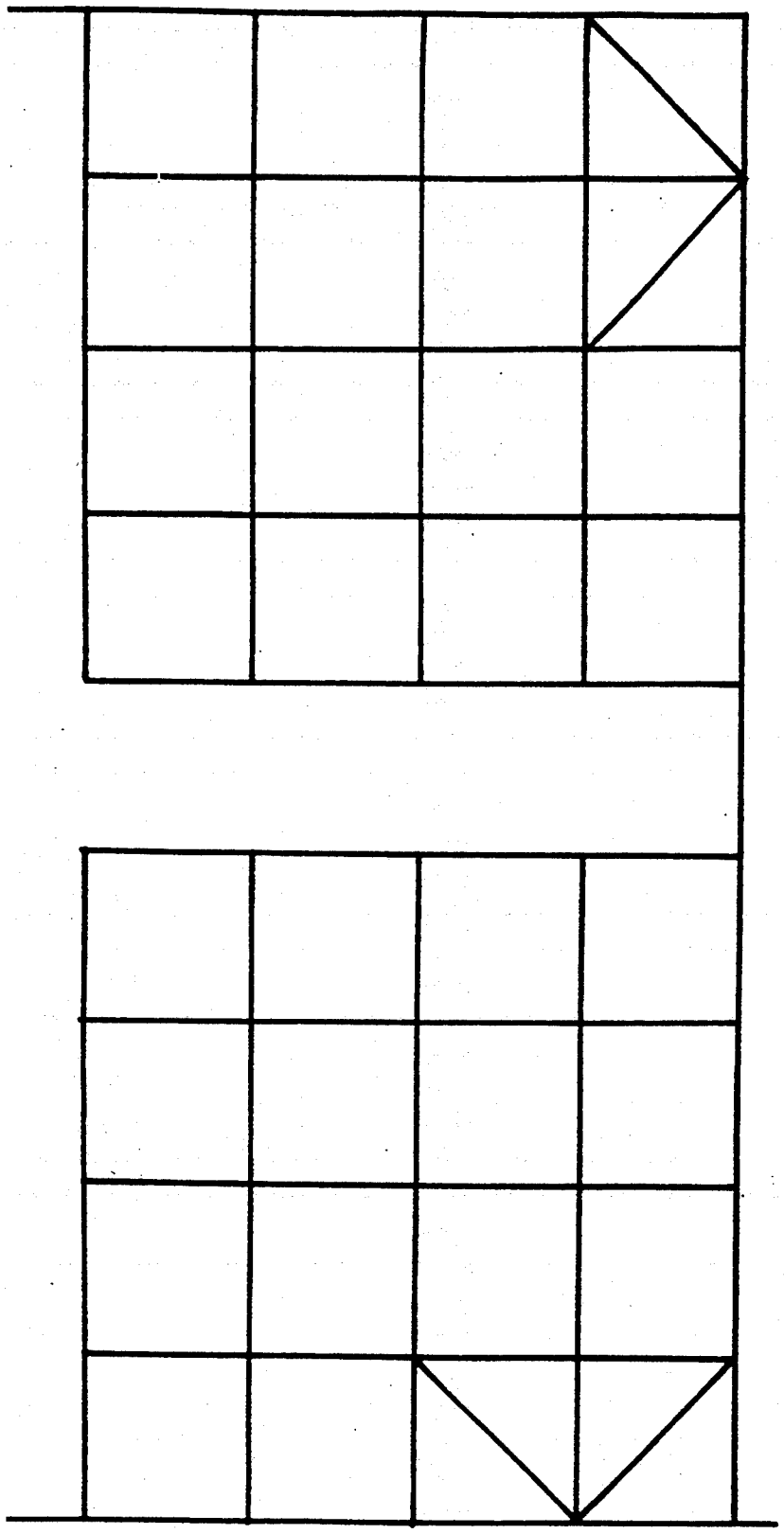
FIG. 35B 5 6 7 8 9 X 5 6 7 8 9 X

METHOD OF PLAYING MULTIPLE PLAYER STRATEGY GAME

BACKGROUND OF THE INVENTION

The invention may be categorized as a chess game. Chess games playable by two, three, or four persons are well known. Examples are the U.S. Pat. Nos: 3,533,627, 3,652,091, 3,778,065, 3,829,099, 3,836,149, 3,840,237, 3,833,130, 3,963,242, 3,998,464, 4,653,759, 4,708,349, 4,832,669, 4,940,241, 5,125,666, 5,158,302, 5,209,488. However, the present invention differs from the other chess games by:

a. the number and arrangement of squares and intersecting rectangles on the game board, b. the number and type of playing pieces for each player, c. the movement of each playing pieces as described hereinafter by the "movement abilities of the playing pieces" and the "rules of the game", d. the names, shapes, positioning, and movement abilities of the playing pieces on the game board.

The novelty of the present invention lies within the concepts of the elements of the strategic game board, the number, types, positioning, and movement abilities of playing pieces, and the rules of the game.

SUMMARY OF THE INVENTION

The invention is a strategic game for two, three, or four players. The players, utilizing nine playing pieces each, engage in a strategic game on an original game board. The objective of the games is for a princess and her patriots to win over all of the other princesses, and vice versa. The game board comprises four square kingdoms separated by two intersecting blank rectangles in the middle. Each kingdom consists of twenty five intersecting points for each player. Each set of playing pieces, including a princess, an angel, an elephant, an eagle, a horse, a tiger, and three monkeys, can be differentiated from the other sets by characteristics such as colors. The starting positions and movements of the playing pieces on the game board proceed according to a set of game rules. The game ends when a princess wins over all of the other princesses. The game board, thirty six playing pieces, and their movement abilities under the game rules form a novel, intellectually challenging, and entertaining strategic game.

The players take turns in maneuvering their playing pieces on the game board in accordance to the game rules, defending and expanding their own kingdoms. While considering their maneuvers, players may choose either to replace or avoid opposing pieces, or to move to empty positions for strategic reasons. The strength of each player diminishes and will lead to a conclusion of the game.

The game finishes when a princess wins and replaces all of the opposing princesses, or a draw is agreed upon by the remaining players.

BRIEF DESCRIPTIONS OF THE DRAWINGS

DESCRIPTION OF THE PREFERRED EMBODIMENTS

The following information describes the preferred embodiments in reference to FIGS. 1 through 36. The objective of the game is for a princess to win over all of the other princesses by removing the other princesses. This game can be played by two, three, or four players and requires the use of equipment.

Equipment Required

Figure 1A:
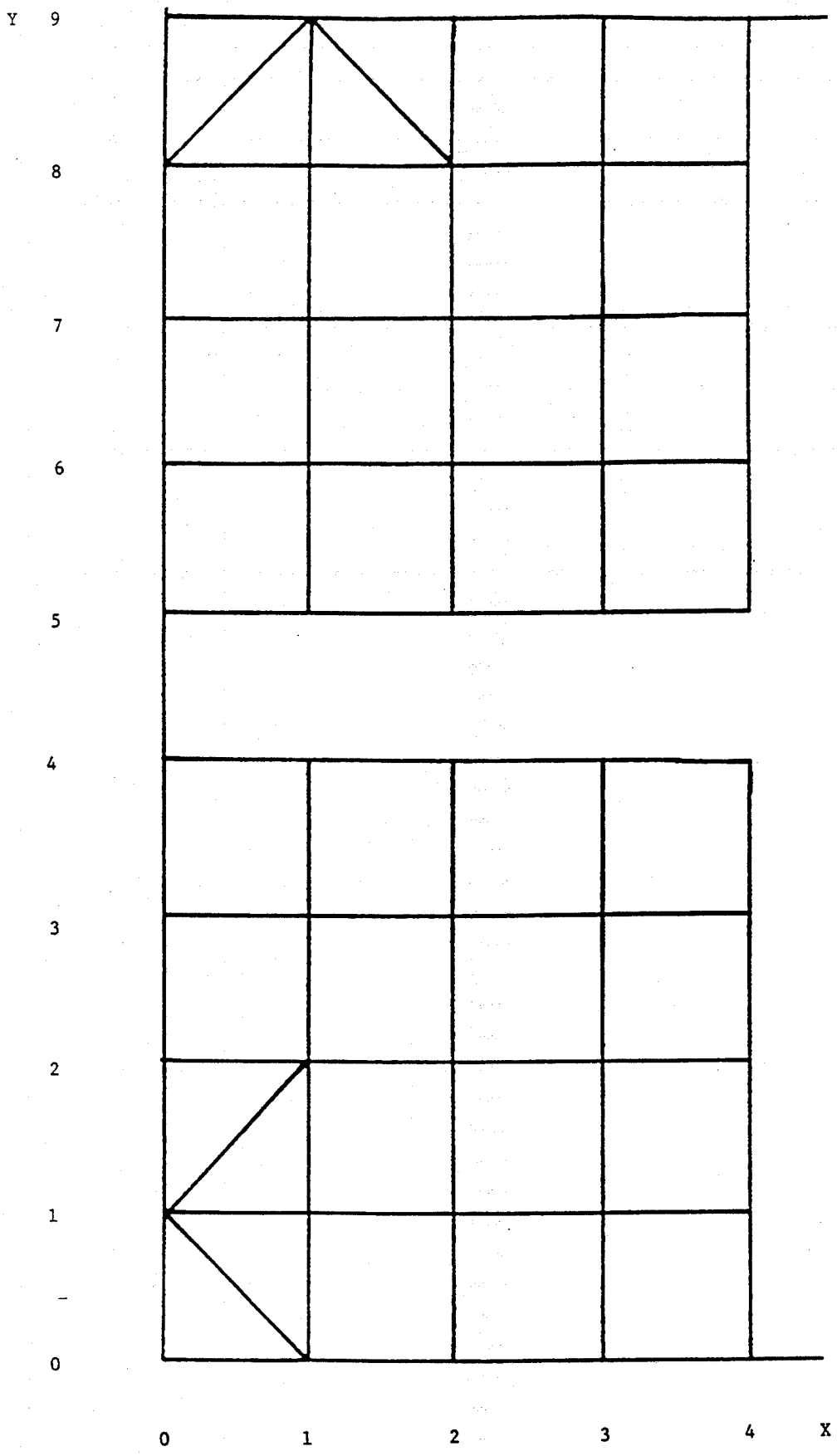
FIG. 1 is a plan view illustration of the game board.
Figure 2:
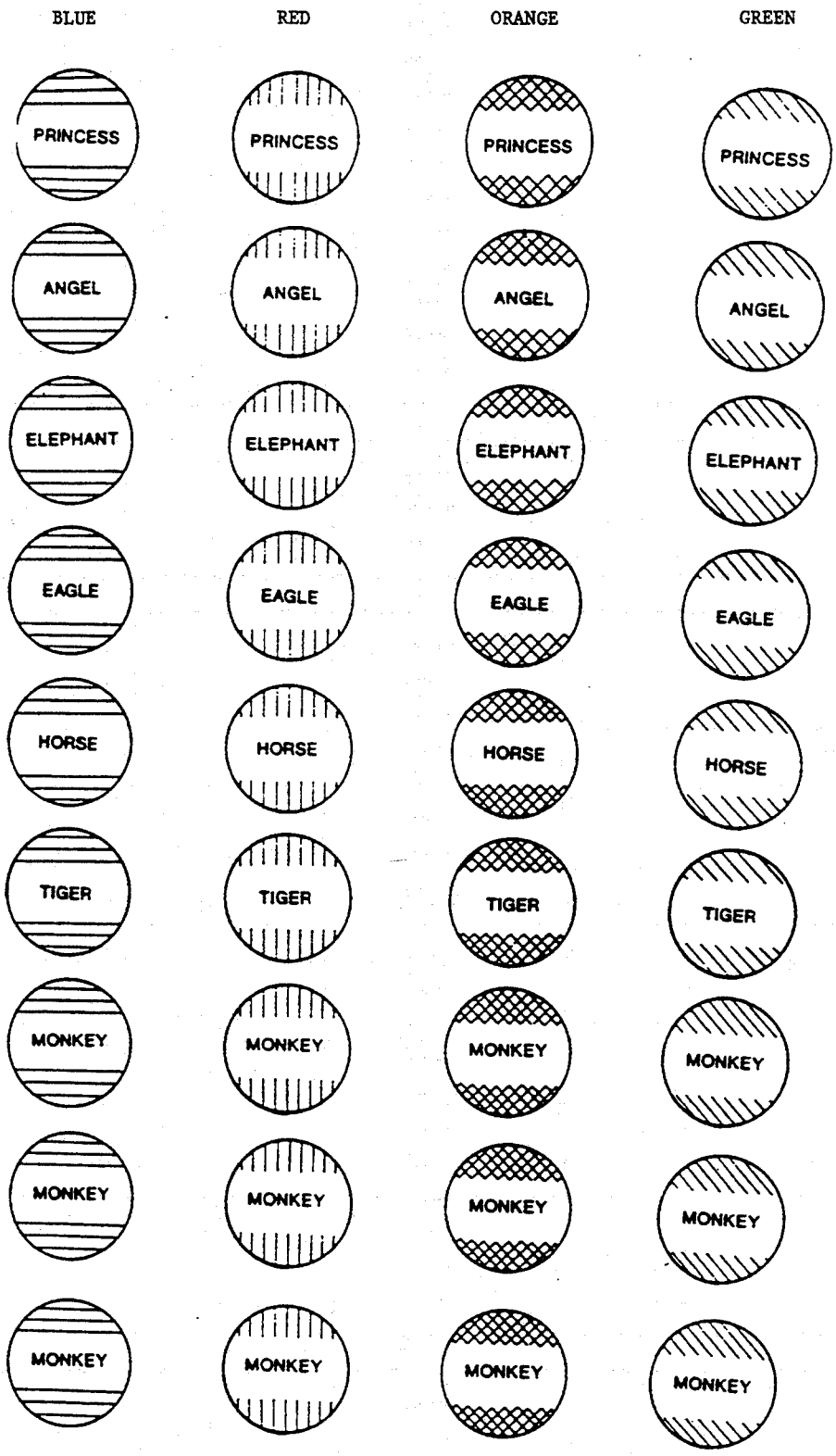
FIG. 2 is a plan view illustration of the playing pieces.

The game of the present invention requires a game board and four sets of playing pieces, as illustrated in FIG. 1 and FIG. 2, respectively.

The game board is a four-sided game area defined by ten perpendicularly intersecting horizontal and vertical lines forming 100 intersecting points. Said 100 points are divided into four squares that represent four kingdoms and are separated by two blank rectangles that form a cross in the middle. The four kingdoms are located in the bottom left, upper left, upper right, and bottom right corners of the game board. Each kingdom has 25 intersection points, of which six points arranged two by three represent the palace of a princess. The palace of the bottom left kingdom is located vertically in the kingdom's bottom left corner; the palace of the upper left kingdom is located horizontally in the kingdom's upper left corner; the palace of the upper right kingdom is located vertically in the kingdom's upper right corner; and the palace of the bottom right kingdom is located horizontally in said kingdom's bottom right corner. Each said palace has two diagonal lines that meet at the midpoint of the outer line of said palace.

The four sets of playing pieces are comprised of the following pieces per set:

One princess;
One angel;
One elephant;
One eagle;
One horse;
One tiger;
Three Monkeys;

The game board can be made with drawings printed on a sheet of media such as paper, plastic, glass, wood or metal with an appearance similar to the illustration shown in FIG. 1.

Each of said playing pieces can be made of moldable materials such as paper, plastic, glass, wood or metal in a solid cylinder or in a form with a representation of a word, shape or symbol of an animal, human being, or thing such as a car. An example of said playing pieces made in solid cylinders with the words of animals, human beings and things printed on the surfaces of the cylinders in four colors is shown in FIG. 2.

The game board and playing pieces can also be developed into computer programs. Multimedia computers, standard computer software materials, visual and audio display terminals, communication and other computer peripheral equipment needed to run the game program will be utilized.

Movement Abilities of the Playing Pieces

Figure 3A:
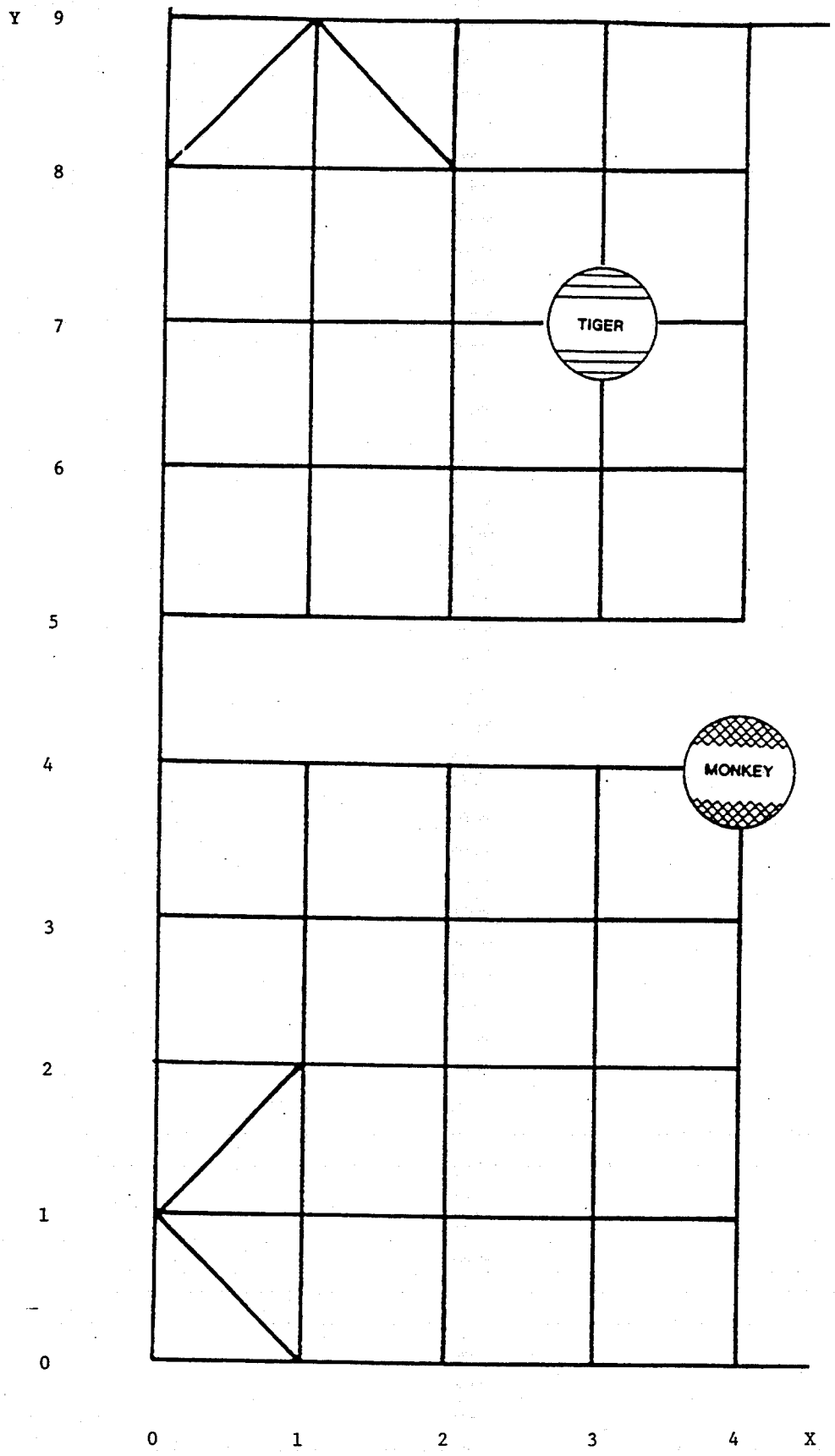
FIG. 3 is a plan view illustration of a coordinate system for explaining positioning and moving of the playing pieces.
Figure 3B:
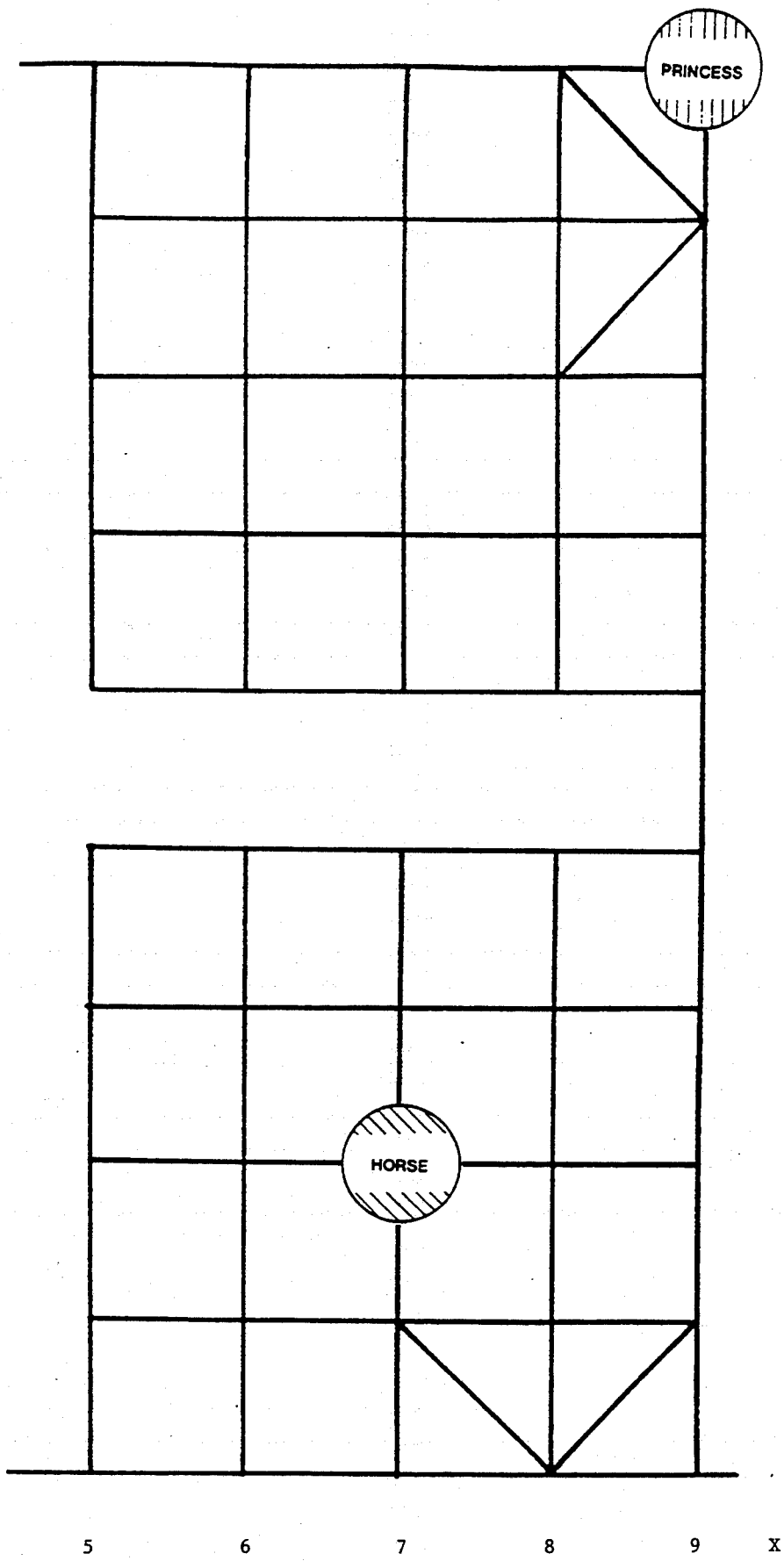

A coordinate system illustrated in FIG. 3 will be used to explain the movement abilities of the playing pieces.

In FIG. 3, the horizontal axis is identified as the X axis and the vertical as the Y axis. An intersection point on the board is identified as an (X, Y) pair. For example, the orange monkey is at the point (X, Y)=(4, 4); the blue tiger at the point (X, Y)=(3, 7); the red princess at (X, Y)=(9, 9); and the green horse at (X, Y)=(7, 2).

For simplicity, a point is identified by a XY number. For example, the orange monkey is at 44 because (X, Y)=(4, 4); the blue tiger is at 37 because (X, Y)=(3, 7), and so on. This coordinate system and the two-digit XY point identification method will be used throughout the rest of this description.

Figure 4A:
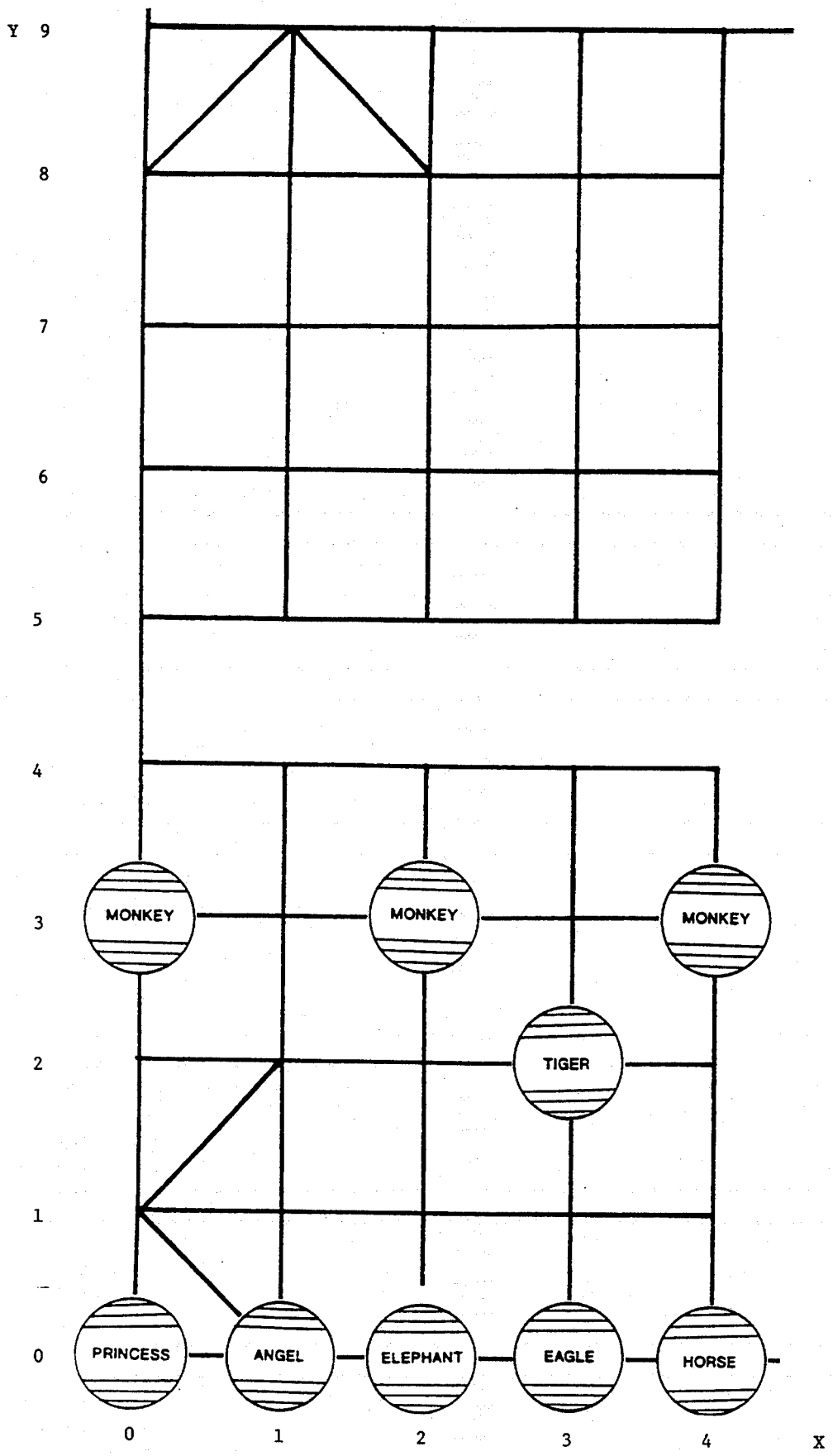
FIG. 4 is a plan view illustration of the game board and the starting positions of the playing pieces for two players.
Figure 5A:
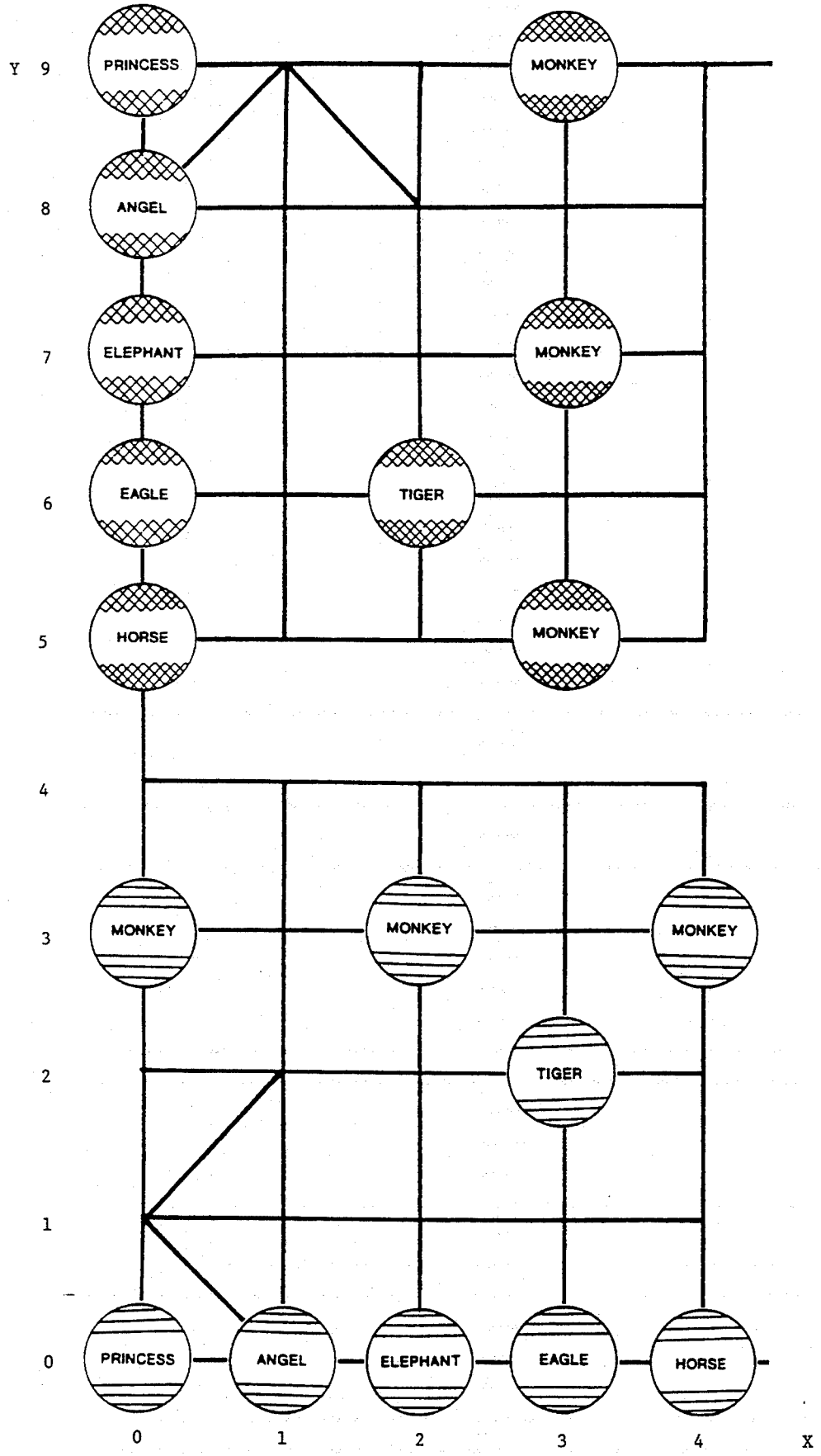
FIG. 5 is a plan view illustration of the game board and the starting positions of the playing pieces for three players.
Figure 6A:
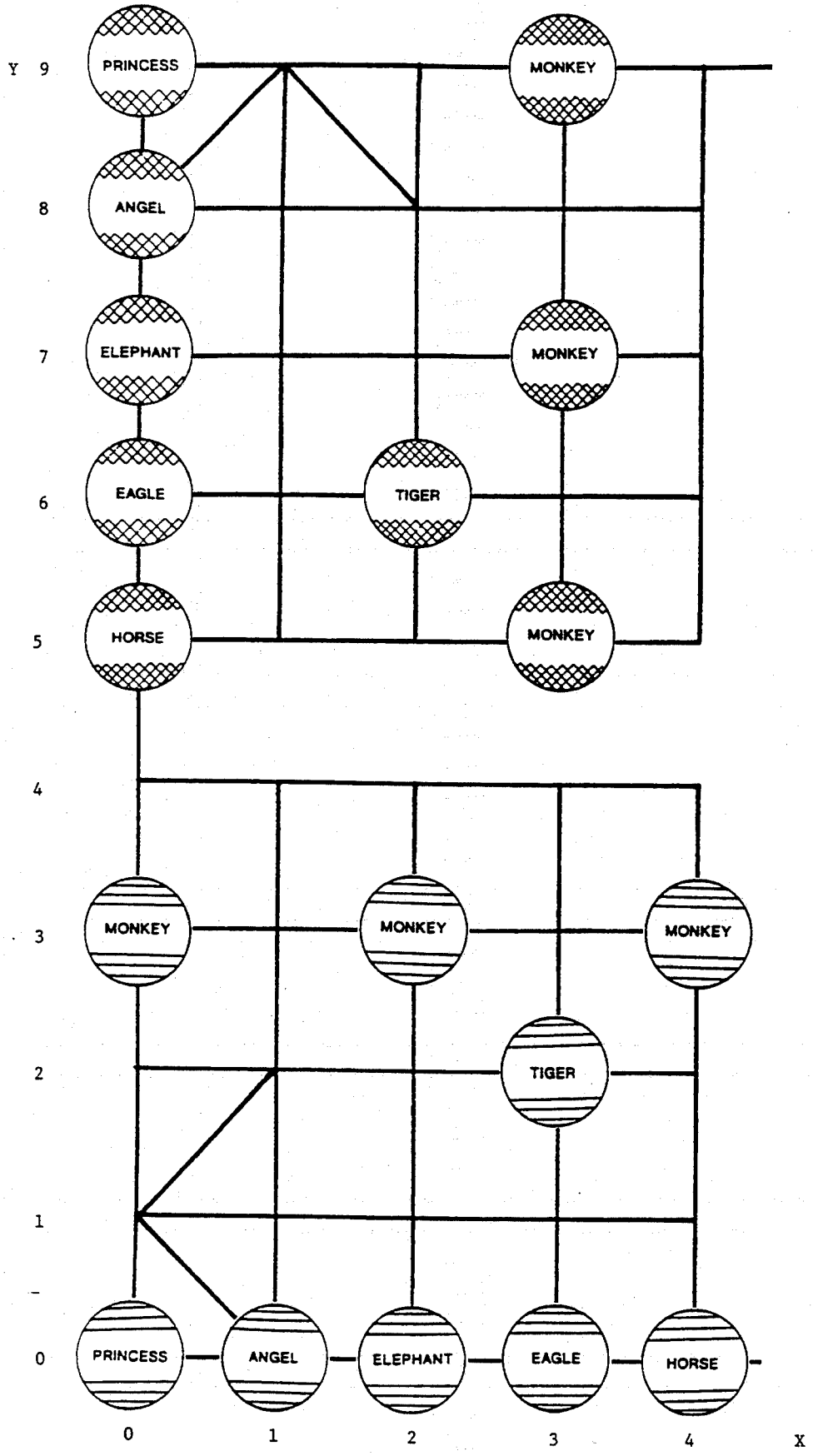
FIG. 6 is a plan view illustration of the game board and the starting positions of the playing pieces for four players.
Figure 7A:
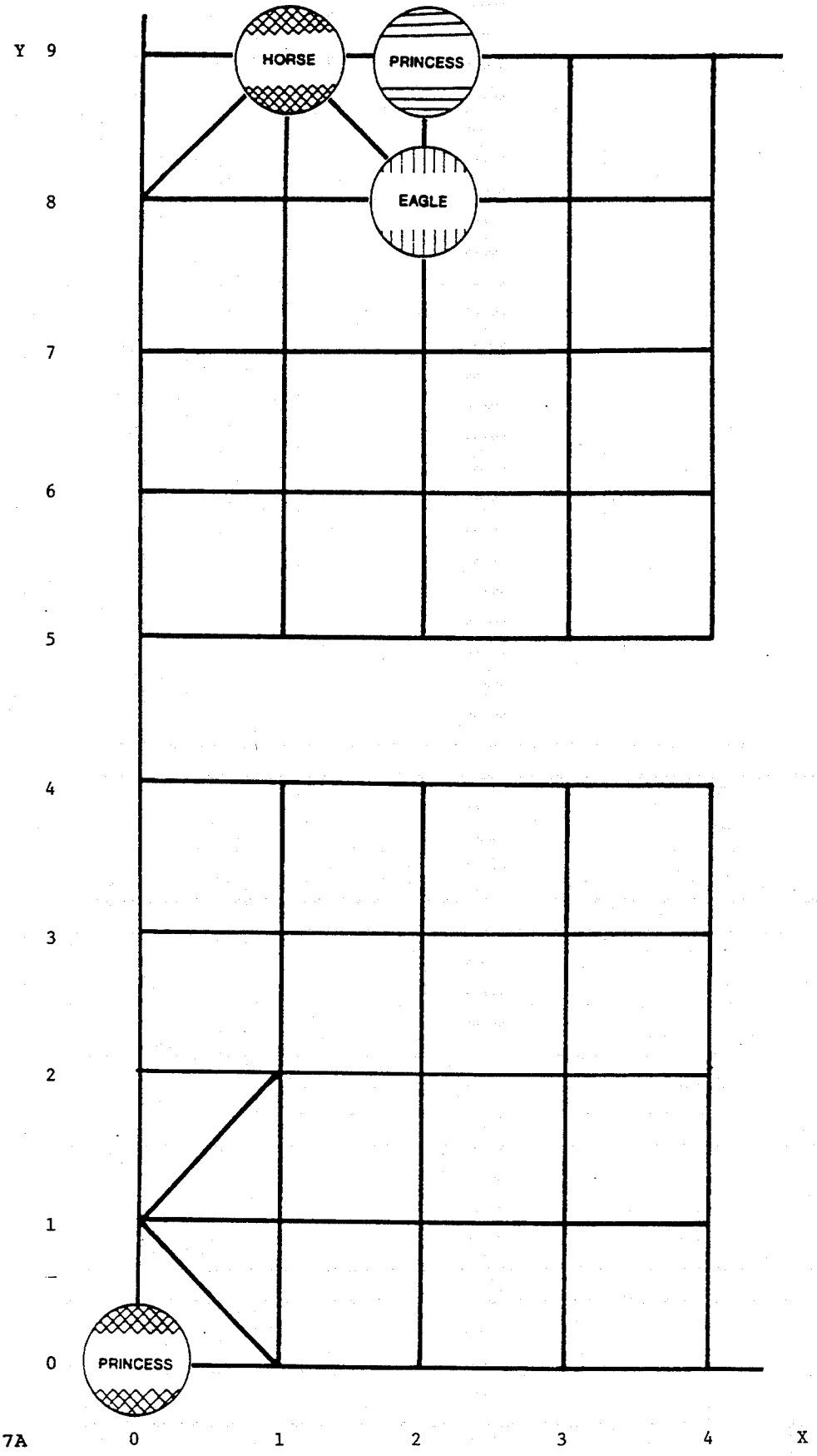
FIG. 7 is a plan view illustration of the game board and the movement abilities of a princess.
Figure 8A:
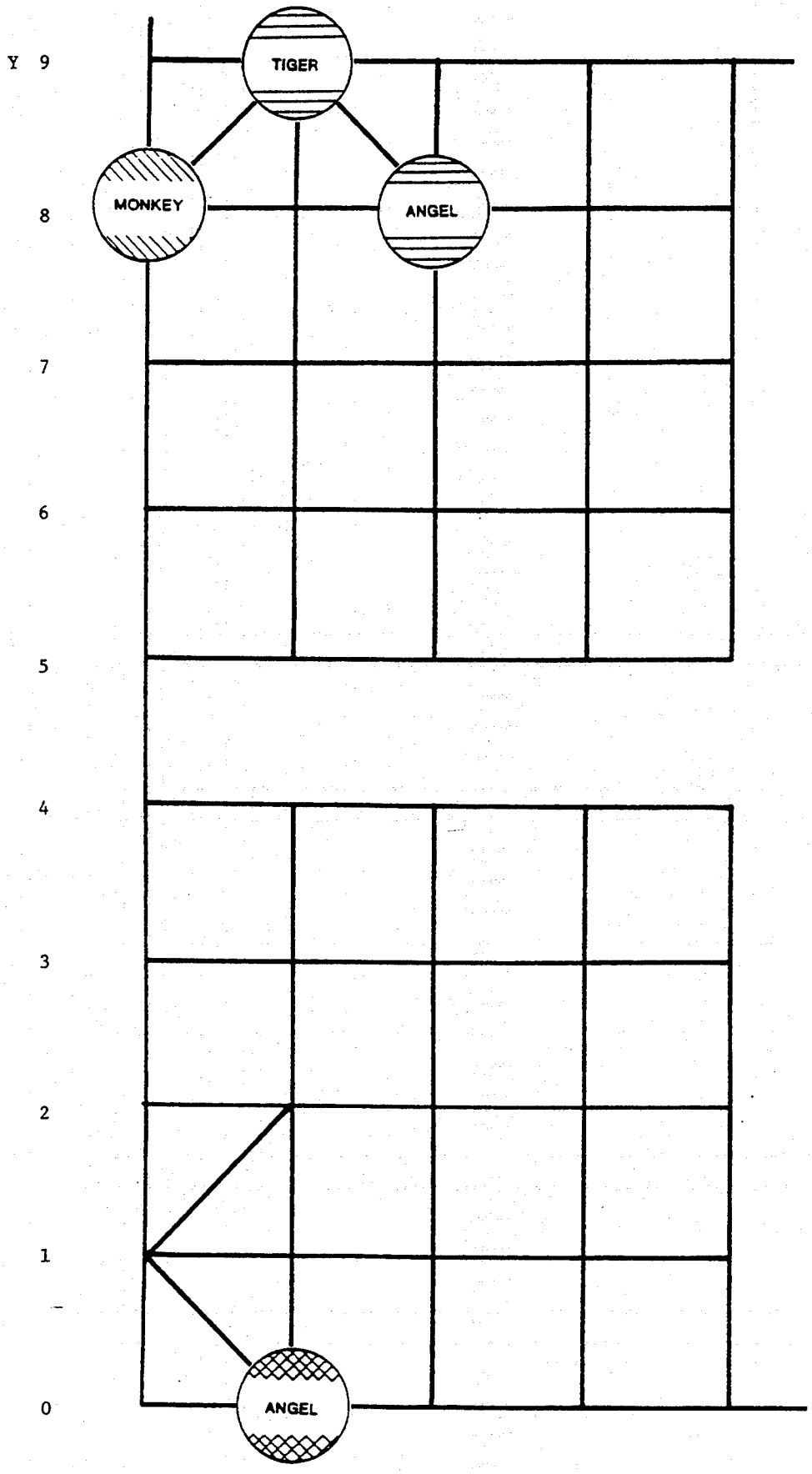
FIG. 8 is a plan view illustration of the game board and the movement abilities of an angel.
Figure 9A:
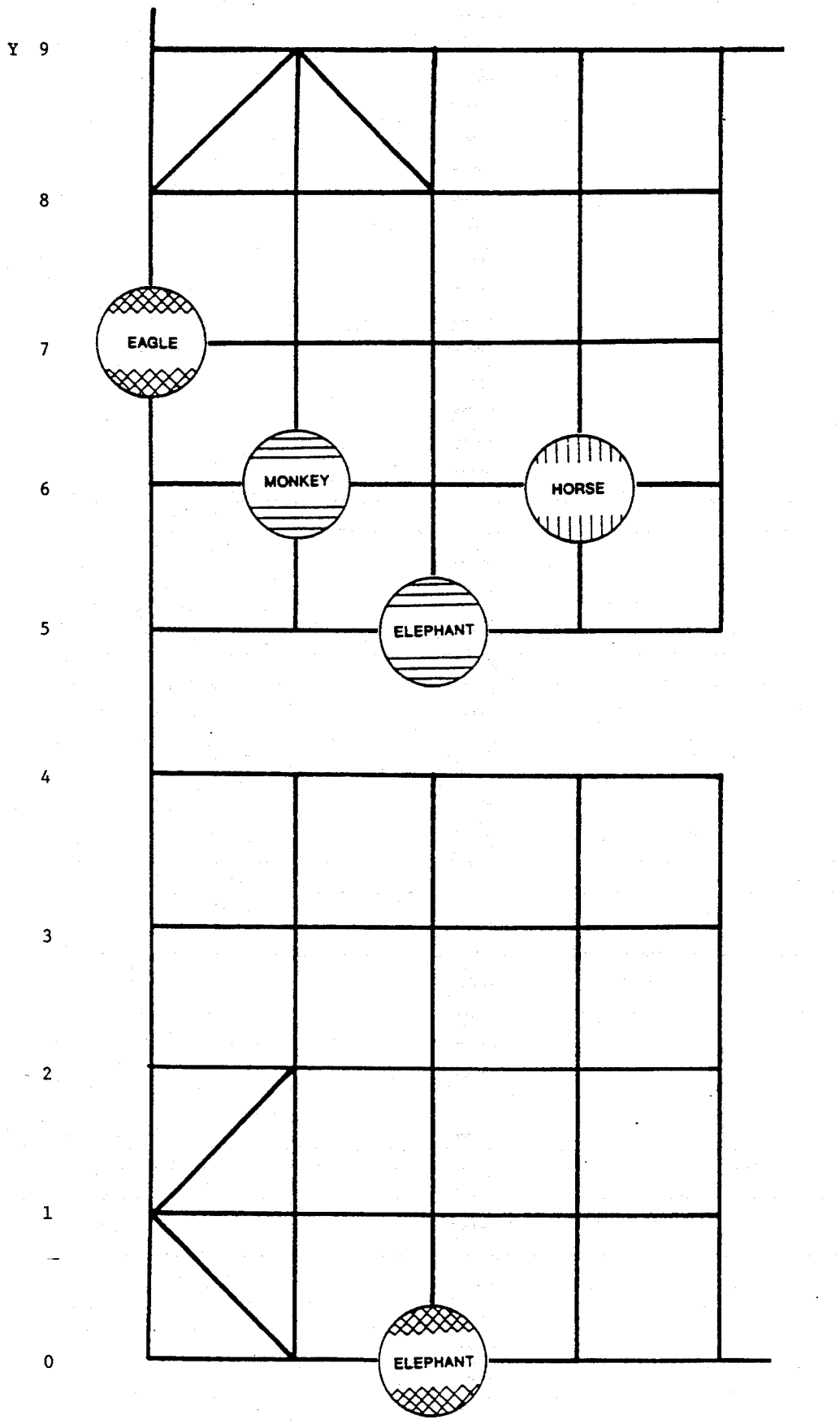
FIG. 9 is a plan view illustration of the game board and the movement abilities of an elephant.
Figure 10A:
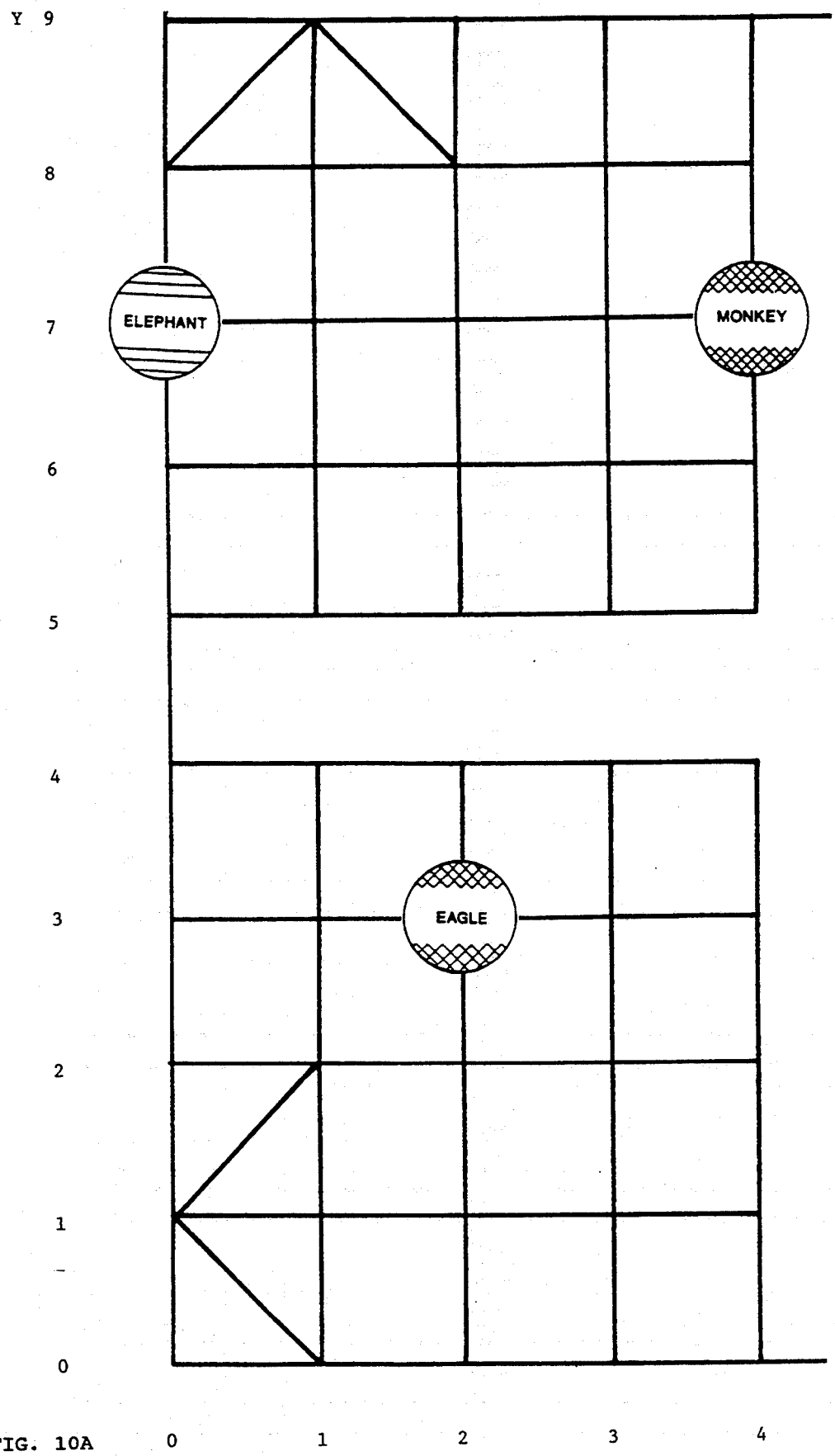
FIG. 10 is a plan view illustration of the game board and the movement abilities of an eagle.
Figure 11A:
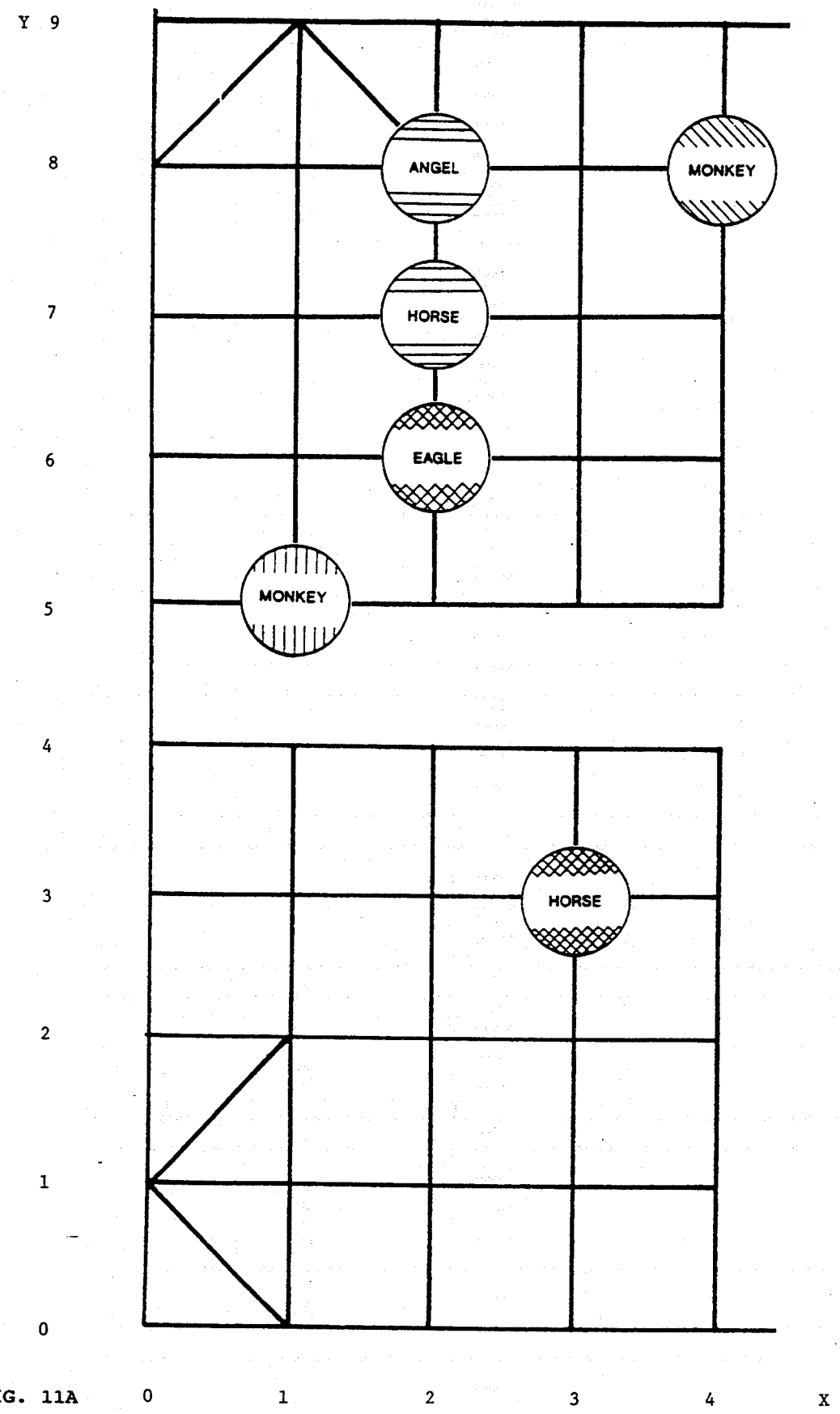
FIG. 11 is a plan view illustration of the game board and the movement abilities of a horse.
Figure 12A:
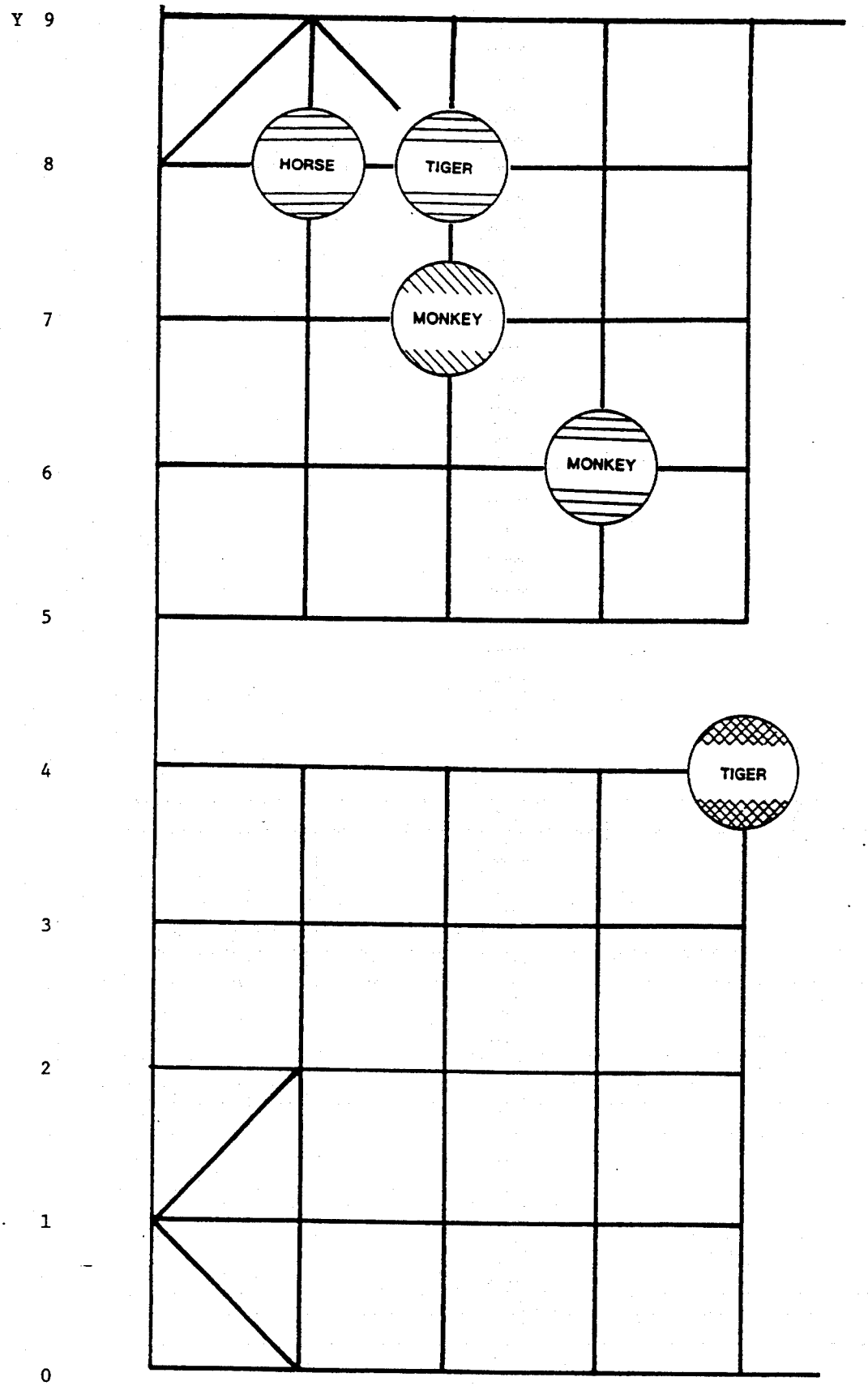
FIG. 12 is a plan view illustration of the game board and the movement abilities of a tiger.
Figure 13A:
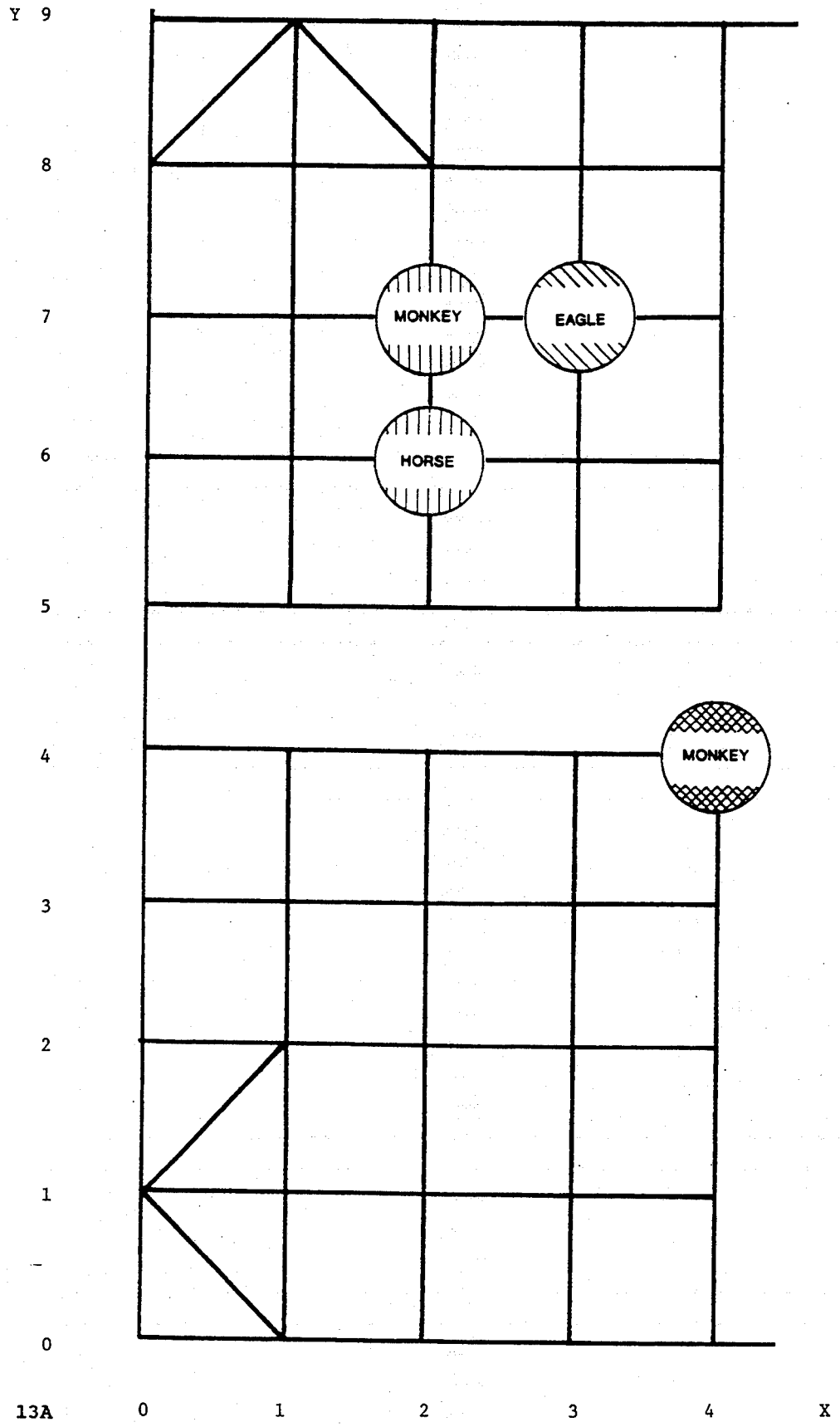
FIG. 13 is a plan view illustration of the game board and the movement abilities of a monkey.

Each game player selects a kingdom and a set of playing pieces to begin playing. The starting positions of the playing pieces are illustrated in FIG. 4, FIG. 5, and FIG. 6 for two, three, and four players, respectively.

Referring to FIG. 1, the movement abilities of the playing pieces are explained on the game board. The game board comprises four kingdoms with one palace per kingdom. The following chart uses six points to define each palace:

| Kingdom | Palace |
|---|---|
| Bottom Left | 00, 01, 02, 12, 11, 10 |
| Upper Left | 09, 19, 29, 28, 18, 08 |
| Upper Right | 99, 98, 97, 87, 88, 89 |
| Bottom Right | 90, 80, 70, 71, 81, 91 |

The movement abilities of the playing pieces are explained as follows:

Princess's Movement Abilities (Referring to FIG. 7):

1. The movements of a princess are limited to the six points within the palace of her kingdom, subject to her movement abilities 2, 3, and 4 below. For example: The orange princess can move to 00, 01, 02, 12, 11, and 10 within her palace; the red princess is limited to 90, 80, 70, 71, 81, and 91; the green princess may move to 99, 98, 97, 87, 88, and 89; the blue princess is limited to 09, 19, 29, 28, 18, and 08.
2. A princess moves one point horizontally, or vertically, to an unoccupied point within her palace.
3. A princess cannot move to a point that is occupied by her teammate.
4. A princess can move to a point occupied by an opponent within her palace to replace that piece.

Example:

1. The orange princess at 00 can move to either 10 or 01 only.
2. The red princess at 90 can move to 80 only; it cannot move to 91 which is occupied by the red angel, a teammate.
3. The green princess at 99 can move to 89 to replace the blue horse; it cannot move to 98 which is occupied by the green horse, a teammate.
4. The blue princess at 29 can either move to 19 to replace the orange horse, or to 28 to replace the red eagle.

Angel's Movement Abilities (Referring to FIG. 8):

1. The movements of an angel are limited to moving diagonally to only 3 points within her princess's palace, subject to its movement abilities 2, 3, 4 below. For example, the orange angel can move to 10, 01, and 12 only; the red angel is limited to 91, 80, and 71; the green angel can move to 89, 98, and 87; and the blue angel can move to 08, 19, and 28 only.
2. An angel moves one point diagonally to an unoccupied point within her palace.
3. An angel cannot move to a point that is occupied by its teammate.
4. An angel can move to a point, within her palace, occupied by an opponent to replace that piece.

Example:

1. The orange angel at 10 can move to 01 only.
2. The red angel at 91 cannot move to 80 because 80 is occupied by the red horse, a teammate.
3. The green angel at 89 can move to 98 and replace the orange tiger.
4. The blue angel at 28 cannot move to 19 which is occupied by the blue tiger, a teammate.

Elephant's Movement Abilities (Referring to FIG. 9):

1. An elephant can move to only 4 points within its princess's kingdom, subject to its movement abilities 2, 3, and 4 below. For example: The orange elephant can move to 20, 02, 24, and 42 only; The movements of the red elephant are limited to 92, 70, 52, and 74; The green elephant can move to 79, 97, 75, and 57; and the blue elephant can move to 25, 07, 29, and 47 only.
2. An elephant can move on a two-point diagonal path to an unoccupied point. If the "first" point on a path is occupied by a teammate or an opponent, the elephant cannot move on that path.
3. An elephant cannot move to a point that is occupied by its teammate.
4. An elephant can move to a point occupied by an opponent to replace that piece.

Example:

1. The orange elephant at 20 can move to either 02 or 42 only.
2. The red elephant at 92 can move to 74 only; it cannot move to 70 which is occupied by the red princess.
3. The green elephant at 79 cannot move to 97 because the "first" point, 88, on the diagonal path is blocked by the orange monkey. It may move to 57 to replace the red tiger.
4. The blue elephant at 25 cannot move to 07 because the "first" point, 16, in the path is occupied by the blue monkey; it cannot move to 47 because the "first" point, 36, on the diagonal path is occupied by the red horse.

Eagle's Movement Ability (Referring to FIG. 10):

1. An eagle "flies" in any horizontal, or vertical, path to an empty point in any kingdom, without flying over said other playing pieces.
2. An eagle "flies" in any horizontal, or vertical, path over the "first" playing piece, whether a teammate or an opponent, on the path to the next, or the "second", playing piece which must be an opponent to replace that piece.

Example:

1. The orange eagle at 23 can fly to any point on the path from 24 to 29, 33 to 93, 22 to 20, or 13 to 03.
2. The red eagle at 94 can fly to any point on the path from 95 to 96, or 93 to 93.
3. The green eagle at 88 can fly to 89, 98, or 87.
4. The green eagle at 88 can fly over the "first" playing piece, the orange monkey at 86, to replace the next playing piece, the red horse at 84, which is an opponent.
5. The blue eagle at 97 can fly to a point on a path from 98 to 99, or 96 to 95, or 87 to 57.
6. The blue eagle at 97 can fly over the red eagle at 94 to replace the red elephant at 92.
7. The blue eagle at 97 cannot fly over the orange monkey at 47 to the blue elephant at 07 because the eagle and elephant are teammates.

Horse's Movement Abilities (Referring to FIG. 11):

1. A horse moves on a three-point path to an unoccupied point in any kingdom. This path comprises either two vertical points and one horizontal point, or two horizontal points and one vertical point. If the "first" point in the two-point segment of the path is occupied by any playing piece, the horse cannot move on that path. If the first point is empty and the second point is occupied by any playing piece in the two-point segment of the path, the horse can move on that path.
2. A horse cannot move to a point that is occupied by its teammate.
3. A horse can move to a point occupied by an opponent to replace that piece.

Example:

1. The orange horse at 33 can move to 45, 54, 52, 41, 21, 12, 14, or 25.
2. The red horse at 82 can move to 94, 70, 63, or 74 only; it cannot move to 90 or 61 because those points are occupied by the red princess and red tiger, its teammates, respectively.
3. The green horse at 57 can move to 69, 65, 45, 36, 38, or 49.
4. The green horse at 57 cannot move to 78 because the "first" point, 67, in the two-point segment of the path is occupied by the red eagle.
5. The green horse at 57 cannot move to 76 to replace the red monkey because the "first" point, 67, in the two-point segment of the path is occupied by the red eagle.
6. The blue horse at 27 can move to either 46, 06, or 08.
7. The blue horse at 27 can move to 48 to replace the green monkey.
8. The blue horse at 27 cannot move to 15 to replace the red monkey because the "first" point, 26, on the two-point segment of the path is occupied by the orange eagle.
9. The blue horse at 27 cannot move to 35 because the "first" point, 26, on the two-point segment of the path is occupied by the orange eagle.
10. The blue horse at 27 cannot move to the points 19 or 39 because the "first" point, 28, on the two-point segment of the path is occupied by the blue angel.

Tiger's Movement Abilities (Referring to FIG. 12):

1. A tiger moves on an unoccupied horizontal, or vertical, path to an unoccupied point in any kingdom.
2. A tiger cannot move to a point that is occupied by its teammate.
3. A tiger can move to a point occupied by an opponent to replace that piece.

Example:

1. The orange tiger at 44 can move to a point on a path either from 45 to 49, 54 to 94, 43 to 40, or 34 to 04.
2. The red tiger at 72 can move to a point anywhere on a path from 73 to 79, 82 to 92, or 71 to 70.
3. The red tiger at 72 cannot move to 62 because the point is occupied by its teammate, the red monkey.
4. The green tiger at 66 can move on a path from 67 to 68, 76 to 96, 65 to 63, or 56 to 46.
5. The green tiger at 66 can move to 69 to replace the orange horse; or to 36 to replace the blue monkey; or to 62 to replace the red monkey.
6. The blue tiger at 28 can move to 29 or to any point on the path from 38 to 98.
7. The blue tiger at 28 cannot move to 18 because the point is occupied by its teammate, the blue horse.
8. The blue tiger at 28 can move to 27 to replace the green monkey.

Monkey's Movement Abilities (Referring to FIG. 13):

1. A monkey moves one point horizontally, or vertically, to an unoccupied point in any kingdom.
2. A monkey cannot move to a point occupied by its teammate.
3. A monkey can move to a point occupied by an opponent to replace that piece.

Example:

1. The orange monkey at 44 can move to 45, 54, 43, or 34.
2. The green monkey at 73 can move to 74, 83, or 63.
3. The green monkey at 73 can move to 72 to replace the orange horse.
4. The blue monkey at 57 can move to either 67 or 47.
5. The blue monkey at 57 can neither move to 56 nor 58 because the points are occupied by its teammates, the blue tiger and blue eagle, respectively.
6. The red monkey at 27 can move to 28 or 17.
7. The red monkey at 27 cannot move to 26 which is occupied by the red horse.
8. The red monkey at 27 can move to 37 to replace the green eagle.

Figure 14A:
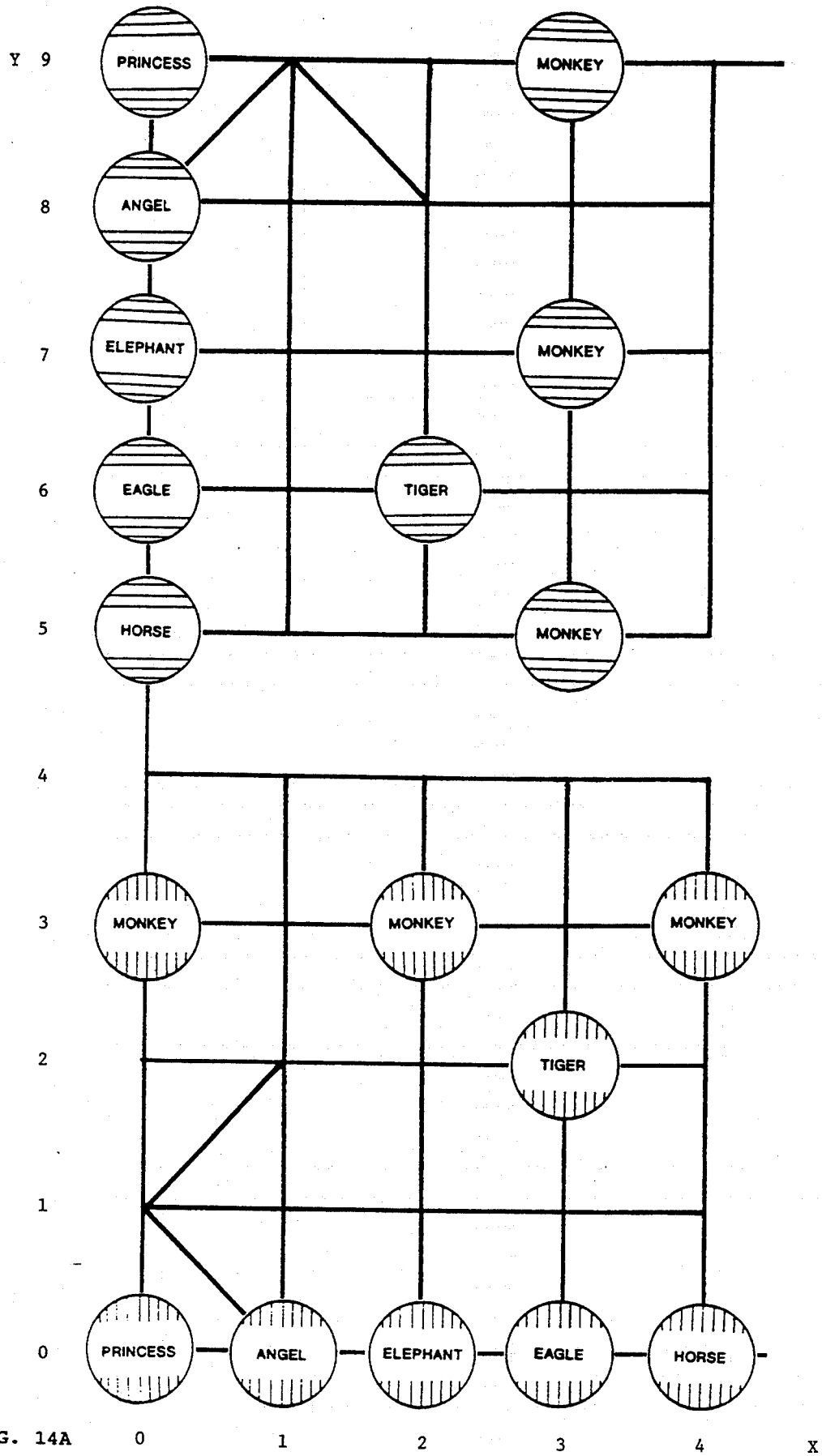
FIGS. 14 through 36 are plan view illustrations of the game board and selected winning strategies of playing pieces and their positioning.

The use of said movement abilities of said playing pieces in playing a complete two-player game is illustrated, referring to FIGS. 14 to 36, as follows:

FIG. 14 illustrates the starting positions of playing pieces for two players in playing the game.

Figure 15A:
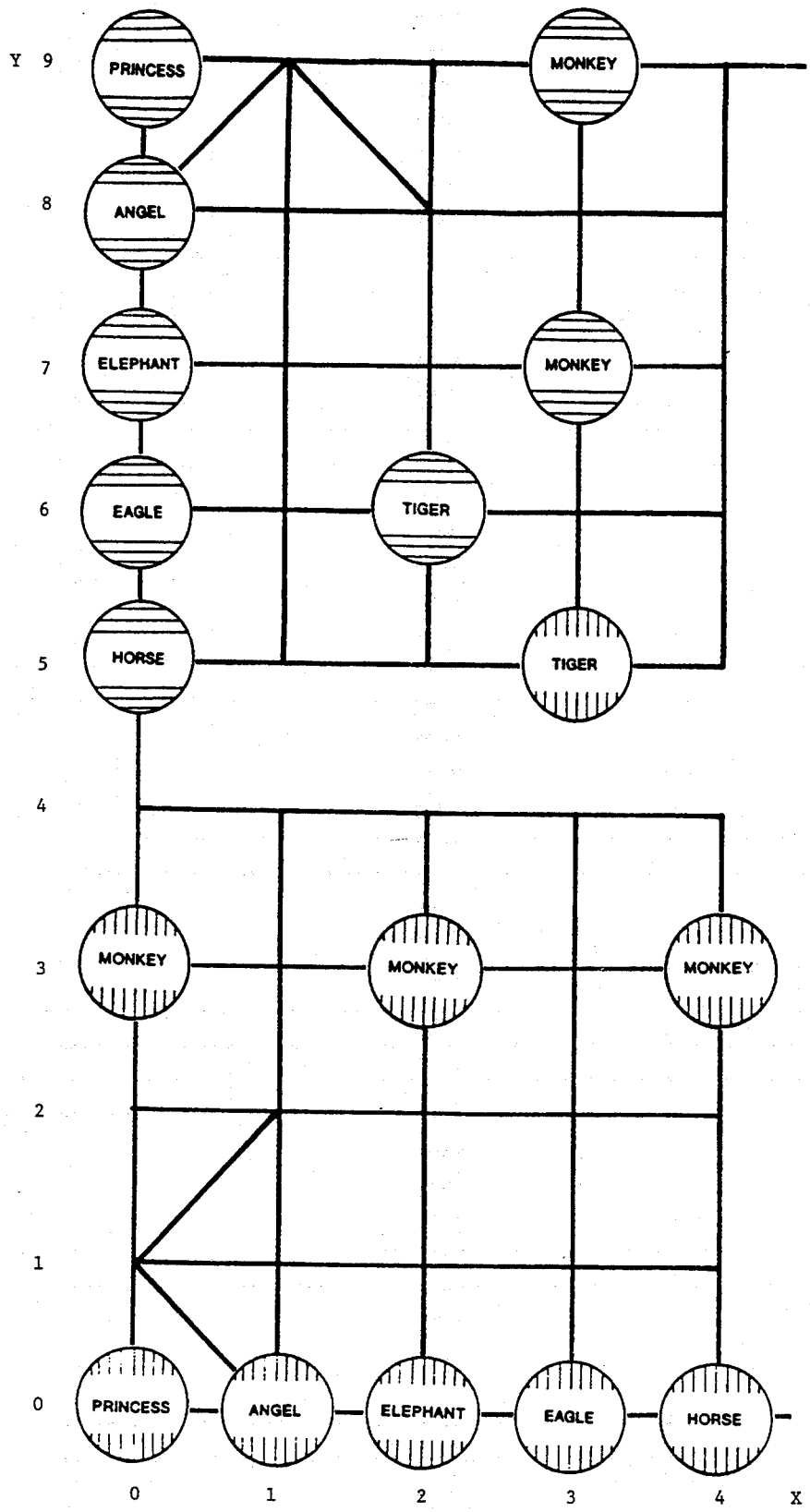

FIG. 15 shows moving the red tiger from 32 to 35 to replace the blue monkey at 35.

Figure 16A:
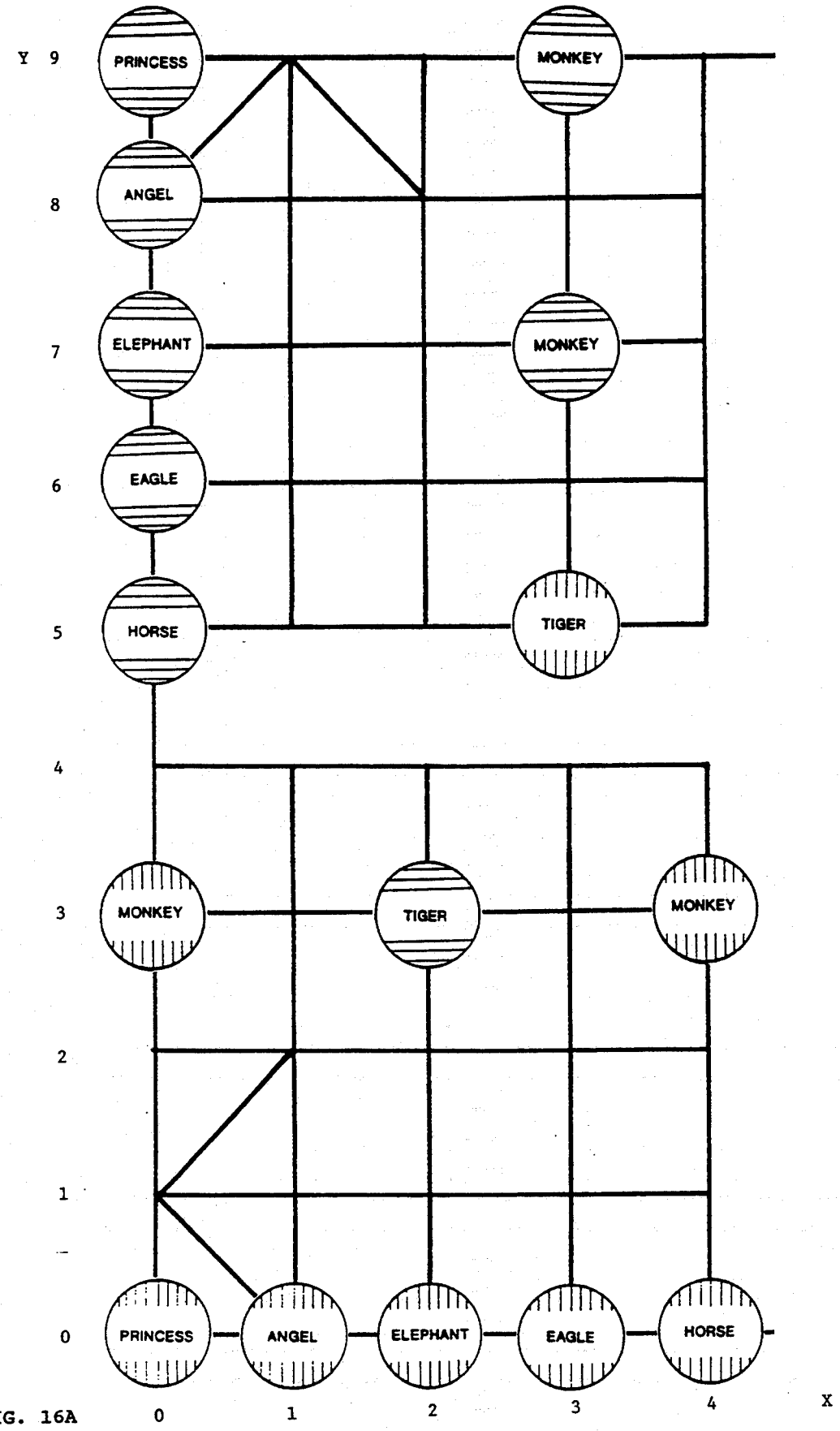

FIG. 16 depicts moving the blue tiger from 26 to 23 to replace the red monkey at 23.

Figure 17A:
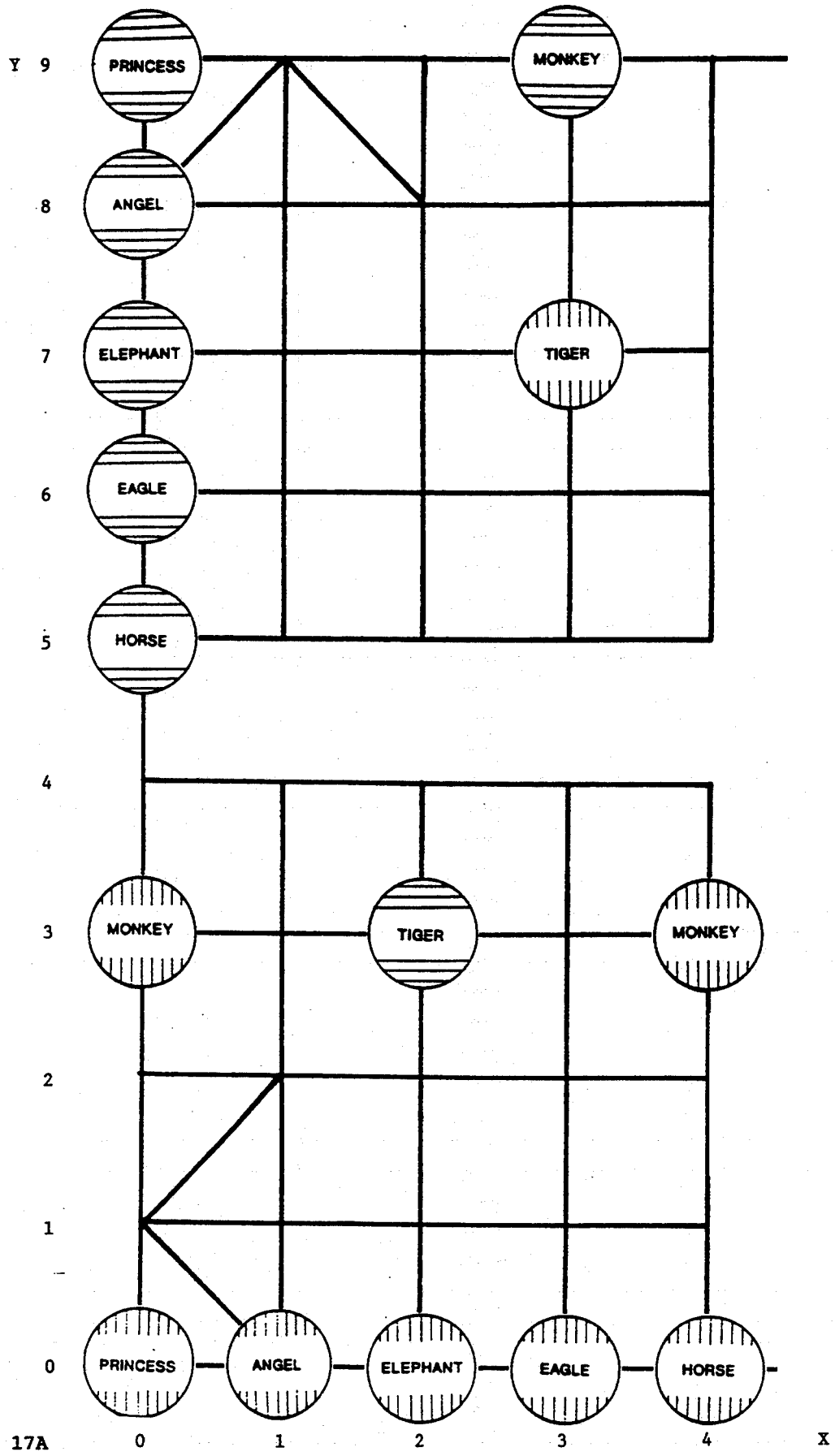
Figure 17B:
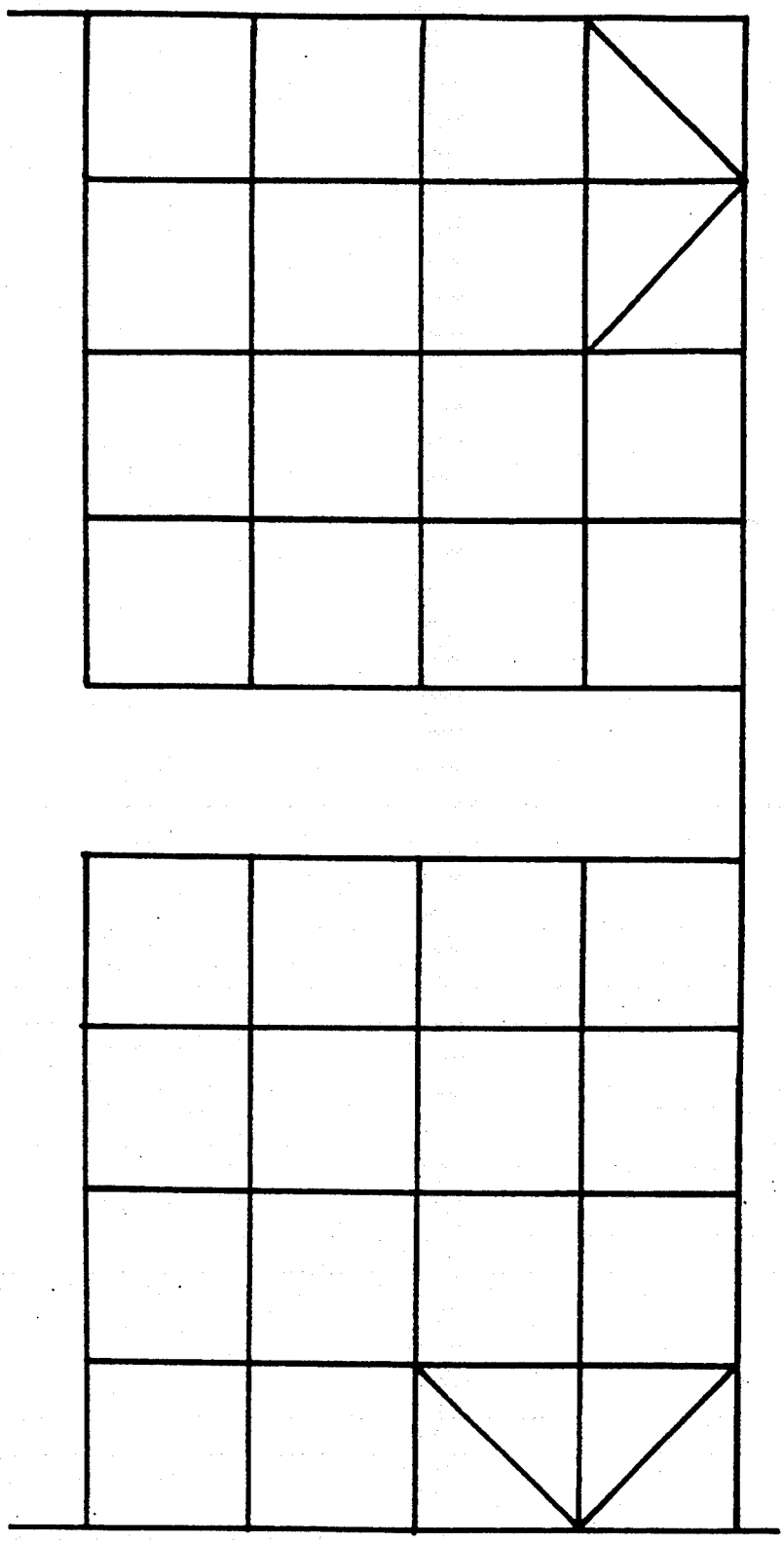

FIG. 17 illustrates moving the red tiger from 35 to 37 to replace the blue monkey 37.

Figure 18A:
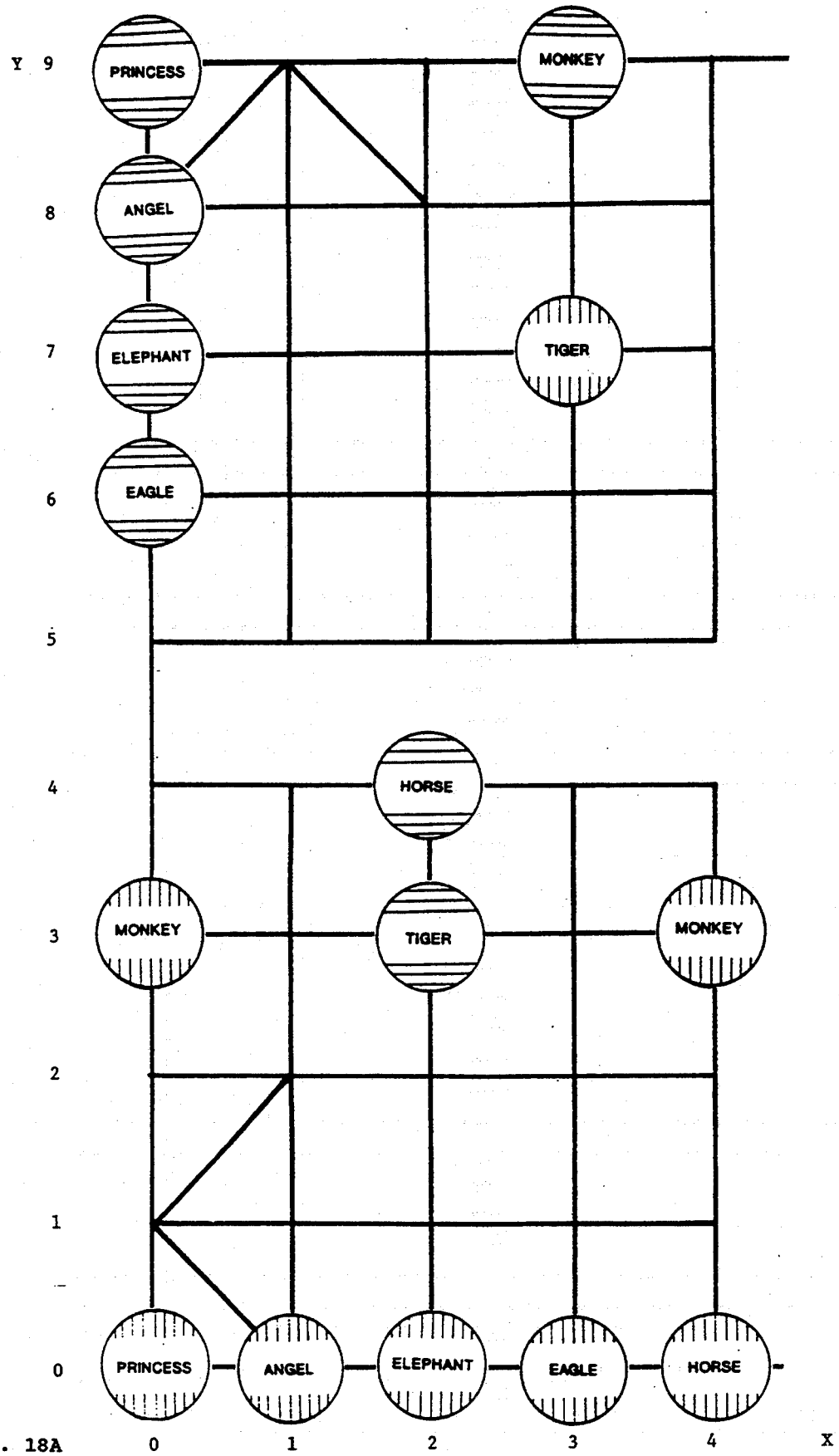

FIG. 18 displays moving the blue horse from 05 to 24 for the blue eagle at 06 to call the red princess at 00 darling.

Figure 19A:
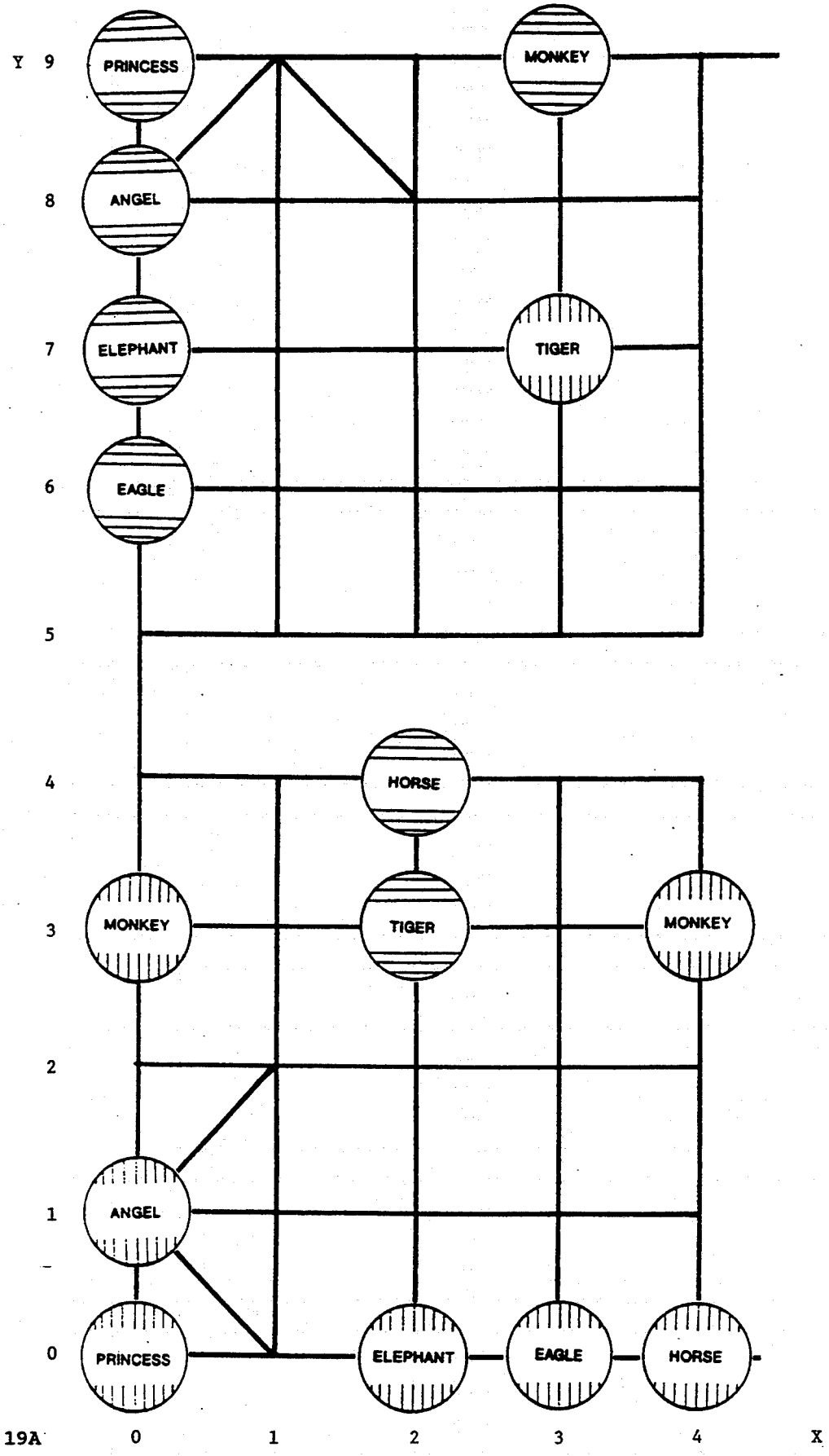

FIG. 19 illustrates moving the red angel from 10 to 01 to protect the red princess at 00 from being called darling by the blue eagle at 06.

Figure 20A:
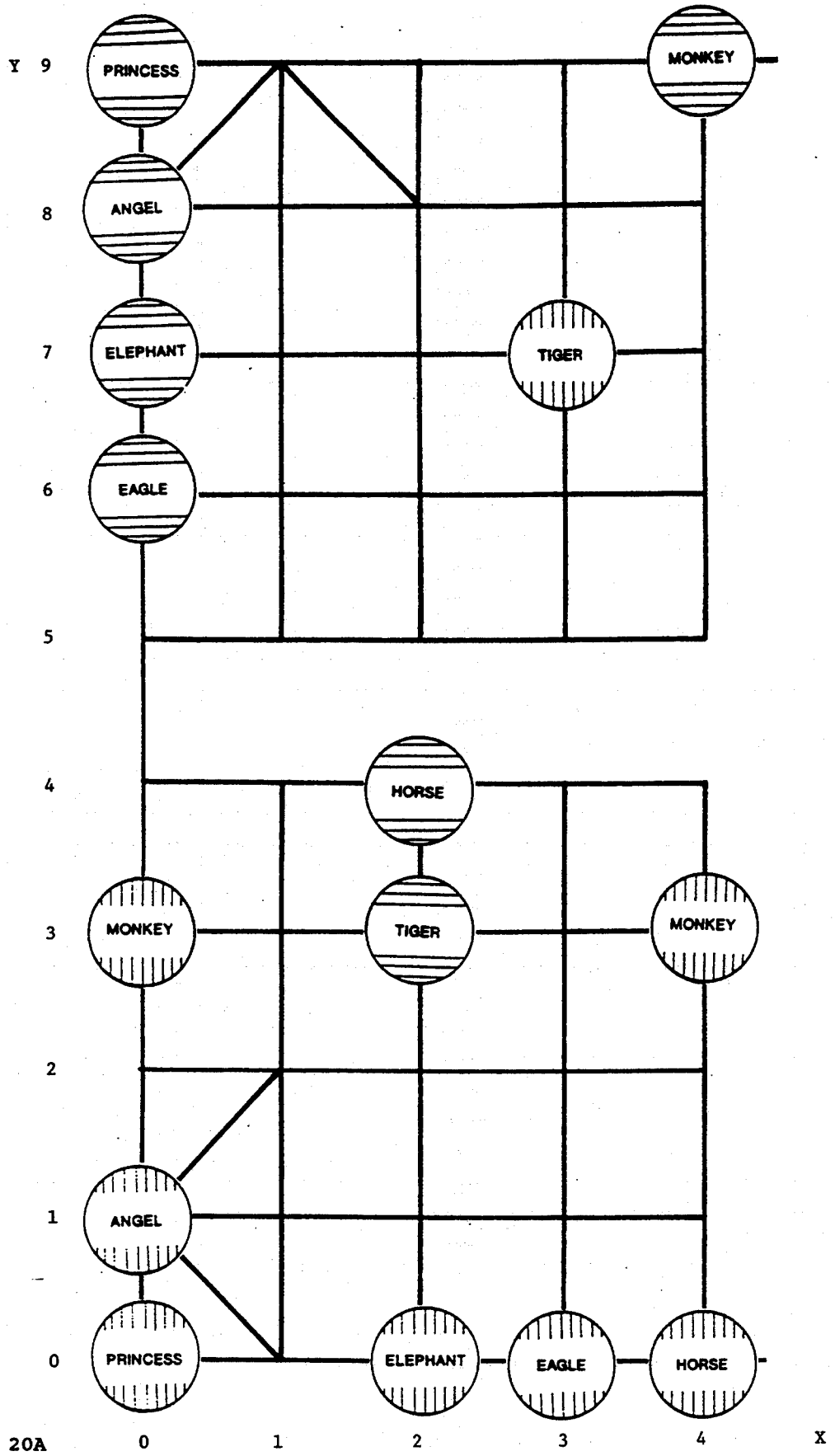

FIG. 20 shows moving the blue monkey from 39 to 49 to prevent the red tiger at 37 from replacing the blue monkey at 39 and from calling the blue princess at 09 darling at the same time.

Figure 21A:
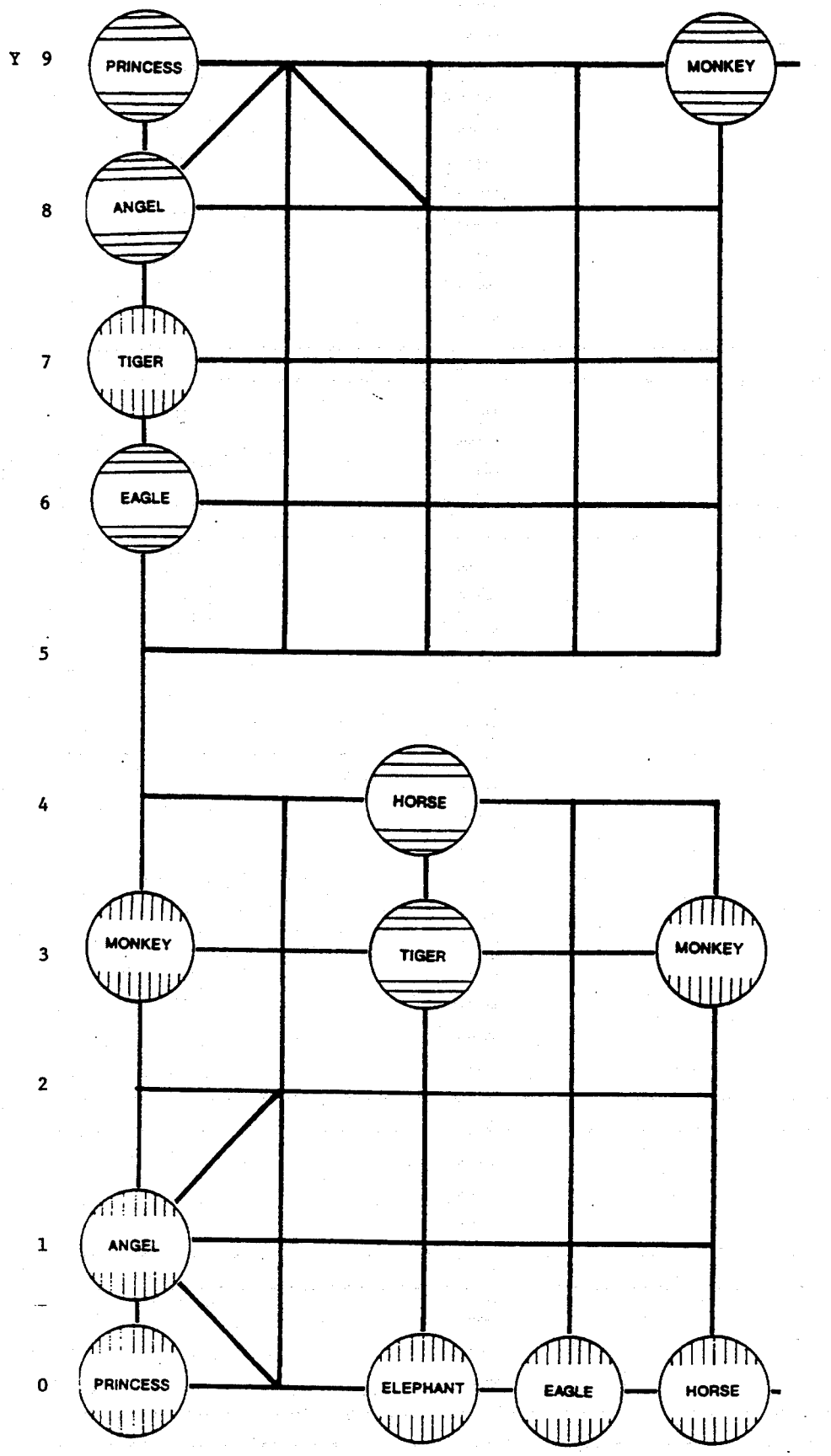

FIG. 21 depicts moving the red tiger from 37 to 07 to replace the blue elephant at 07.

Figure 22A:
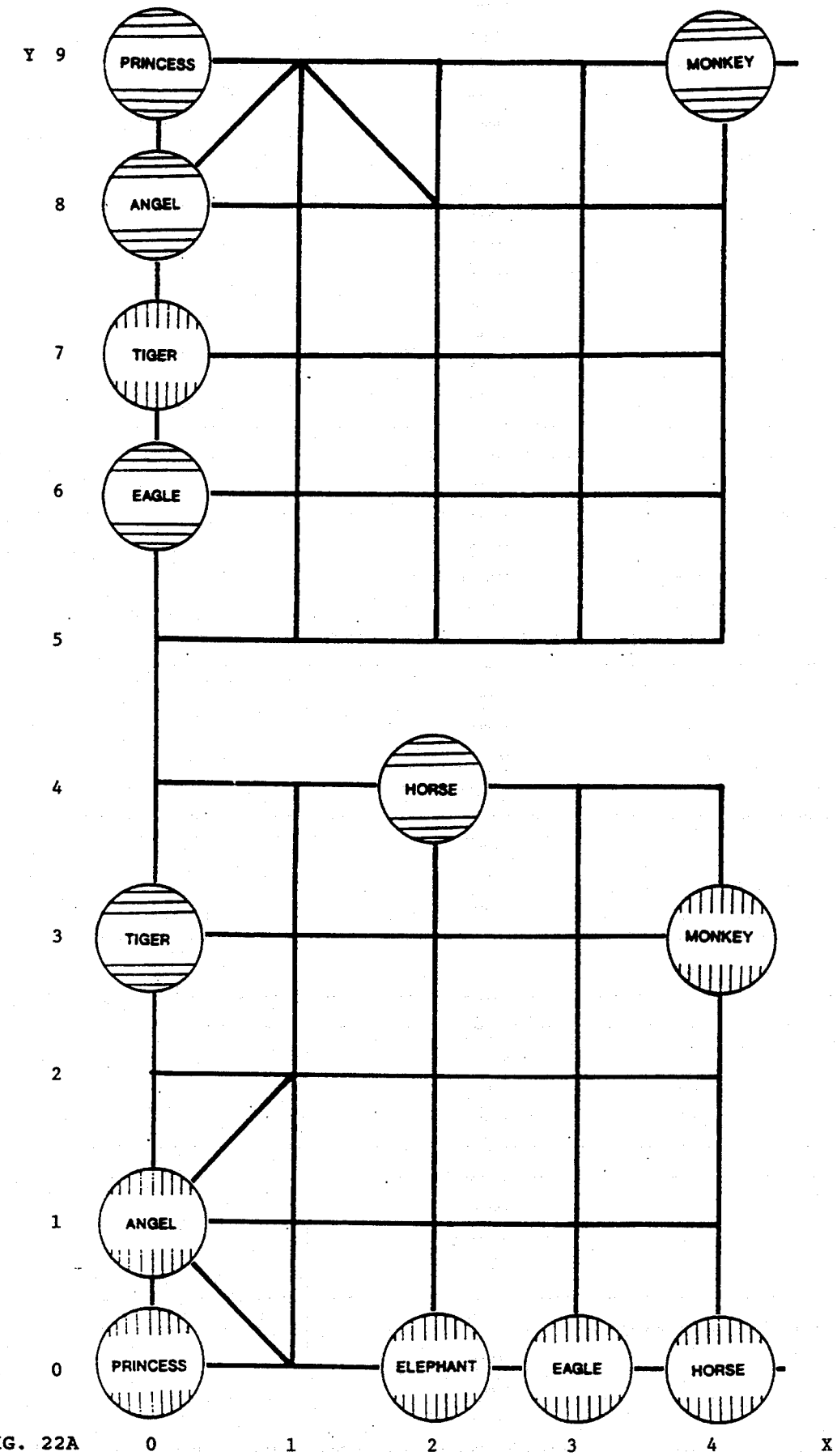

FIG. 22 displays moving the blue tiger from 23 to 03 to replace the red monkey at 03 and to protect the blue eagle at 06 from the red tiger at 07.

Figure 23A:
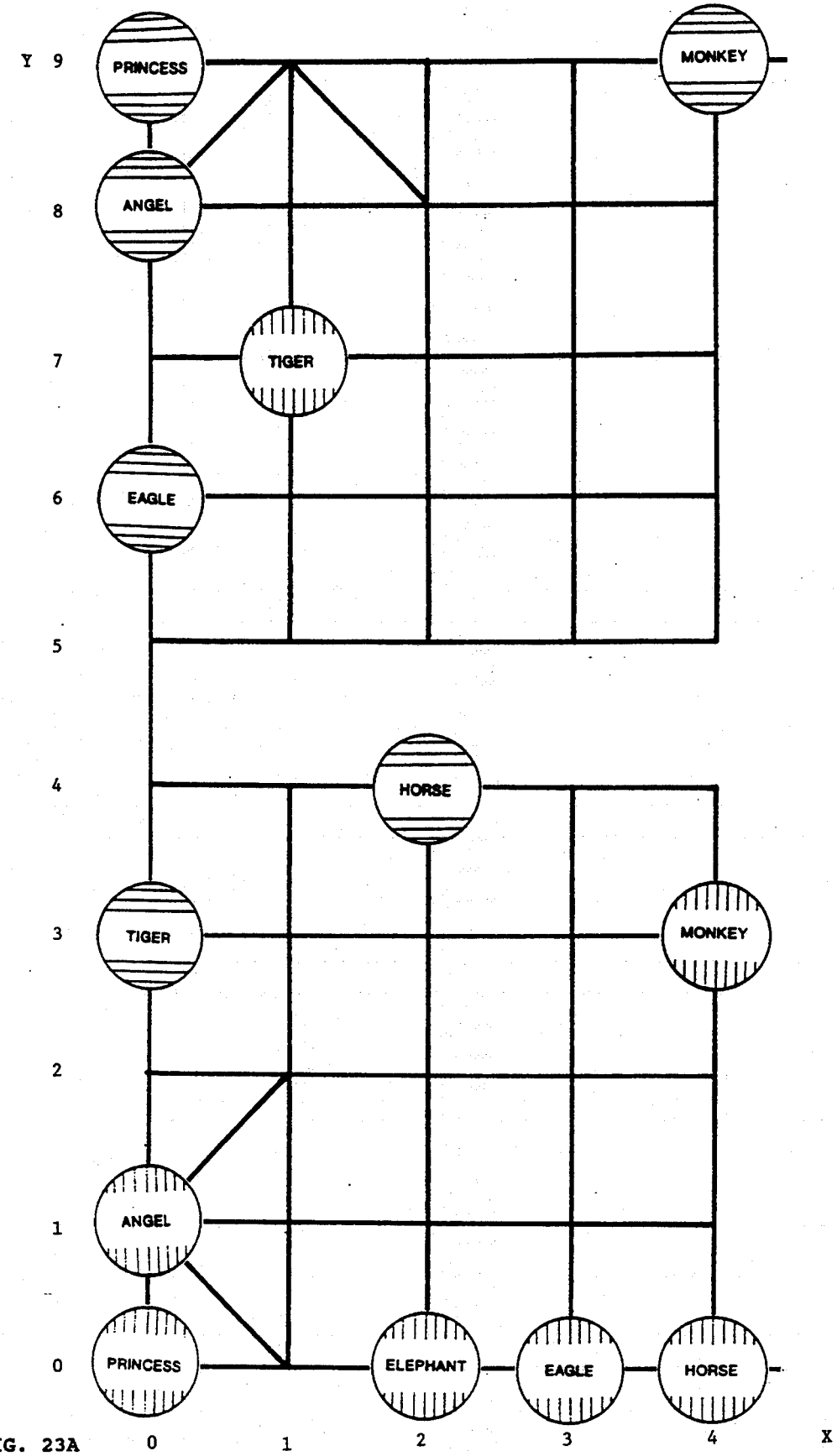

FIG. 23 illustrates moving the red tiger from 07 to 17 for stopping the blue horse at 24 from moving to 12 to call the red princess at 00 darling.

Figure 24A:
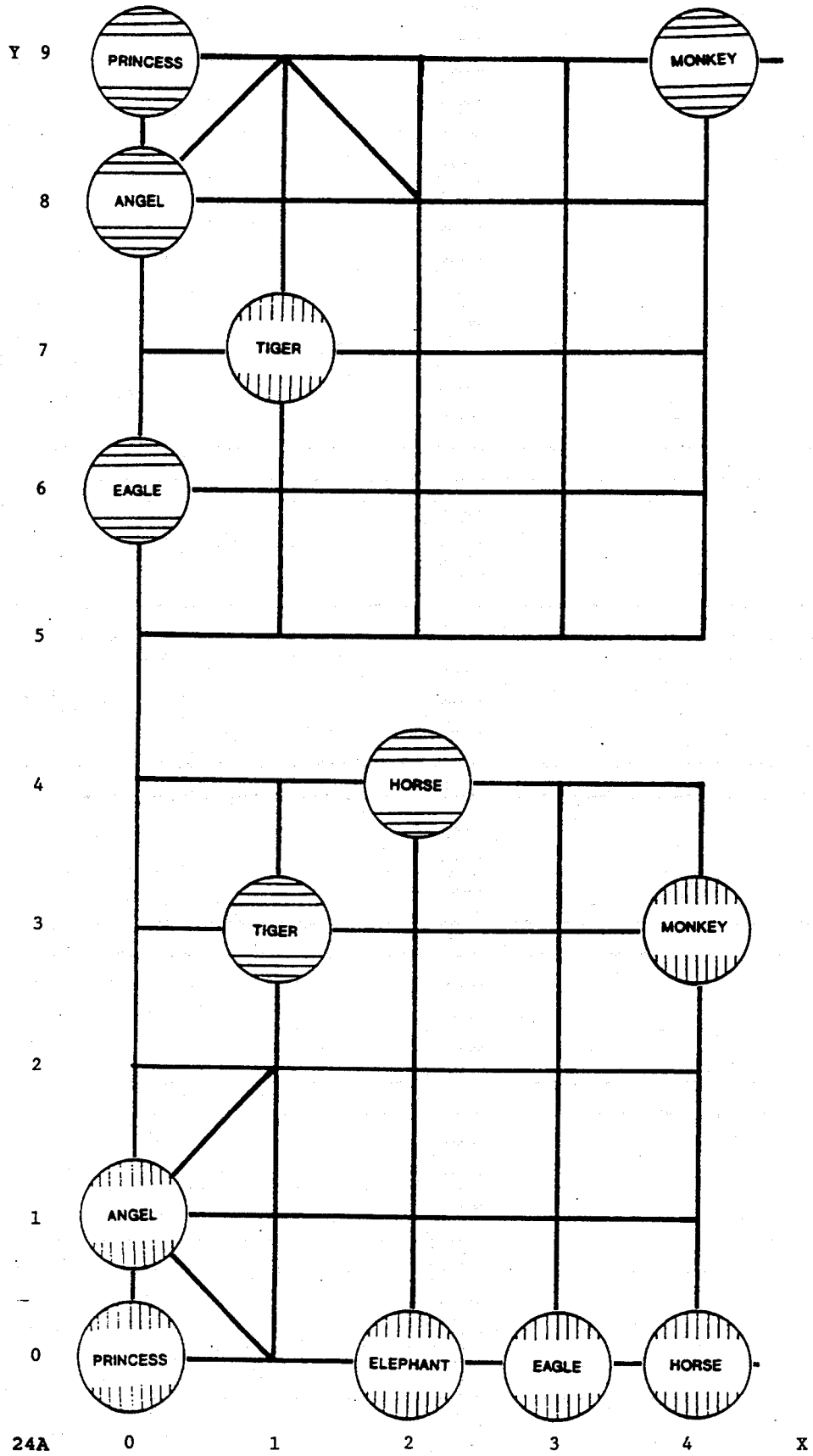

FIG. 24 displays moving the blue tiger from 03 to 13 for the blue eagle at 06 to call the red princess at 00 darling and to replace the red tiger at 17.

Figure 25A:
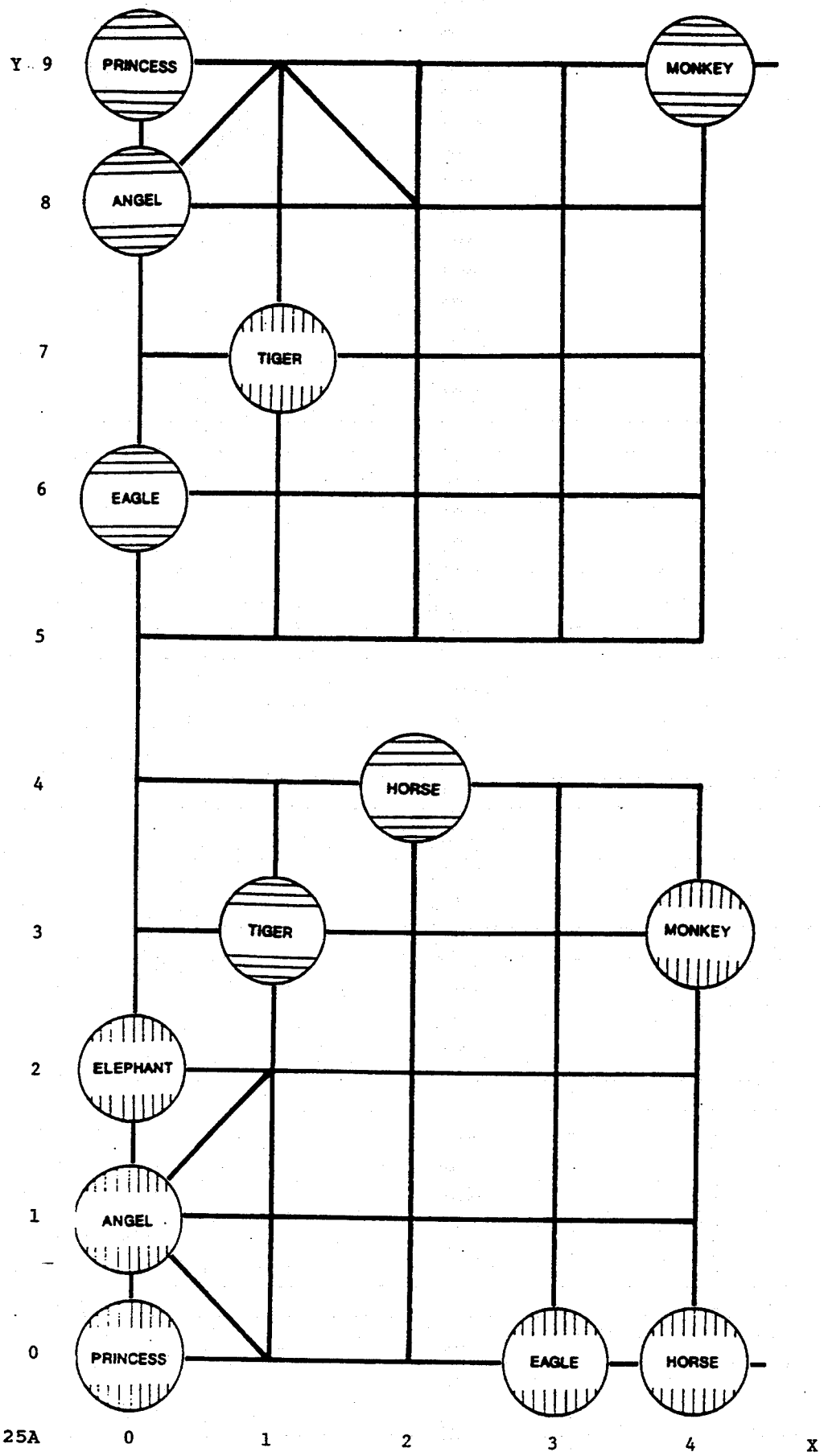

FIG. 25 shows moving the red elephant from 20 to 02 to protect the red princess at 00 from being called darling by the blue eagle at 06.

Figure 26A:
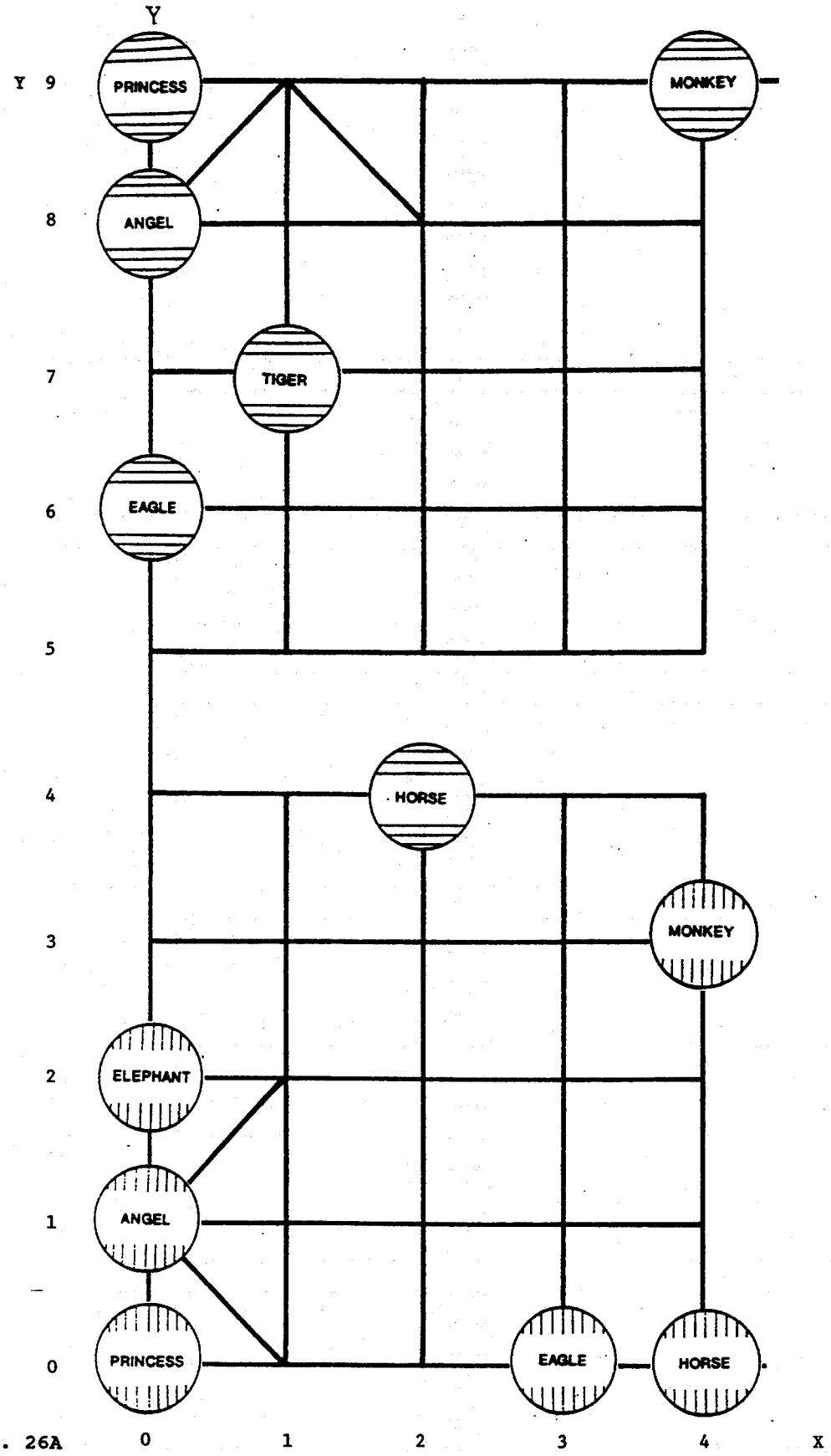

FIG. 26 depicts moving the blue tiger from 13 to 17 to replace the red tiger at 17.

Figure 27A:
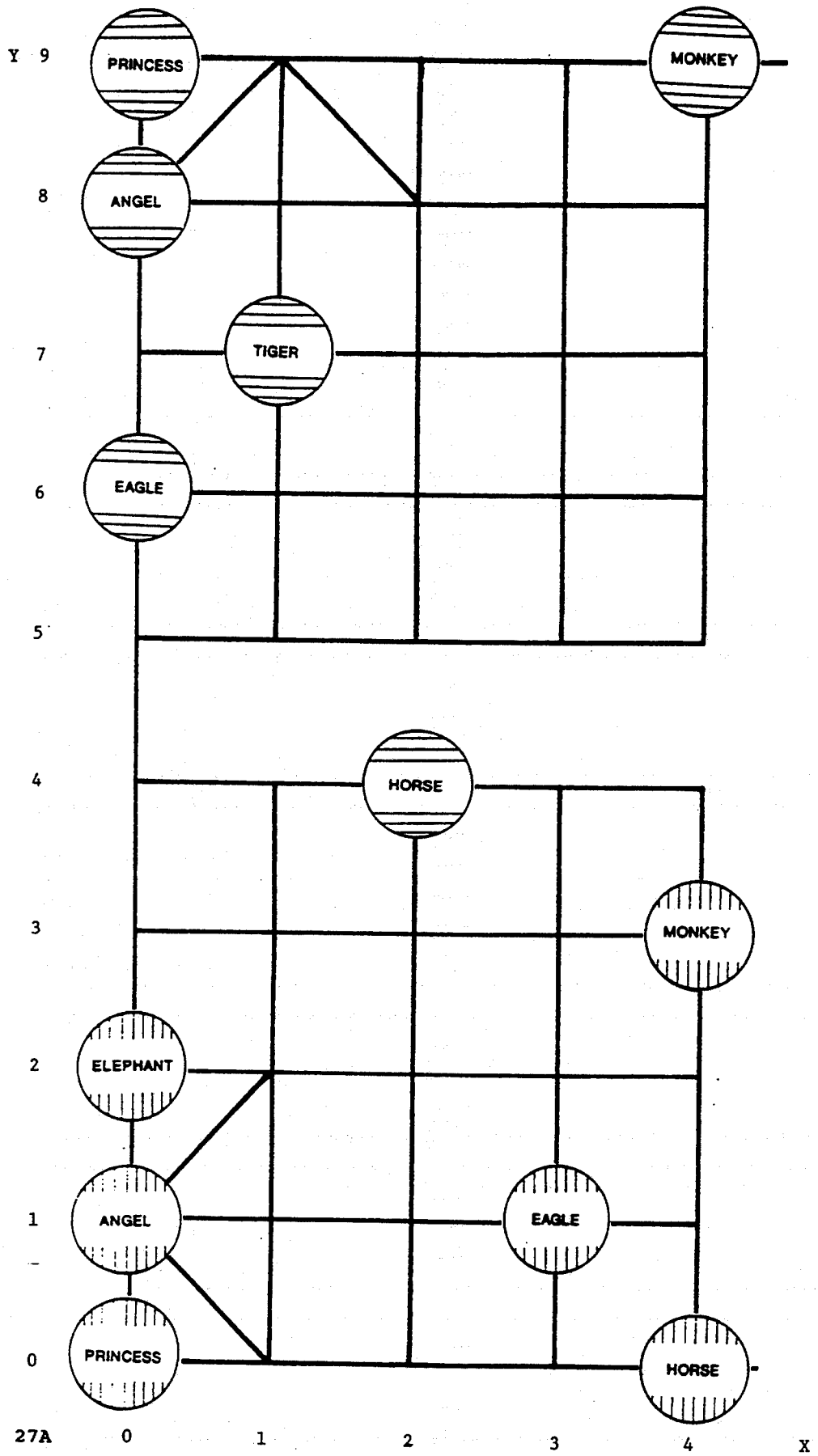

FIG. 27 illustrates moving the red eagle from 30 to 31 for protecting the red princess at 00 from being called darling by the blue horse at 24.

Figure 28A:
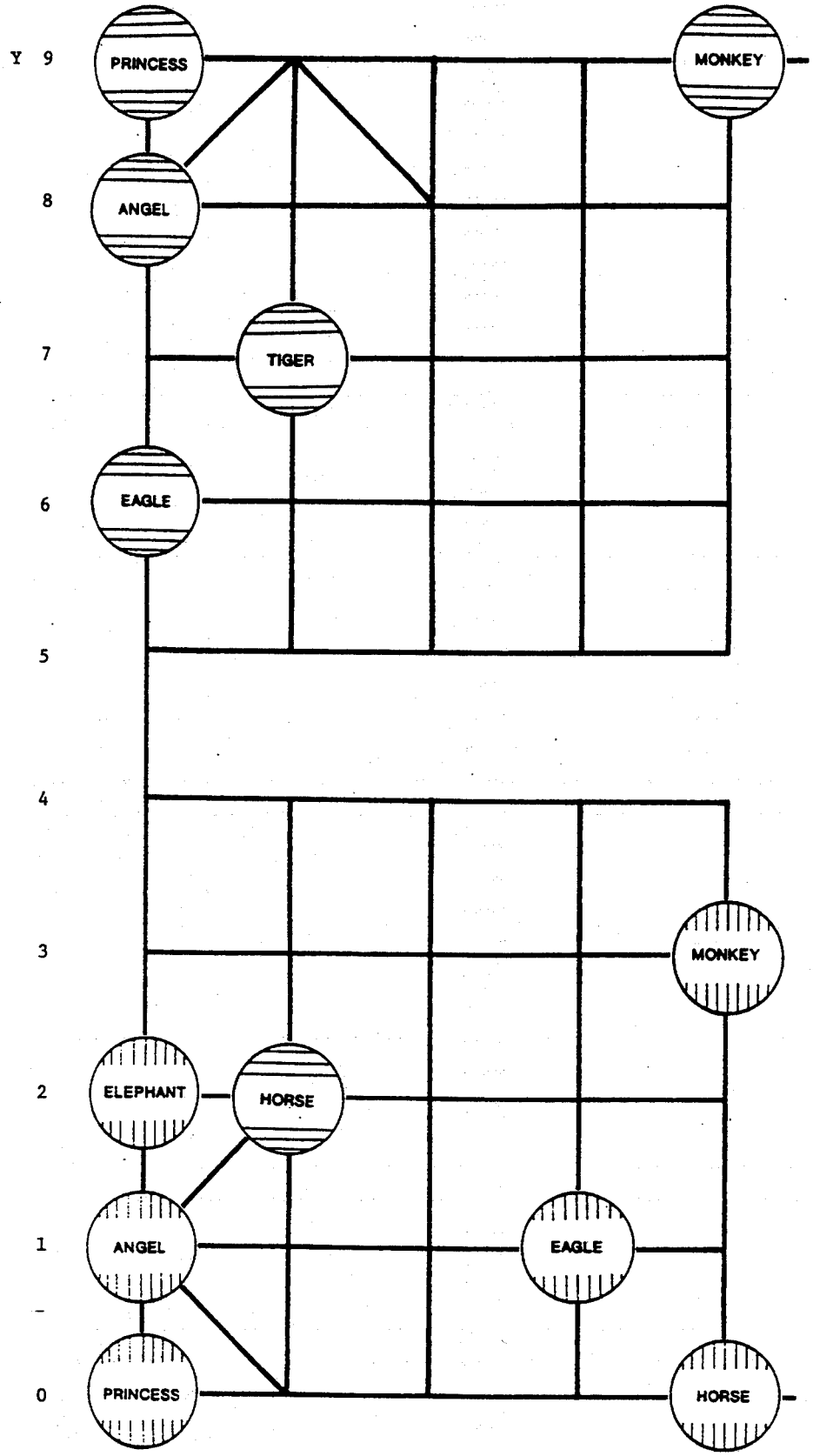

FIG. 28 displays moving the blue horse from 24 to 12 to call the red princess at 00 darling.

Figure 29A:
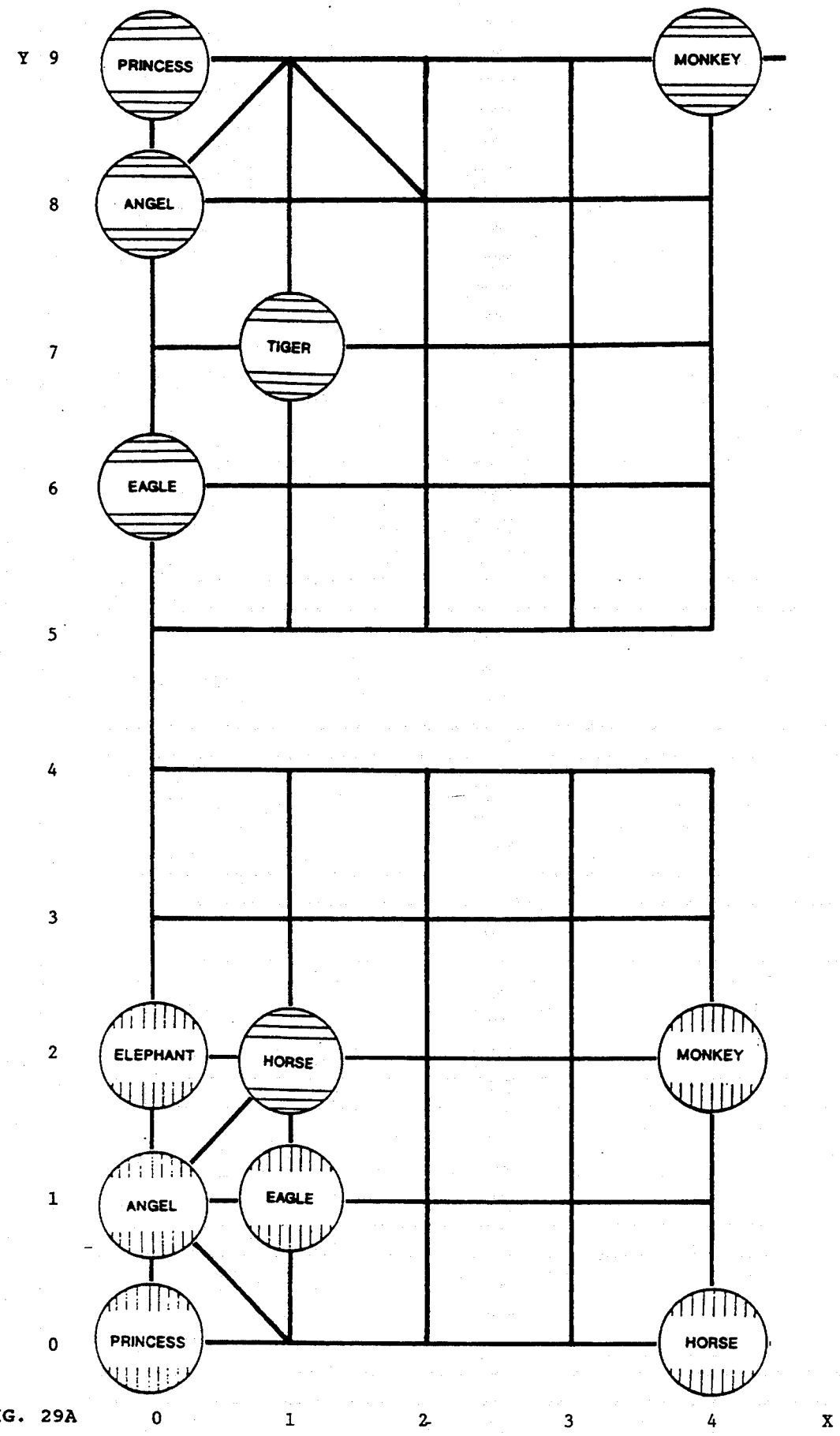

FIG. 29 illustrates moving the red eagle from 31 to 11 to the "first" point on the two-point segment of the horse path to prevent the blue horse at 12 from calling the red princess at 00 darling.

Figure 30A:
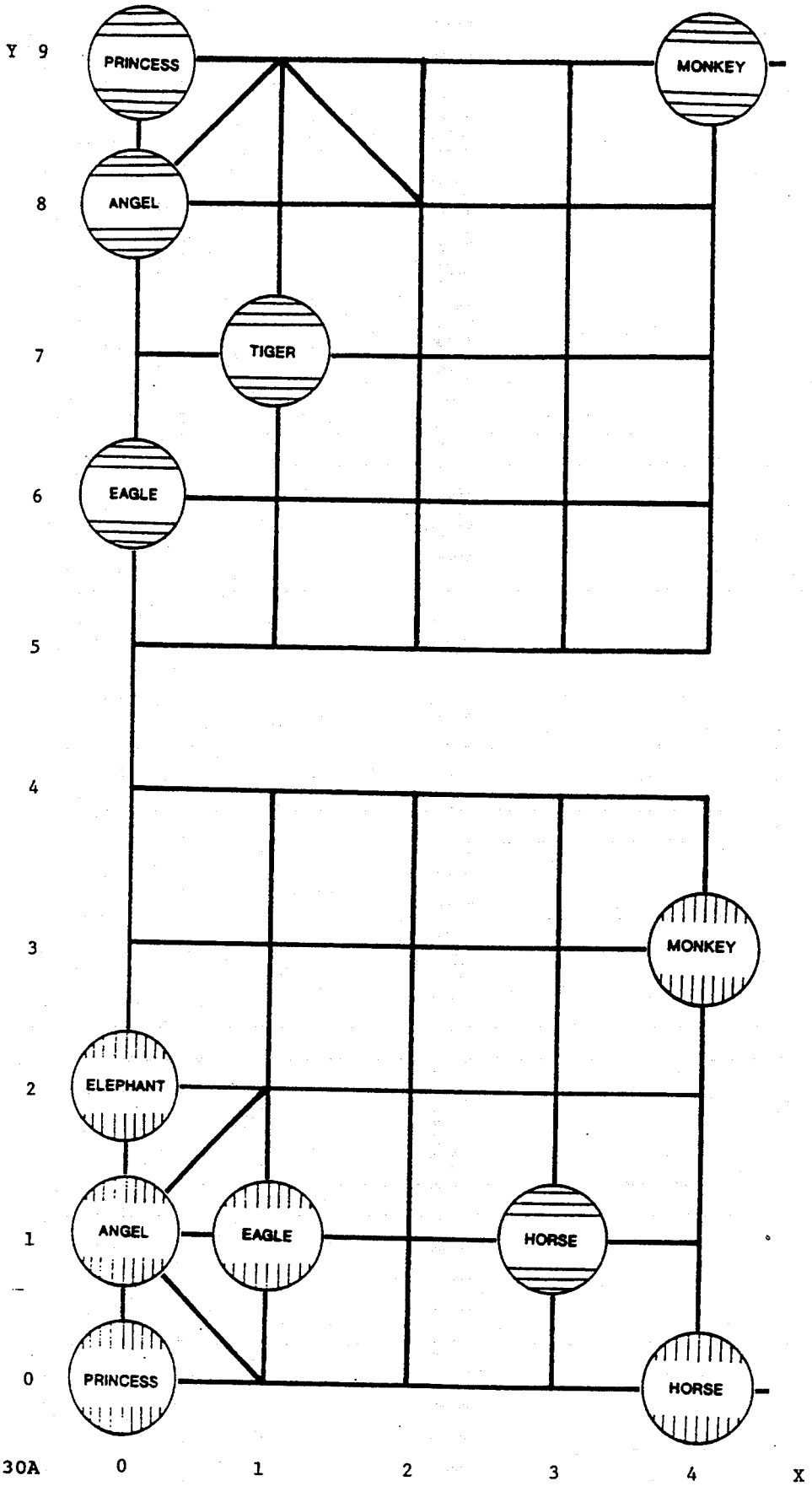

FIG. 30 depicts maneuvering the blue horse from 12 to 31.

Figure 31A:
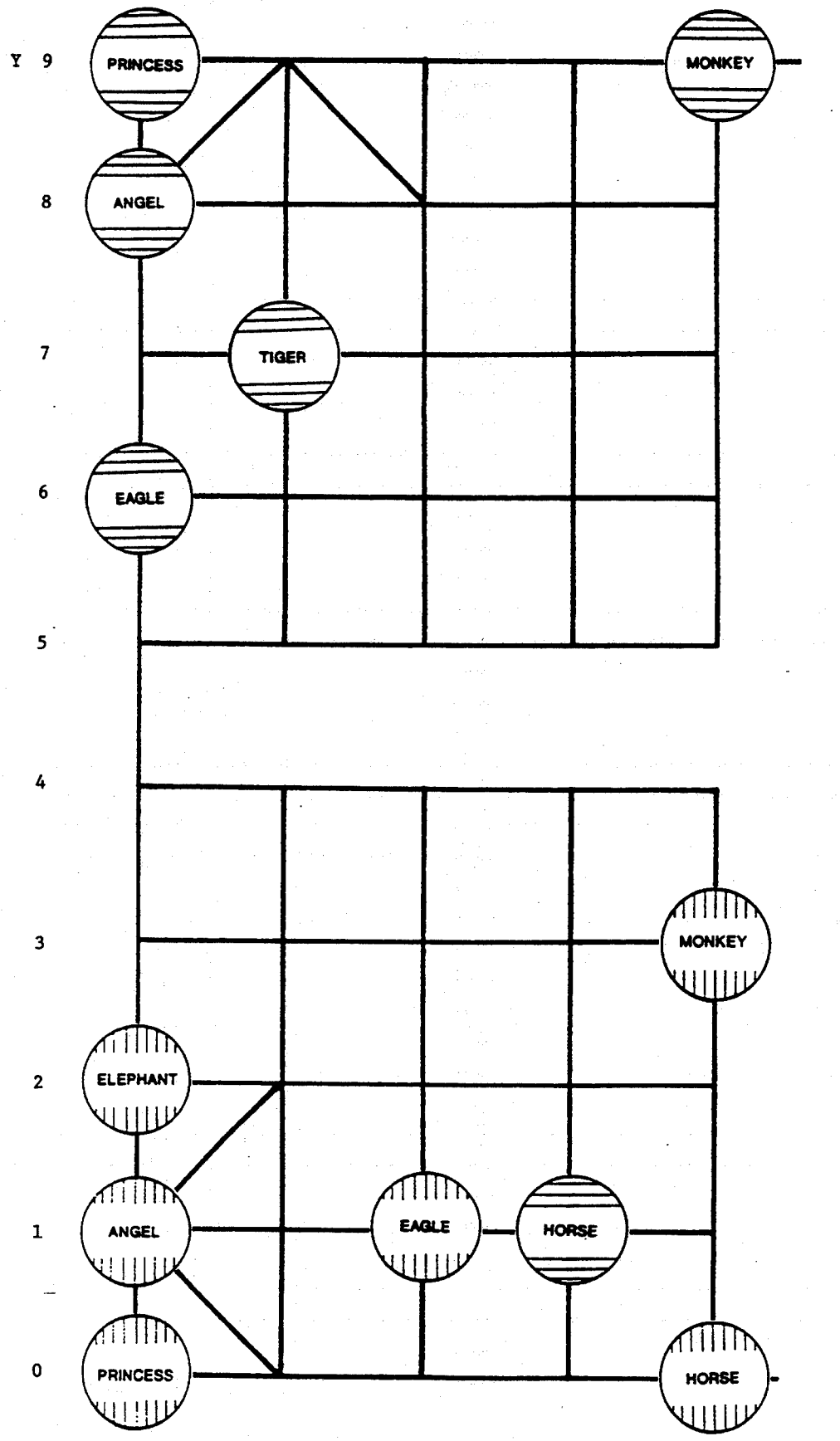

FIG. 31 shows moving the red eagle from 11 to 21 to block the blue horse at 31 from moving closer to the red princess at 00.

Figure 32A:
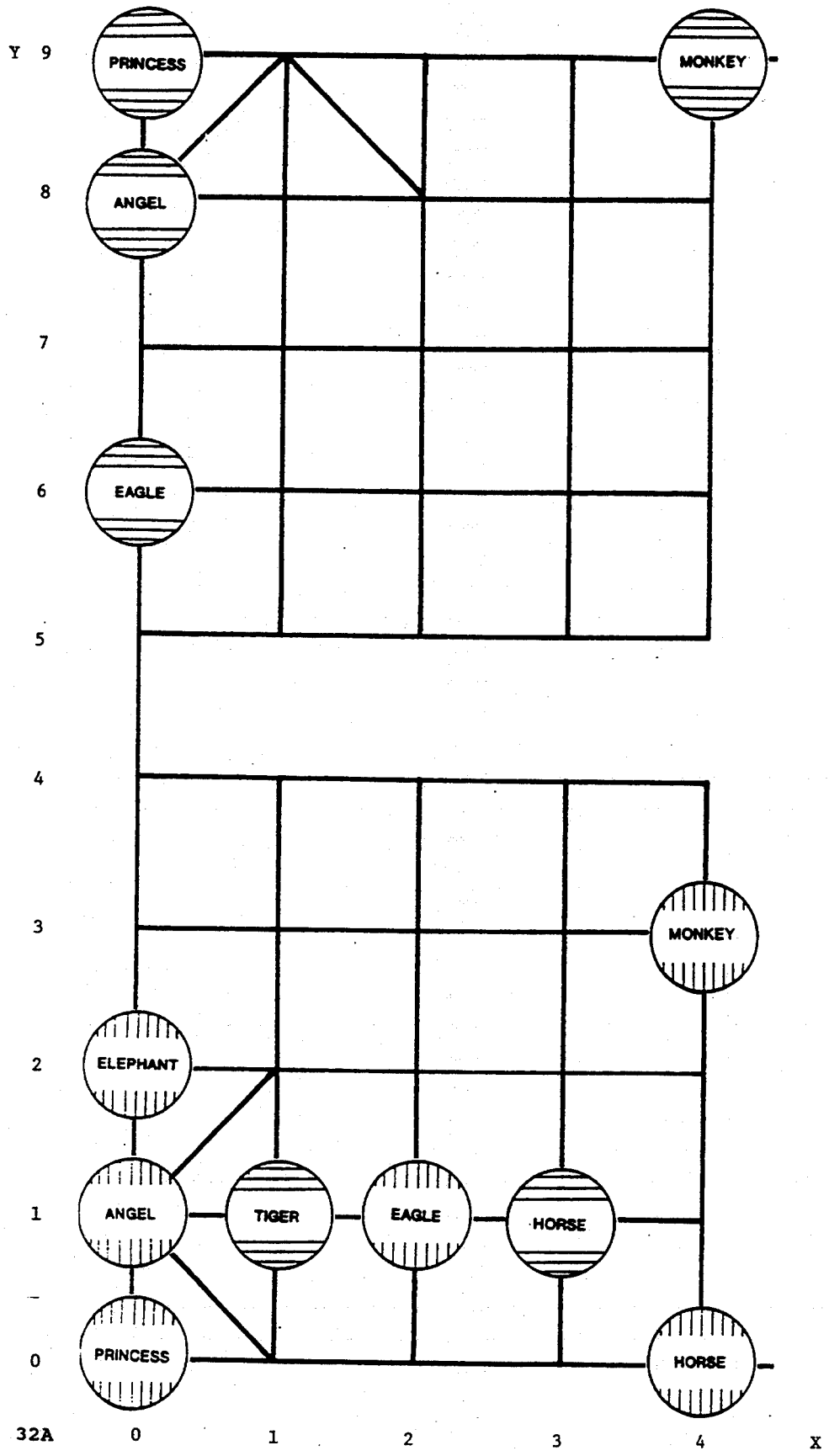

FIG. 32 illustrates maneuvering the blue tiger from 17 to 11.

Figure 33A:
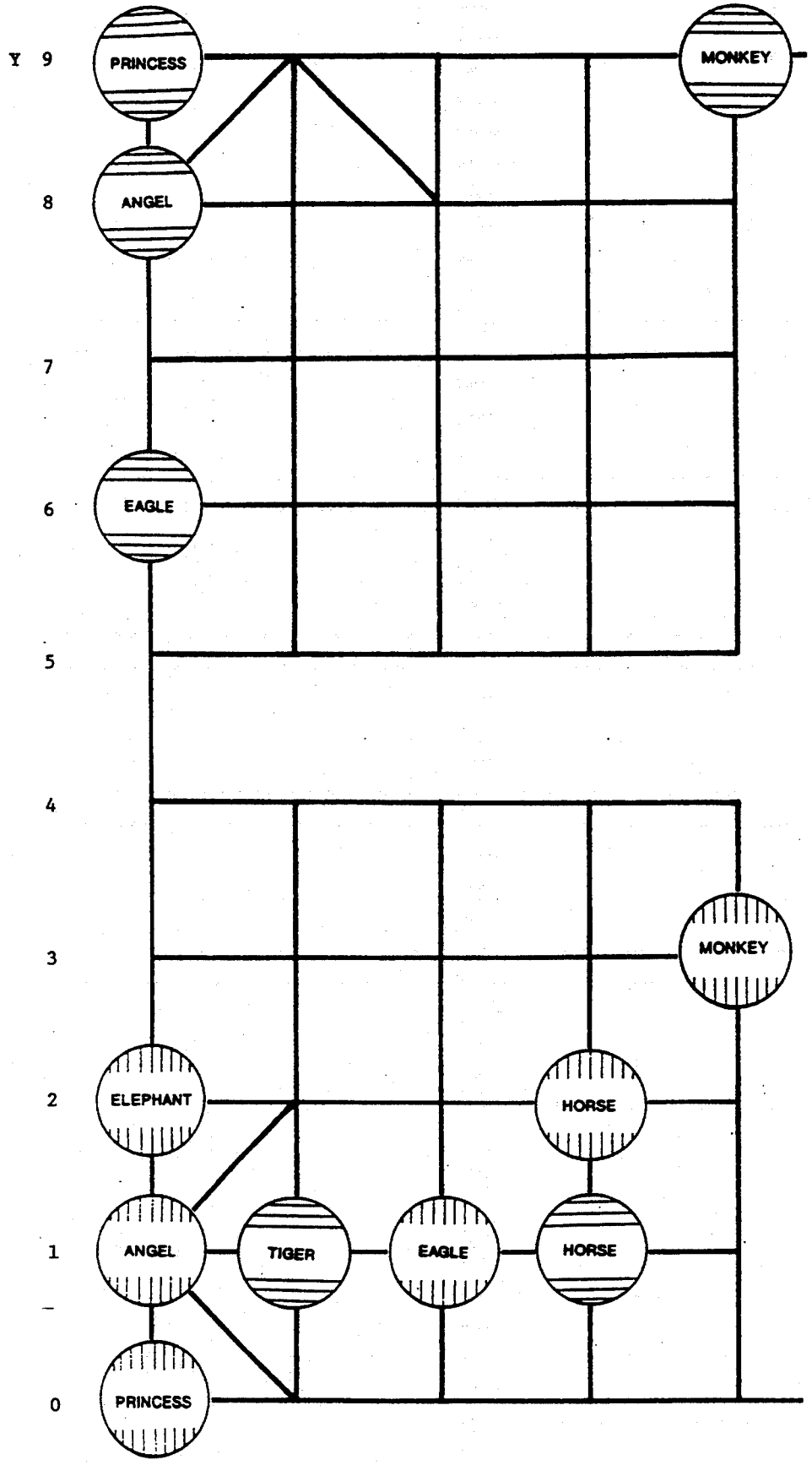
Figure 33B:
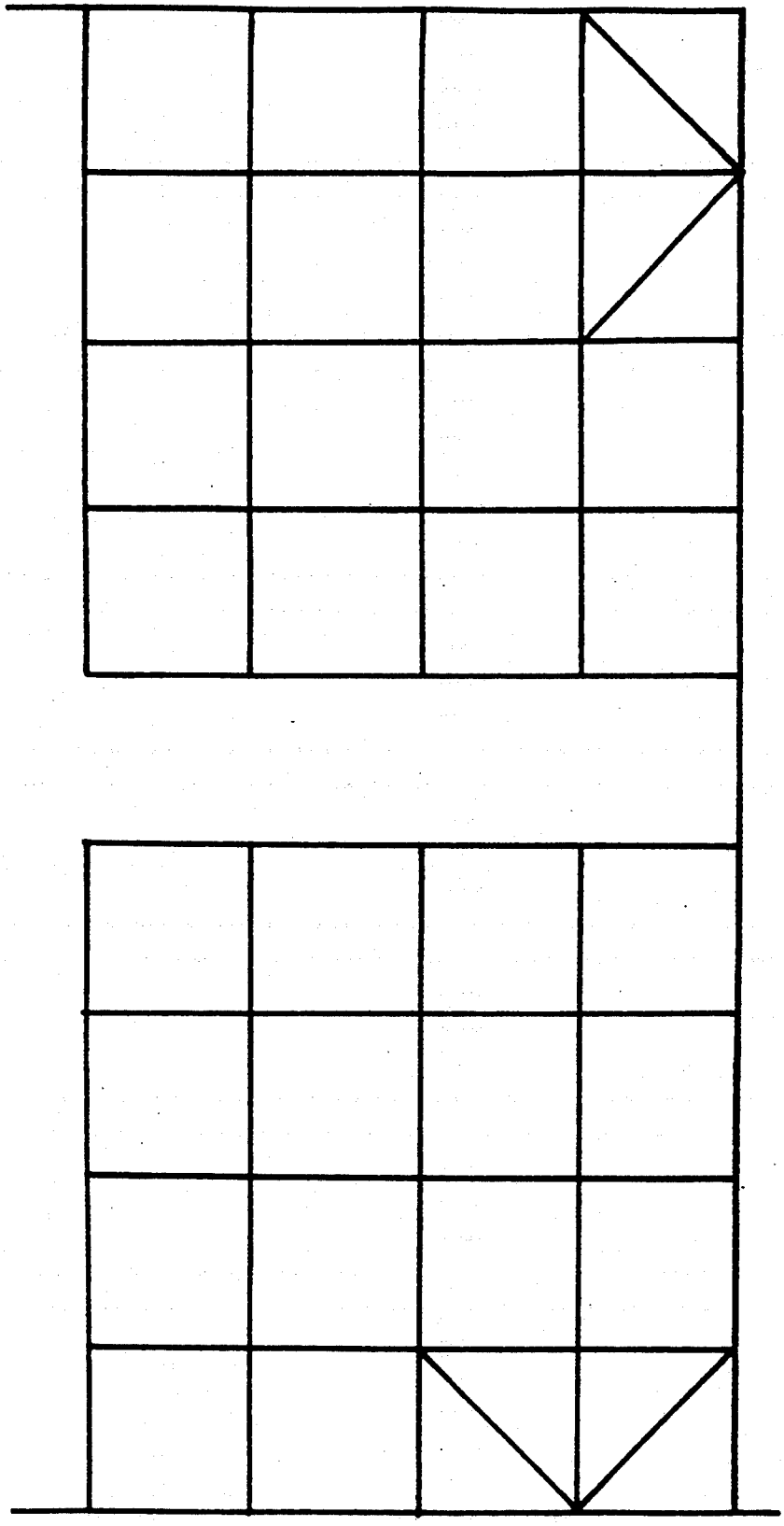

FIG. 33 displays maneuvering the red horse from 40 to 32.

Figure 34A:
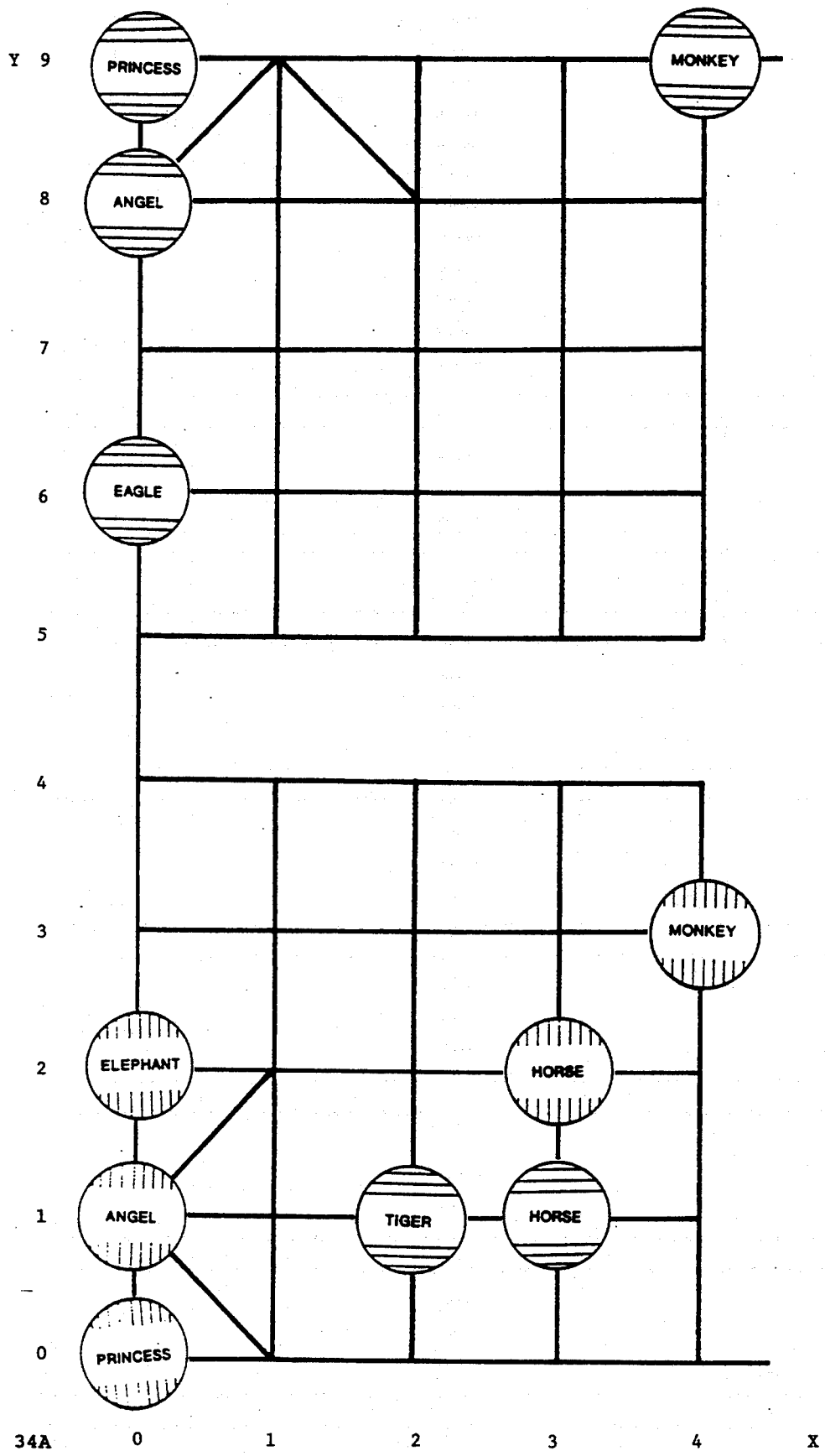

FIG. 34 illustrates moving the blue tiger from 11 to 21 to replace the red eagle at 21.

Figure 35A:
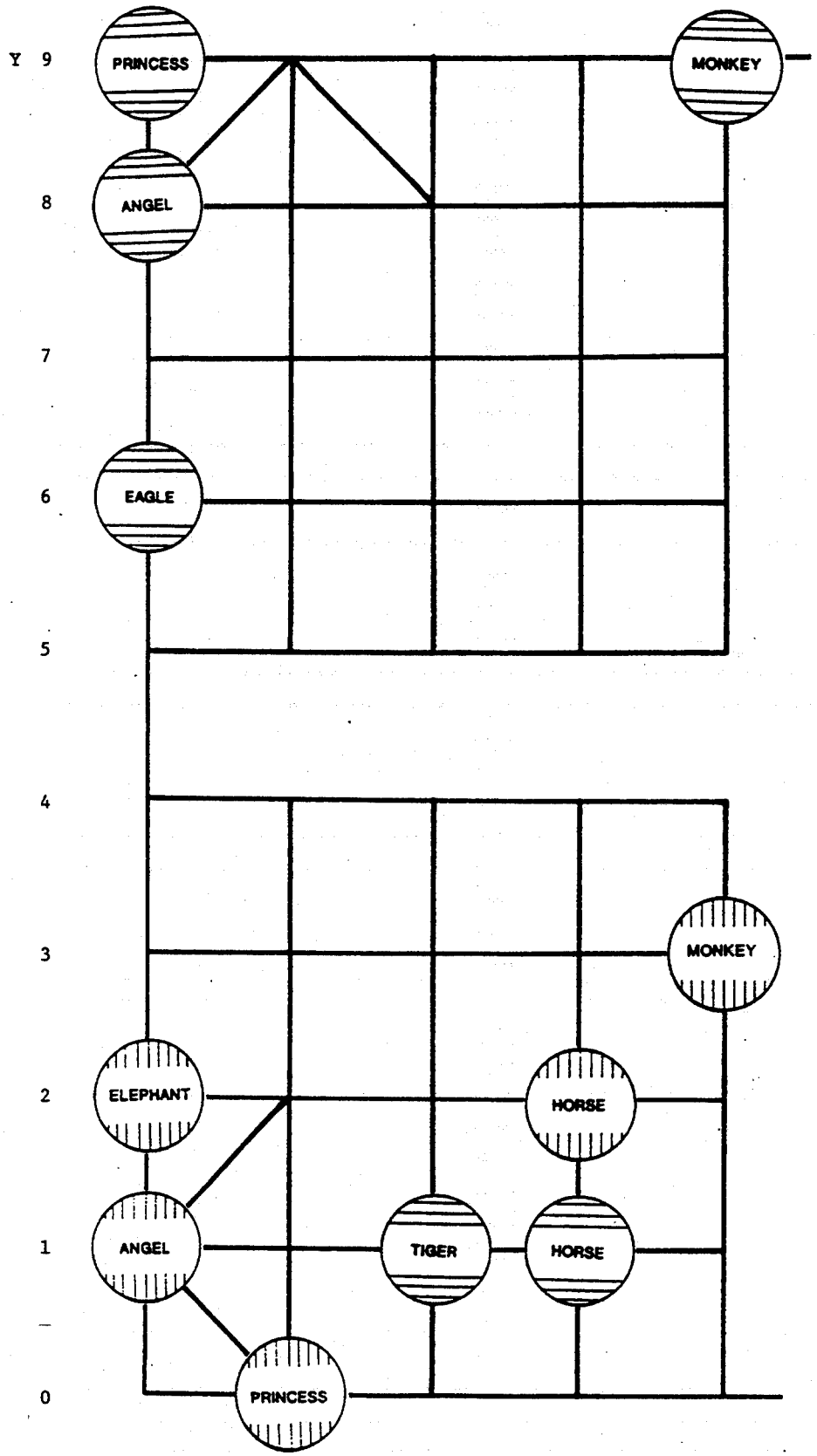

FIG. 35 shows moving the red princess from 00 to 10 to escape from a potential darling call.

Figure 36A:
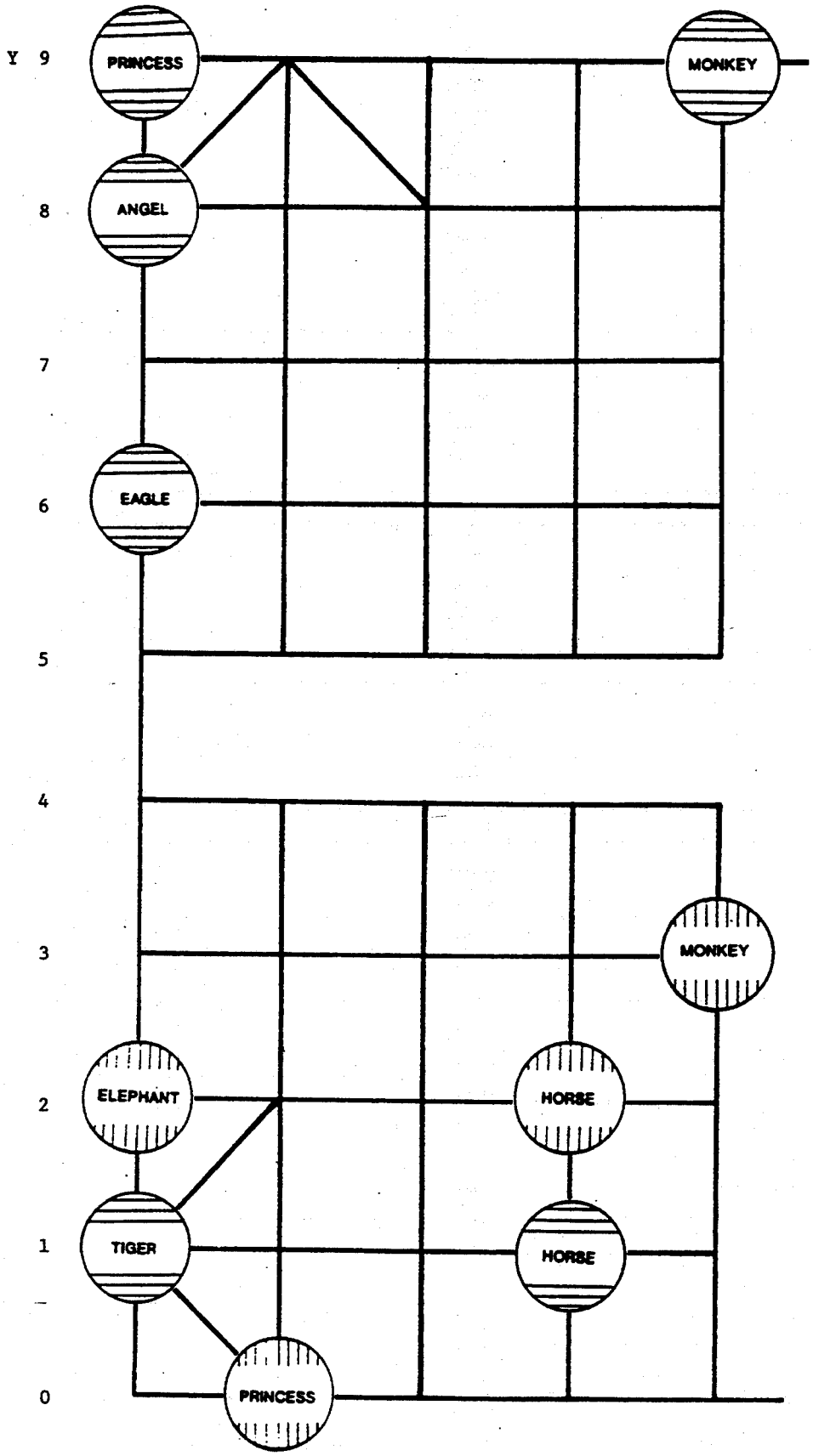
Figure 36B:
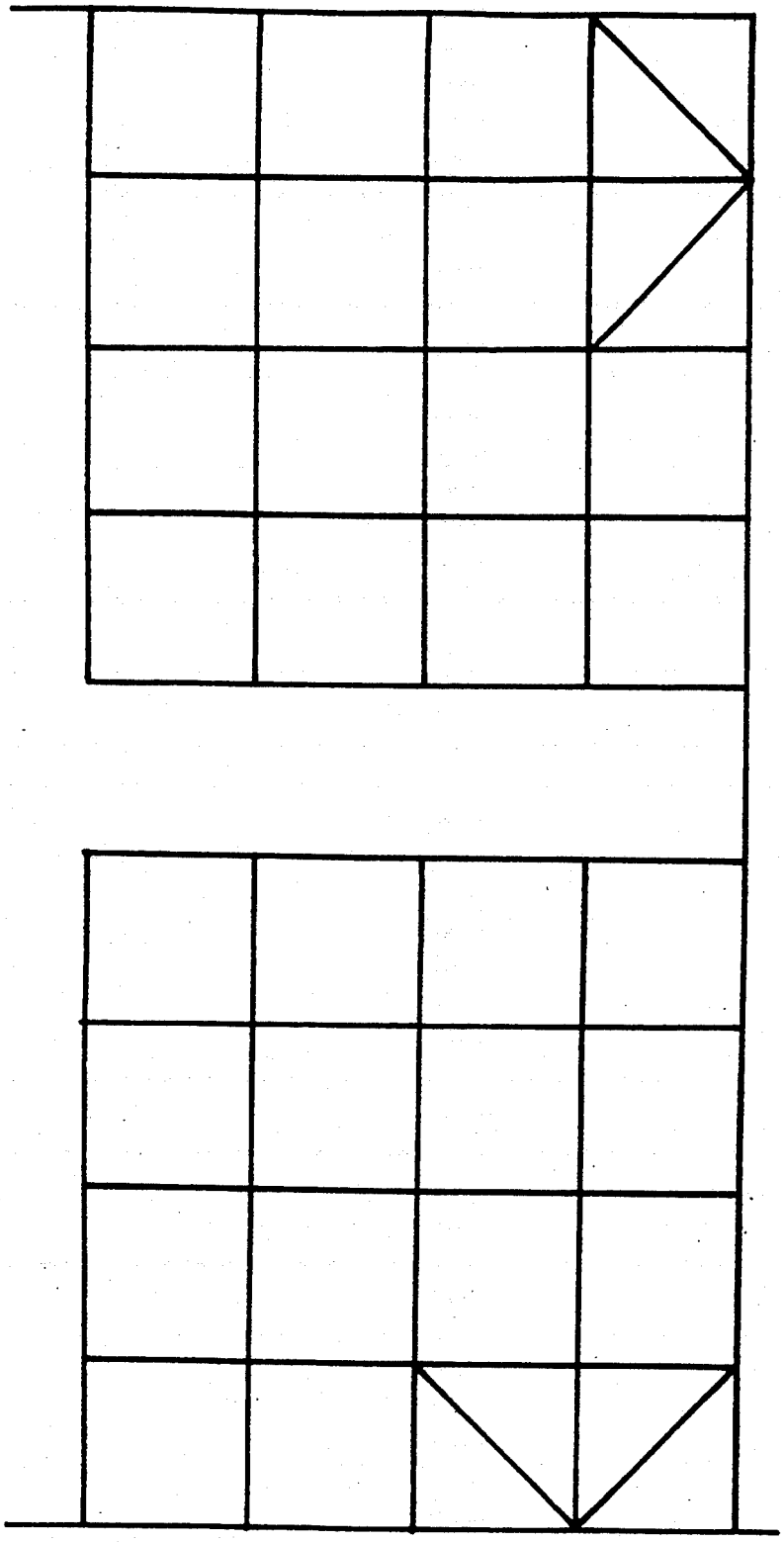

FIG. 36 displays moving the blue tiger from 21 to 01 to replace the red angel at 01 and to let the blue horse at 31 to call the red princess at 10 darling. The game is over.

RULES OF THE GAME

1. A prince playing piece may be used in lieu of a princess playing piece for a male player.
2. Prior to starting a game, each player shall choose a kingdom and a set of playing pieces. These pieces shall be positioned on the game board, as illustrated in FIG. 4, FIG. 5, or FIG. 6 for two, three, or four players, respectively.
3. Players shall decide who moves first.
4. Each player must move, in turn, a playing piece regardless of the consequences.
5. A playing piece is moved to an intersecting point, in accordance to its movement ability, to an unoccupied point or to replace an opponent.
6. A player's turn finishes after he has moved his playing piece.
7. When a playing piece "meets" an opposing princess, that piece woos the princess by calling her a "darling." That princess must respond immediately by moving to another point within her palace, or by moving a teammate to defend her. When the princess can neither escape from the calling message nor be protected, she loses the game and all of her team patriots must leave the game board.
8. When said rule 7 is executed, the turn of play continues with the princess's player.
9. The last princess on the game board wins the game.
10. If the game comes to a draw, the winner shall be determined by the value of each playing piece's strength. The strength value of each playing piece is assigned as follows:

| Playing Piece | Strength Value |
|---|---|
| Princess | 1280 |
| Angel | 640 |
| Tiger | 320 |
| Horse | 160 |
| Eagle | 80 |
| Elephant | 40 |
| Monkey (each) | 10 |

The strength value for a player at drawing time is the sum of the values of his/her remaining pieces.

11. In tournaments, the strength value can be used to decide the winner and rankings of the players.

What is claimed is:

1. A method of playing a strategic board game playable by two, three, or four persons comprising the steps of:

a. providing a four-sided game board defined by ten perpendicularly intersecting horizontal and vertical lines forming 100 intersecting points, said 100 points being divided into four squares that represent four kingdoms, said four kingdoms each having twenty five points being located in the bottom left, upper left, upper right, and bottom right corners separated by two blank rectangles that form a blank cross in the middle, said four kingdoms each having a palace of two by three points, said palace of said bottom left kingdom being located vertically in said kingdom's bottom left corner, said palace of said upper left kingdom being located horizontally in said kingdom's upper left corner, said palace of said upper right kingdom being located vertically in said kingdom's upper right corner, said palace of said bottom right kingdom being located horizontally in said kingdom's bottom right corner, said four palaces each having two diagonal lines that meet at the midpoint of the outer line of said palace;

b. providing four sets of playing pieces, said sets being distinguishable one from another with characteristics such as color, and comprising the following pieces per set: one princess, one angel, one elephant, one eagle, one horse, one tiger, and three monkeys;

c. providing predetermined movement abilities for each playing piece;

d. assigning each set of playing pieces to up to four different players;

e. positioning said playing pieces on the points of said game board;

f. players moving one of their playing pieces in accordance to its predetermined movement abilities, said predetermined movement abilities comprising:

When a playing piece moves to a point occupied by an opposing playing pieces, said opposing playing pieces is removed from the board;

moving said princess one point in any horizontal or vertical direction to a point within her respective palace without jumping over said other playing pieces;

moving said angel one point in any diagonal direction to a point within the palace of her princess's without jumping over said other playing pieces;

moving said elephant on a two point path in any diagonal direction to a point within its own kingdom without jumping over said other playing pieces;

flying said eagle in any horizontal, or vertical, path to an empty point in any kingdom without flying over said other playing pieces, or flying said eagle in any horizontal, or vertical, path over a teammate or an opponent playing piece to the next point being occupied by an opposing playing piece to replace that piece;

moving said horse on a three point path to a point in any kingdom, said path consists of either a two-point horizontal segment and a one-point vertical segment, or a two-point vertical segment and a one-point horizontal segment, with the first point on said two-point segment being empty and the second point on said two-point segment being either empty or occupied by any playing piece;

moving said tiger in any horizontal, or vertical, path to a point in any kingdom without jumping over other said playing pieces;

moving said monkey one point in any horizontal, or vertical, direction to a point in any kingdom without jumping over other said playing pieces.

2. The method of claim 1 wherein there are four sets of playing pieces, each of said sets having nine playing pieces, each of said playing pieces being made of moldable materials such as paper, plastic, glass, wood or metal in a solid cylinder or in a form with a representation of a word, shape or symbol of an animal, human being or thing.

* * * * *